US007921992B2

(12) United States Patent
LaRue et al.

(10) Patent No.: US 7,921,992 B2
(45) Date of Patent: Apr. 12, 2011

(54) CONTAINER HAVING INTERNAL RESERVOIR

(75) Inventors: Jon Michael LaRue, Lake Villa, IL (US); Craig Edward Cappel, Lake Villa, IL (US); Frank Andrew Petlak, Antioch, IL (US)

(73) Assignee: Pactiv Corporation, Lake Forest, IL (US)

( * ) Notice: Subject to any disclaimer, the term of this patent is extended or adjusted under 35 U.S.C. 154(b) by 236 days.

(21) Appl. No.: 11/559,653

(22) Filed: Nov. 14, 2006

(65) Prior Publication Data

US 2007/0178197 A1 Aug. 2, 2007

Related U.S. Application Data

(60) Provisional application No. 60/737,023, filed on Nov. 14, 2005.

(51) Int. Cl.
*B65D 81/26* (2006.01)

(52) U.S. Cl. ..... 206/204; 206/557; 426/129

(58) Field of Classification Search ..... 206/204, 206/205, 557, 524.6, 64, 514, 515, 518, 562, 206/583, 216, 223; 426/124, 129, 106, 326, 426/229, 407

See application file for complete search history.

(56) References Cited

U.S. PATENT DOCUMENTS

| | | | | | |
|---|---|---|---|---|---|
| 2,732,696 | A | * | 1/1956 | Baker | 99/446 |
| 2,814,381 | A | * | 11/1957 | Stevick | 426/129 |
| 2,918,379 | A | * | 12/1959 | Lurie | 426/129 |
| 3,026,209 | A | | 3/1962 | Niblack et al. | |
| 3,151,799 | A | * | 10/1964 | Engles, Jr. et al. | 229/407 |
| 3,155,303 | A | * | 11/1964 | Fenkel | 229/407 |
| 3,264,120 | A | * | 8/1966 | Westcott | 426/124 |
| 3,288,344 | A | * | 11/1966 | Woollen et al. | 229/103.1 |
| 3,420,431 | A | * | 1/1969 | Donovan | 229/407 |
| T860,020 | I4 | | 3/1969 | Anderson | |
| 3,438,507 | A | * | 4/1969 | Kreuger | 211/85.4 |
| 3,563,445 | A | * | 2/1971 | Clayton | 229/407 |
| 3,834,606 | A | * | 9/1974 | Andersson | 229/406 |
| 3,885,728 | A | | 5/1975 | Gilley | |
| 3,932,575 | A | | 1/1976 | Andersson | |
| D249,238 | S | * | 9/1978 | Limon et al. | D9/425 |
| 4,576,278 | A | | 3/1986 | Laiewski et al. | |

(Continued)

FOREIGN PATENT DOCUMENTS

CH 663943 1/1988

(Continued)

OTHER PUBLICATIONS

Co-pending U.S. Appl. No. 11/793,066, filed Jun. 15, 2007.

(Continued)

*Primary Examiner* — Mickey Yu
*Assistant Examiner* — Jenine M Pagan
(74) *Attorney, Agent, or Firm* — Baker Botts LLP

(57) ABSTRACT

A container includes a first tray, and a second tray disposed within the space of the first tray to define a reservoir therebetween. The first tray has a first bottom wall and a surrounding first sidewall, which extends generally upwardly from the first bottom wall to define a space therein. The second tray has a second bottom wall and a surrounding second sidewall, which also extends generally upwardly from the second bottom wall. The second bottom wall has at least one aperture defined in a central region thereof, and also has an upper surface, which slopes downwardly toward the at least one aperture. The reservoir defined between the first and second trays is in fluid communication with the aperture.

28 Claims, 58 Drawing Sheets

U.S. PATENT DOCUMENTS

| | | | | |
|---|---|---|---|---|
| 4,664,922 | A | 5/1987 | Leon et al. | |
| D294,466 | S * | 3/1988 | Culver | D9/425 |
| 4,949,897 | A * | 8/1990 | Pawlak et al. | 229/407 |
| 5,266,763 | A | 11/1993 | Colombo | |
| 5,352,416 | A | 10/1994 | Wagner | |
| 5,456,379 | A | 10/1995 | Krupa et al. | |
| 5,705,213 | A * | 1/1998 | Guillin | 426/129 |
| 5,720,999 | A * | 2/1998 | Lanzani et al. | 426/129 |
| 6,269,946 | B1 * | 8/2001 | Colombo | 206/213.1 |
| 6,619,501 | B2 * | 9/2003 | Hayes et al. | 220/608 |
| 6,627,273 | B2 | 9/2003 | Wolf et al. | |
| 6,671,578 | B1 | 12/2003 | D'Amelio et al. | |
| 6,983,575 | B2 | 1/2006 | Longo | |
| 2003/0057114 | A1 * | 3/2003 | Brander | 206/204 |
| 2004/0211682 | A1 | 10/2004 | Brander | |
| 2007/0056863 | A1 * | 3/2007 | Chou | 206/204 |

FOREIGN PATENT DOCUMENTS

| | | |
|---|---|---|
| DE | 4234632 | 4/1994 |
| EP | 0600535 | 6/1994 |
| EP | 0701955 | 3/1996 |
| EP | 1053944 | 11/2000 |
| FR | 2519840 | 7/1983 |
| FR | 2 564 807 | 11/1985 |
| FR | 2622551 | 5/1989 |
| FR | 2 697 809 | 5/1994 |
| FR | 2775261 | 8/1999 |
| NL | 8000159 | 8/1981 |
| WO | WO8600275 | 1/1986 |
| WO | WO 86/07036 | 12/1986 |
| WO | WO 93/06026 | 4/1993 |
| WO | WO9306026 | 4/1993 |
| WO | WO 99/00314 | 1/1999 |

OTHER PUBLICATIONS

Co-pending U.S. Appl. No. 12/514,564, filed May 12, 2009.

U.S. Appl. No. 11/793,066, Non-final rejection-Sep. 21, 2009.

* cited by examiner

CONTAINER HAVING INTERNAL RESERVOIR

CROSS REFERENCE TO RELATED APPLICATIONS

This application claims the benefit of U.S. provisional application Ser. No. 60/737,023 filed Nov. 14, 2005 which is incorporated by reference in its entirety herein.

BACKGROUND OF THE INVENTION

1. Field of the Invention

The present invention relates to a container for packaging. Particularly, the present invention is directed to a container for packaging products or other items susceptible to exuding liquids, wherein the container has an internal reservoir for the collection of liquids exuded therefrom.

2. Description of Related Art

Typical containers for packaging and display of meat, produce and other products for consumers are made of plastic foam, or paperboard and generally are simple concave trays having a film cover or overwrap.

Consumers prefer to purchase items such as meat, poultry, seafood and products that release liquid, in dry packages. However, the amount of liquid residing in a food container typically increases over time, as the product ages and exudes liquid. Accordingly, retailers frequently rewrap the package, reduce the sale price of the product, or remove the product from the shelf because of consumer perception that the product might be spoiled. Moreover, such liquid can leak from a package if the package is not well sealed.

To reduce the problems caused by exuded liquids inside such containers, absorbent pads are typically placed in or glued to the bottom of the container, typically between the container and the contents of the package. While effective, these pads can be relatively expensive and have limited absorbency. Also, these pads can tear, tend to stick to container contents, and freeze to the contents when frozen—all of which pose inconvenience to the consumer, and added cost. Absorbent pads tend to dry the product with which they are in contact by wicking more liquid from the product than would otherwise occur naturally. Also, liquid held by an absorbent pad can be squeezed out if the pad is pressed, which may occur as a result of handling or due to the force exerted by the film overwrap. Such pads also tend to leak fluid when products are merchandised on their side. Moreover, labor is required to insert the pads into the containers, sometimes with hot-melt adhesive, and additional quality inspection is required to ensure proper placement of the pads.

A self-absorbing tray using an open cell foam structure is another solution used to absorb excess fluids. The material becomes absorbent when holes are pierced through the surface of the tray. While effective in reducing labor required to insert pads, an open cell tray structure is weaker overall, increasing the chance for folded, cracked or broken trays during wrapping and transport of the product. Depending on the tray design, open cell trays can wick moisture through the tray and transfer liquid to the consumer's hands. Some open cell foam trays change color when saturated with fluid and are therefore unsightly to consumers. Furthermore, open cell trays offer a limited amount of absorbency. Trays loaded with large amounts of meat can easily overwhelm the absorbent capacity of the tray, resulting in unabsorbed liquid pooling at the bottom of the package.

Double-walled trays, which contain an absorbent pad between an outer and inner tray are expensive and also have a limited absorbency. Moisture is introduced to the absorbent core through holes in the inner tray. Like that of the open cell tray, the liquid within the pad has a propensity to be wicked up to and leaked from top edges of these types of trays. Further, the process used to manufacture these trays results in a rough edge that tends to pierce film wraps, which also results in leakage of liquid from the container.

Packaging containing an absorbent pad, either glued inside or sandwiched between inner and outer trays, creates a packaging container comprised of many different materials. The added labor and expense required to remove the absorbent materials from the package prohibit recycling of such packaging.

Trays have also been designed to capture liquids without absorbent padding by allowing the fluids to fall by way of gravity into a space between two sheets of plastic material, the liquid passing through holes formed in the sheet upon which the product is placed. In these trays, drainage occurs through many holes provided in a flat surface, upon which the product sits. Therefore, if the tray is simply turned upside down or displayed on its side, the liquids easily run out of the containment area. Accordingly, these products cannot be displayed on either their sides or their ends without leaking liquids from the containment area. Moreover, in this type of tray, the direct contact of the meat to the tray surface blocks many of the drain holes, thereby inhibiting the passage of liquids to the containment area.

Accordingly, there remains a need to provide an effective and inexpensive means for containment of exuded liquids from and pooling of exuded liquids within containers for packaging liquid-exuding products, such as meats, produce and other products.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

Therefore, an object of the invention is to provide a packaging tray for products that tend to release liquids that avoid the drawbacks of existing trays set forth above.

To achieve these and other advantages and in accordance with the purpose of the invention, as embodied and broadly described, the invention includes, in one aspect, a container including first and second trays. The first tray has a first bottom wall and a surrounding first sidewall extending generally upwardly from the first bottom wall to define a space therein. The second tray has a second bottom wall and a surrounding second sidewall extending generally upwardly from the second bottom wall. The second bottom wall has at least one aperture located within a central drain region thereof, and an upper surface that slopes downwardly toward the aperture. The central drain region is proximate to the center, or a centerline of the upper surface, depending on the specific embodiment. The second tray is disposed within the space of the first tray to define a reservoir therebetween, and the reservoir is in fluid communication with the aperture.

In accordance with another aspect of the invention, the first and second trays are adhered to one another. While heat sealing techniques are preferred for this purpose, adhesive, cohesive, lip rolling, mechanical crimping, ultrasonic welding, vibration welding, chemical bonding, mechanical snap fitting and induction welding, or combinations thereof can also be used to join the first and second trays.

In accordance with still another aspect of the invention, a bottom wall and sidewall of the first tray can include elements that cooperate with the second tray to aide in self-alignment of the trays during assembly.

In accordance with another aspect of the invention, the first and second trays can be mutually attached along an edge during forming, so that the edge acts as a hinge and a seal to both align the two trays and to seal the edge of the container to prevent leakage. Alternatively, the attachment along the edge can be partial, only functioning only to align the trays, but not seal the trays.

In accordance with another aspect of the invention, the second tray is disposed within the space of the first tray to define a reservoir therebetween in fluid communication with the aperture(s) where at least a portion of the first and second sidewalls are spaced from each other to define a chamber of the reservoir therebetween.

In accordance with another aspect of the invention, the chamber formed by the first and second side walls maintains the fluid level to be at or below the level of the aperture(s) when the container is tilted on any of its sides.

In accordance with a further aspect of the invention, the upper surface of the second bottom wall includes a raised surface feature.

In some embodiments, a second bottom wall of the second tray that slopes downwardly toward the center of the container, in combination with a first bottom wall of the first tray that slopes upwardly toward the center of the container creates an approximately hourglass-shape cross-section that encourages movement liquid to the reservoir while also encouraging movement of liquid in the reservoir away from a central drain region. Advantageously, this shape also directs liquid in the reservoir away from the aperture when the container is turned upside-down.

In a preferred embodiment, positioning of the aperture(s), relative to the edges of the container and to the reservoir, is such that a first volume of liquid capable of being retained within the reservoir when the container is oriented in a first position is substantially equal to a second volume of liquid capable of being retained within the reservoir when the container is oriented in a second position. The first and second positions can be any of placing the tray generally horizontally on a front or back side, generally vertically on an end or an edge, or at any angle therebetween. Such orientations depend on the storage, transportation and merchandising display requirements for the contents of the container.

In accordance with still another aspect of the invention, the reservoir defined by the trays is vented utilizing features of the first and/or the second trays. Specifically, one or both trays can be formed such that an air passage is created in a sidewall to relieve air from the reservoir, particularly air that is displaced by liquid entering the reservoir. The first and second trays can be configured to create a vent chamber and path that inhibit the flow of liquid, but allow free passage of air. Sintered materials can be advantageously utilized for venting of the reservoir, also by allowing air to escape, but preventing liquid from escaping. Such materials prevent escape of liquid but allow the passage of gasses.

In accordance with still a further aspect of the invention, a one-way valve is provided in communication with the aperture to inhibit liquid flow from the reservoir through the aperture.

In accordance with another aspect of the invention, the first and second trays include bottom wall and sidewall ribs. As such, an upper surface of the first, or bottom, tray can include cooperating elements to support the second tray, the cooperating elements extending from the first tray to a bottom face of the bottom wall of the second tray. The second tray can be provided with mating depressions, which correspond in location to the cooperating elements of the first tray. The cooperating elements act to support the contents of the container by supporting the second tray, thereby reducing the possibility of the contents of the reservoir being squeezed out of the reservoir under pressure.

In accordance with still a further aspect of the present invention, each embodiment includes elements that facilitate flow of liquid underneath the contents of the tray, which prevent the contents from blocking the drainage apertures of the second tray. The elements can be either raised surface features or recessed surface features, for example. Raised surface protrusions can extend upwardly from the upper surface of the second bottom wall, and can be round or elongate in shape. The surface protrusions can be aligned radially or non-radially with respect to the central drain aperture(s), can be perpendicular to at least one edge of the second sidewall, and can be spaced from the aperture(s). The surface protrusions can also continue up the sidewall of the second tray to allow fluid released from the top portion of the contents access to the drain aperture(s) and reservoir.

If depressions are provided to facilitate the flow of liquid, such depressions can be formed in the bottom wall of the second tray and can be, for example, in the form of grooves or troughs. Such depressions can also be either radial or non-radial, relative to the aperture(s).

In accordance with a further aspect of the invention, depressions on a bottom face of the first tray correspond with raised features of the top face of the second tray. The raised features can be in the form of ribs or other shapes. The mating nature of these features enables a reduced stack height of the containers when stored or shipped, and helps engage the stack to result in a more stable stack, while the raised features also help elevate the contents of the tray to prevent blockage of the drain aperture(s).

In accordance with another embodiment of the invention, a container is provided that includes first and second trays. The first tray is divided into a plurality of cells, each of which has a cell bottom wall and a surrounding cell sidewall. Each sidewall extends generally upwardly from the corresponding cell bottom wall to define and individual cell space. The second tray has a plurality of drain areas, each of which corresponds to one of the cells of the first tray. Each drain area has a bottom wall with at least one aperture in a central region of the wall. The bottom wall of each drain area also has an upper surface that slopes downward toward the aperture(s) of the drain area. The second tray further includes a surrounding sidewall that extends generally upwardly from the plurality of drain areas. Each drain area of the second tray is disposed within a respective cell space of the first tray, each thus defining a corresponding reservoir therebetween. Each reservoir is in fluid communication with a respective aperture.

For each of the embodiments described herein, the first and second trays can have any shape desired, for example, rectangular or circular. The first sidewall can extend upwardly and outwardly from the first bottom wall at a first angle between about 15 and 90 degrees, depending on the embodiment. The second sidewall can extend upwardly and outwardly from the second bottom wall at a second angle, which is equal to or less than the first angle in order to define a chamber between the first sidewall and the second sidewall.

In some embodiments, the container's first bottom wall has a central region aligned with the aperture of the second tray and an upper surface of the first bottom wall slopes away from the central region. The same principle can be applied to a container having multiple cells.

Further, a valve can be incorporated into one or more apertures. Such valve can be a one-way valve such as a reed-type or ball valve. A reed-type valve includes a membrane extending across the aperture(s) and secured on opposite ends thereof to a bottom surface of the second tray. The membrane is preferably adhered to the underside of the first tray. The reed valve preferably has two parallel seals equally spaced from the central drain. Even a small amount of liquid passing from the second tray to the reservoir will cause the membrane to deflect from the bottom surface of the second tray and allow the liquid to enter the reservoir. The membrane is preferably larger than the drain aperture(s). When the container is tipped on an edge or upside-down, pressure of liquid on a bottom face of the reed valve improves the seal between the reed valve and the container surface, thus preventing liquid from exiting the reservoir. As an alternative, ball valves, duck bill valves, or umbrella valves can be utilized.

In any of the foregoing embodiments, the second bottom wall can have a lower surface that slopes generally upwardly, away from the aperture.

Also, in any of the above embodiments, an edge of the aperture(s) can protrude downward into the reservoir space to aid in preventing leakage of liquid through the aperture by providing a barrier to such leakage.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the invention. Together with the description, the drawings serve to explain the principles of the invention.

DETAILED DESCRIPTION OF THE PREFERRED EMBODIMENT

Figure 1:
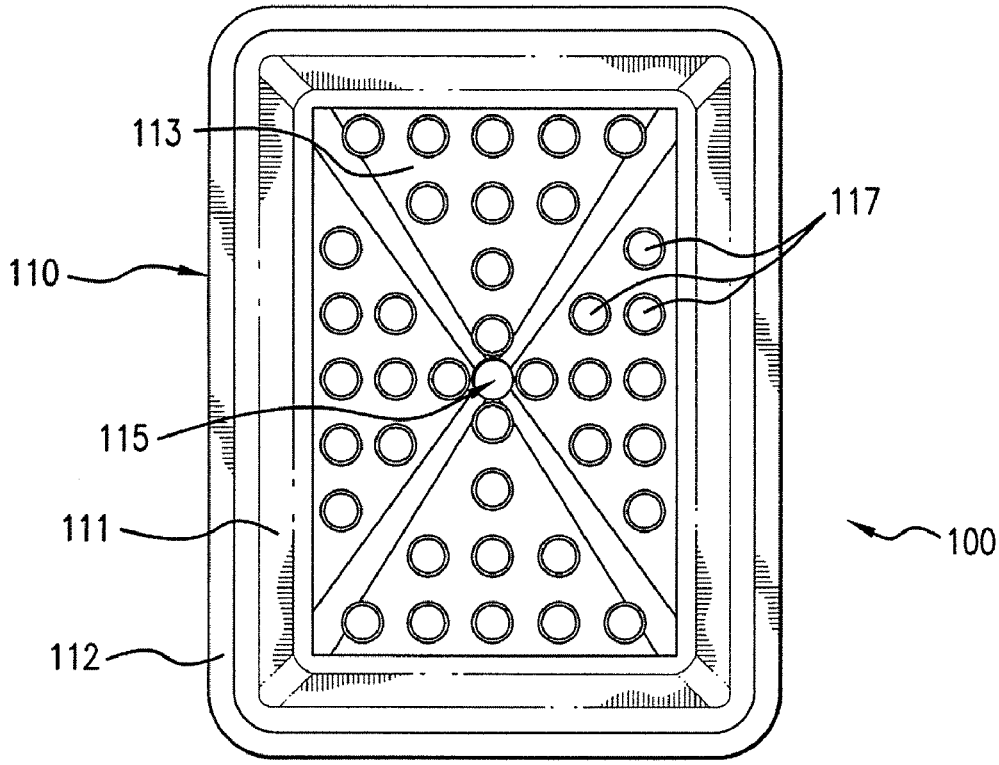
FIG. 1 is a plan view of a container having an internal reservoir, in accordance with the invention.

Reference will now be made in detail to the presently preferred embodiments of the invention, examples of which are illustrated in the accompanying drawings.

The apparatus and related methods presented herein can be used for packaging of any product, particularly a liquid-exuding product. The present invention is particularly suited for the packaging of meat, produce, and other perishable products. In accordance with the invention, a container is provided comprising first and second trays. The first tray has a first bottom wall and a surrounding first sidewall extending generally upwardly from the first bottom wall to define a space therein. The second tray has a second bottom wall and a surrounding second sidewall extending generally upwardly from the second bottom wall. The second bottom wall has at least one aperture in a central region thereof, and an upper surface that slopes downwardly toward the aperture. The second tray is disposed within the space of the first tray to define a reservoir therebetween, and the reservoir is in fluid communication with the aperture. For purpose of explanation and illustration, and not limitation, an exemplary embodiment of the container in accordance with the invention is shown in FIG. 1 and is designated generally by reference character 100.

Figure 2:
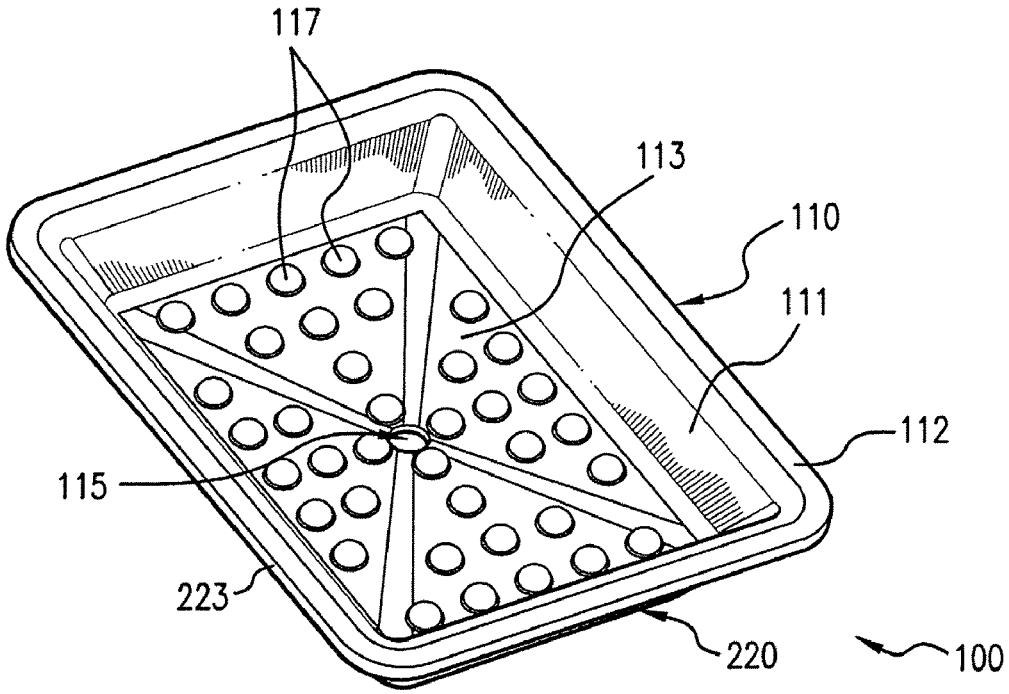
FIG. 2 is an isometric view of the container having an internal reservoir shown in FIG. 1.
Figure 3:
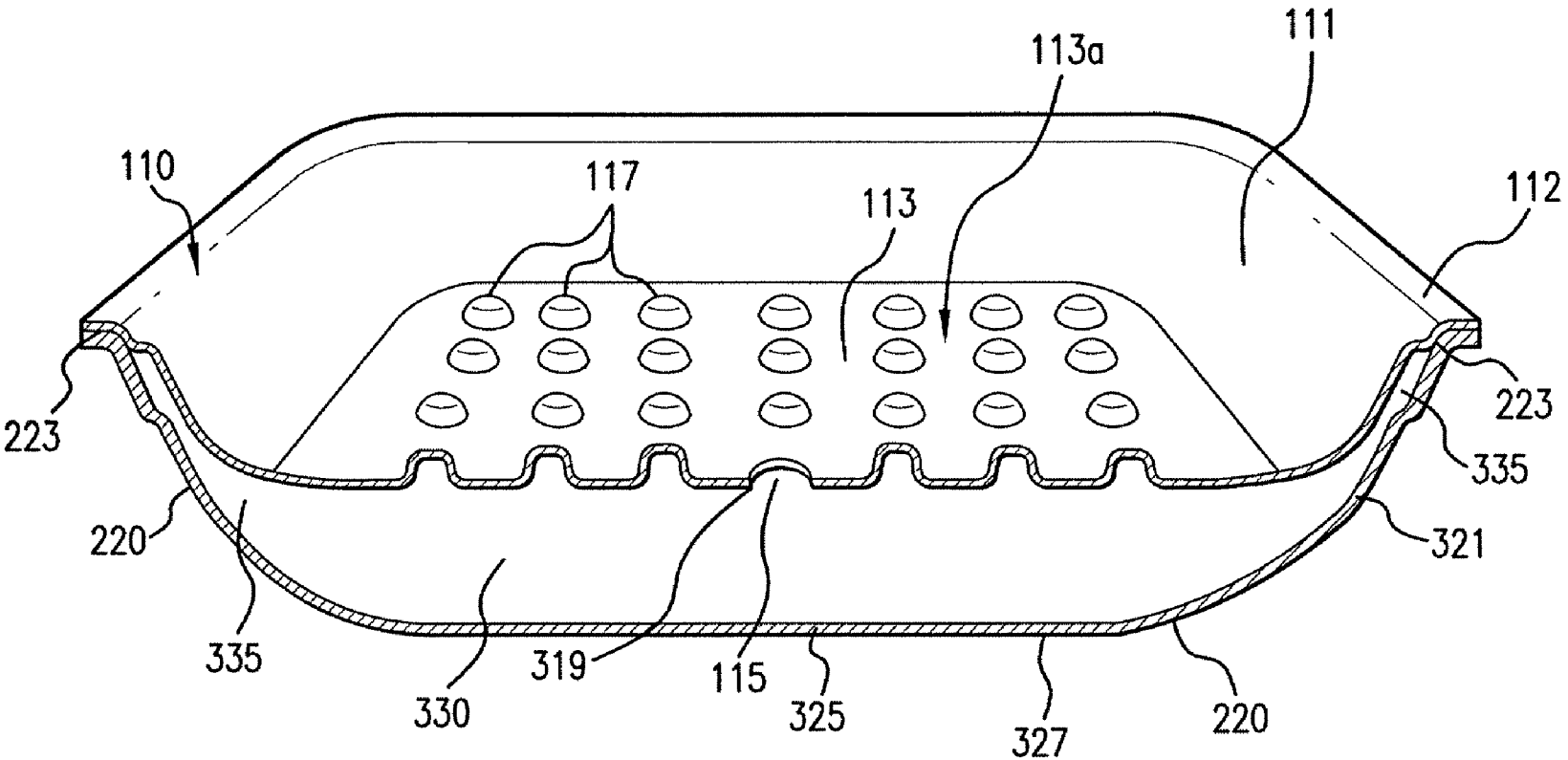
FIG. 3 is a cross-sectional side view of the container having an internal reservoir shown in FIG. 1.

As shown in FIGS. 1-3, which illustrate top, isometric and cross-sectional side views of the container 100, respectively, the container 100 generally includes a first tray 220 and a second tray 110. The first or "bottom" tray 220 is preferably larger than the second tray 110, having a sidewall 321 and a bottom wall 325 defining a recessed space. The space is preferably large enough to accommodate at least a portion of the second tray 110, if not essentially the entire second tray 110.

The second or "top" tray 110, which includes a bottom wall 113 and a sidewall 111 rests on or nests within the first tray 220 as shown in FIG. 3. As embodied herein, an outer edge 112 of the second tray 110 rests on and, preferably, is attached to an outer edge 327 of the first tray 220. Sidewall 111 of the second tray 110 connects the edge region 112 to the bottom wall 113 of the second tray 110. In a preferred embodiment, a flange is provided at the edge of at least one of the edge regions 112, 327. Attachment of the two trays is preferably effected by any suitable, and preferably, watertight connection, such as heat welding or adhesive, cohesive, ultrasonic welding or chemical bonding techniques.

Other known types of bonding techniques can be used, as can mechanical interlocking or interference fit techniques for joining the two trays. The union of the first tray 220 and second tray 110 creates an enclosed volume or reservoir 330. At least one aperture 115 is defined in the bottom wall 113 of the second tray 110, so as to be in fluid communication with the reservoir.

In accordance with another aspect of the invention, the second tray 110 further includes one or more surface features 117, which extend above or below the upper surface of the bottom wall 113 of the second tray 110. The surface features 117 include raised surface features, such as ribs or protrusions or alternatively depressions formed in the upper surface of the bottom wall 113. The surface features 117 can be formed in a variety of desired quantity or pattern. Preferably, the surface features 117 are configured to aide the flow of exuded liquid to the aperture 115, and into the reservoir 330. The surface features 117, furthermore, support the product to be packaged above the upper surface of the bottom wall 113 to minimize contact with the exuded liquid and prevent the contents from plugging the aperture 115. In the embodiment of FIG. 3, the surface features 117 are protrusions having a generally hemispherical shape, but can be formed in a variety of shapes and sizes, such as elongate ribs (See FIG. 14A-14B), and/or can be arranged in a variety of patterns, such as radial or substantially non-radial, relative to the aperture 115. Additionally, or alternatively, the raised surface feature can be defined by recessed channels (See FIGS. 11A-11D).

In accordance with another aspect of the invention, the at least one aperture 115 is provided at or near a center region of the second tray 110. If desired, or necessary, depending on the contents of the container, a plurality of apertures can be provided in a central region of the second tray 110. The aperture(s) are formed in the second tray 110 by any suitable process. Preferably, however, the aperture(s) are formed by punching following another forming process such as molding, if a polymeric foam material is to be used. Advantageously, the process of punching can be performed to yield a lip 319 around the circumference of the aperture, extending downward into the reservoir 330. This lip 319 assists in resisting liquid flow out of the reservoir, particularly when the container is oriented upside-down. If desired, the lip 319 can be manufactured in an alternate manner, such as by molding of the tray.

Additionally or alternatively, the aperture(s) can be formed such that at least a portion of the material which is punched to form the aperture(s) remains attached to the second tray. For example and in accordance with one embodiment, the entire boundary of the cut-out is not separated from the second tray. Instead, the punch is configured to sever a cut-out along an edge defining the aperture(s) that extends a distance less than the entire perimeter of the aperture(s). Accordingly, a portion of the cut-out remains connected to the remainder of the second tray. The cut-out can be depressed downwards toward the first tray to allow liquid to flow into the internal reservoir. This configuration is advantageous in that it avoids the need to discard or otherwise secure a cut-out that is entirely severed from the second tray.

The upper surface 113*a* of the bottom wall 113 of the second tray 110 preferably slopes at least slightly, toward the aperture 115 to aide drainage of liquids through the aperture 115 and into the reservoir 330. Alternatively, the bottom wall 113 is configured such that when a product is placed in the tray, the tray flexes to define a downward slope toward the aperture 115. The bottom wall 113 can have a uniform thickness throughout, or can be varied as desired. As such the features of the upper surface 113*a* of the bottom wall 113 need not control or limit the configuration of the lower surface of the bottom wall 113. For example, the bottom wall 113, as well as the bottom wall 325 of the first tray 220, if desired, can increase or decrease in thickness with respect to distance from the aperture(s) 115. As such, the upper surface 113*a* of bottom wall 113 can slope upward from the aperture(s) 115, while the lower surface 113*b* slopes downward.

In use, the reservoir 330 captures liquids that are exuded from the product held on or within the space of the second tray 110. Liquid passes from the product along the upper surface 113*a* of the bottom wall 113, and into the aperture 115. The liquid is collected in the reservoir 330. Though the aperture can be fitted with a valve, as described in more detail below, the geometry of the aperture and container is preferably self-sufficient to prevent back-flow of liquids from the reservoir 330. For example, and further in accordance with another aspect of the invention, some embodiments include a roughly hour-glass shape in cross-section, which utilizes a bottom wall 325 having an upper surface that slopes away from the aperture 115 to direct liquids away from the aperture 115.

In accordance with an additional aspect of the invention, the reservoir 330 preferably includes one or more chamber(s) 335 defined between sidewall 111 of the second tray 110 and sidewall 321 of the first tray 220. The chambers can be relatively discreet, defined by a gap between the sidewalls, or can be defined by an expanded region in one or both of the trays.

The expanded region can be defined by an outward projection formed in the first tray 220 at the sidewall 321, for example, or from the second tray 110 at the sidewall 111.

As illustrated in the container 100 of FIGS. 1-3, the chamber is formed by an offset of the sidewalls 321, 111 of the first tray 220 and second tray 110, respectively. When tilted toward or onto an edge, liquid collected in the reservoir 330 flows toward the edge and fills the chamber 335. While providing extra volume for the exuded liquid when the container is oriented away from the horizontal, the side chamber(s) 335 provide additional benefits. For example, the chamber(s) inhibit inadvertent "splashing" of liquid when the container is abruptly shifted or moved.

The offset forming the chambers 335 of container 100, can include aligning the sidewalls 111 and 321 parallel to, but spaced from one another. Alternatively, the sidewalls can be aligned at different angles relative to their respective bottom walls 113, 325. Preferably, the general angle of the sidewall 111 of the second tray 110 is less than, or more shallow relative to the bottom wall 113, than the angle of the sidewall 321 of the first tray 220 relative to its bottom wall 325. As such, the sidewalls 111, 321 diverge from one another, away from the edge portion 112, 327. Accordingly, increased volume of the reservoir can be achieved. Further, such a manufactured increase in chamber width can allow for the flexure of the second tray 110. In this manner, when contents are placed within the container 100, the chamber 335 is not compressed to such an extent that volume is reduced beyond a tolerable degree and that the chamber 335 is not isolated from the remainder of the reservoir 330.

Similarly, by providing angled sidewalls, when the container 100 is returned to horizontal position, the liquid flows smoothly down the sidewall 321 of the first tray 220. If necessary, the liquid can even proceed up the incline of the opposing sidewall, thus "oscillating" to and equilibrium condition.

Figure 4:
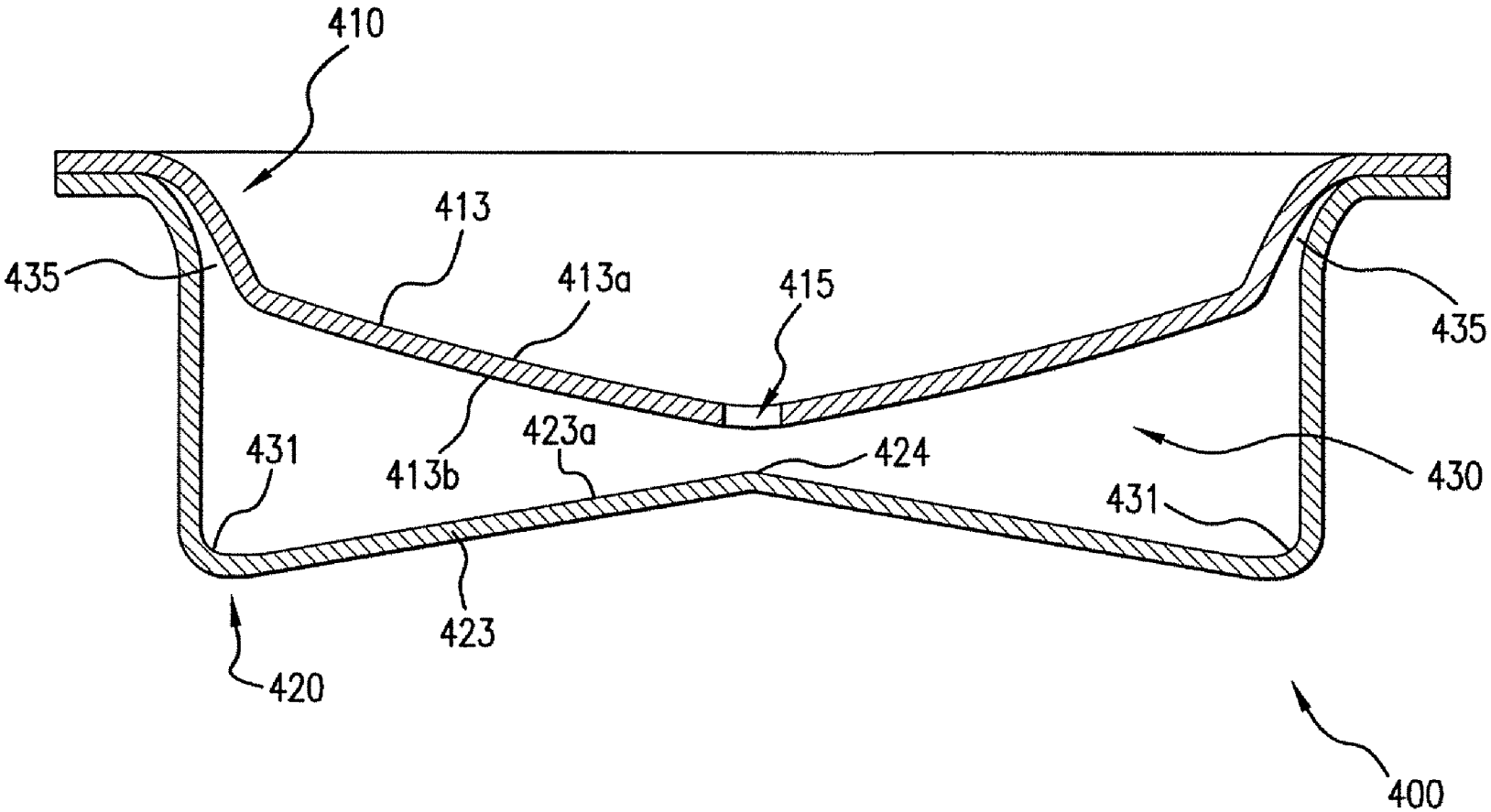
FIG. 4 is a cross-sectional side view of an alternate embodiment of the container having an internal reservoir in accordance with the invention, wherein a wall of the lower tray slopes away from the drain aperture.

FIG. 4 illustrates a container 400, in which the upper surface 413*a* of bottom wall 413 of the second tray 410 slopes downward toward the aperture 415, and in which the upper surface 423*a* of bottom wall 423 of the first tray 420 slopes downward away from the area of the aperture 415. In cross-section, this embodiment forms a roughly hourglass shape. Liquid entering the aperture 415 falls upon a central region 424 of the bottom wall 423, and due to gravity, flows downward to a lower region 431 of the reservoir 430, away from the central region where the liquid is then retained. The objective of this feature is to encourage or direct exuded liquids away from the aperture 415 to prevent the liquids from inadvertently splashing or escaping through the aperture 415.

In this embodiment, the sloped bottom surface 413*b* of the bottom wall 413, in conjunction with reservoir chambers 435, if provided, likewise direct liquid trapped within the chamber away from the aperture when the container 400 is turned upside-down. That is, the bottom surface of the sloped bottom wall 413 directs liquid away from the aperture 415, thereby impeding the release of liquid from the reservoir 430.

Figure 8A:
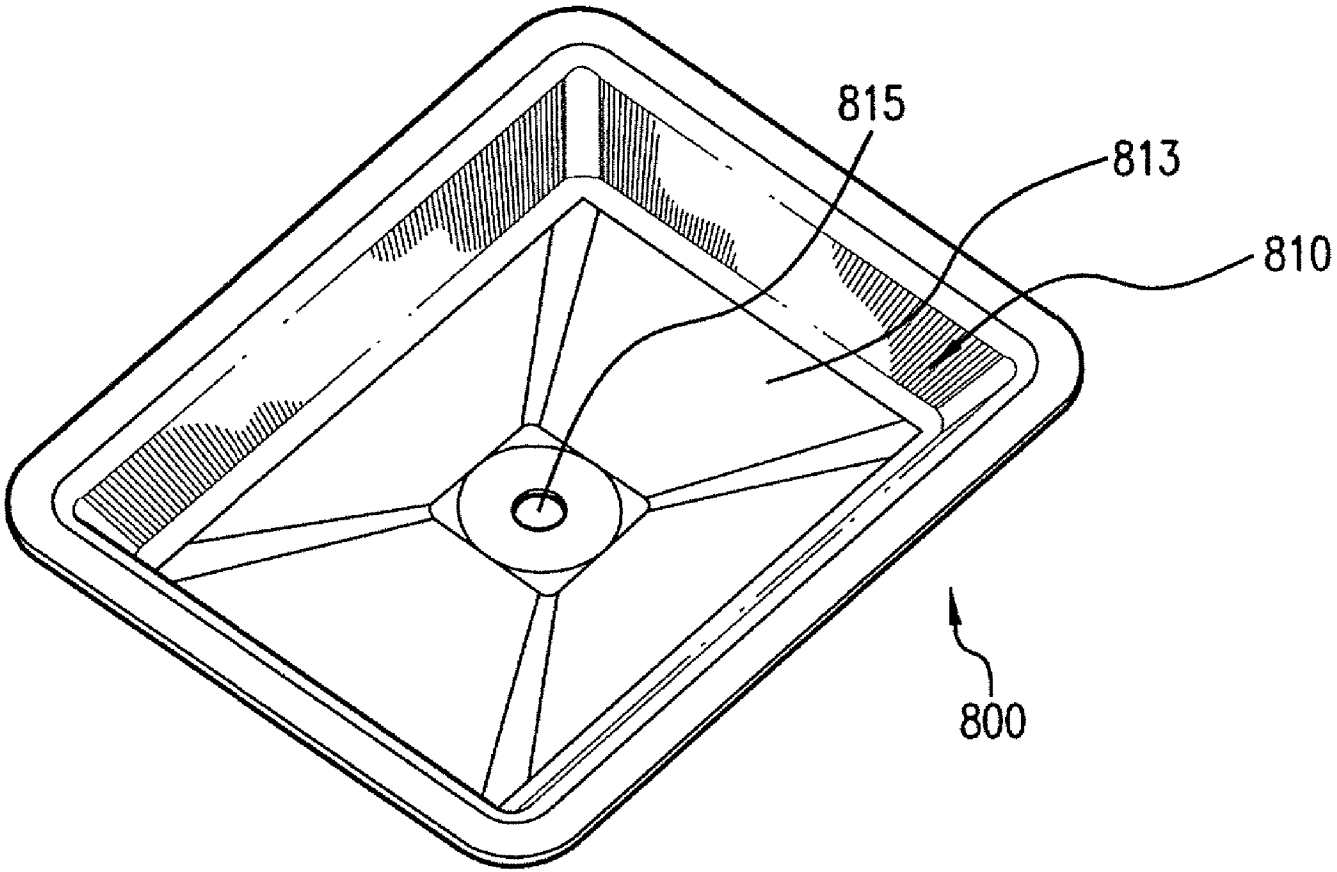
FIGS. 8A-C illustrate an alternative container having an internal reservoir.
Figure 8B:
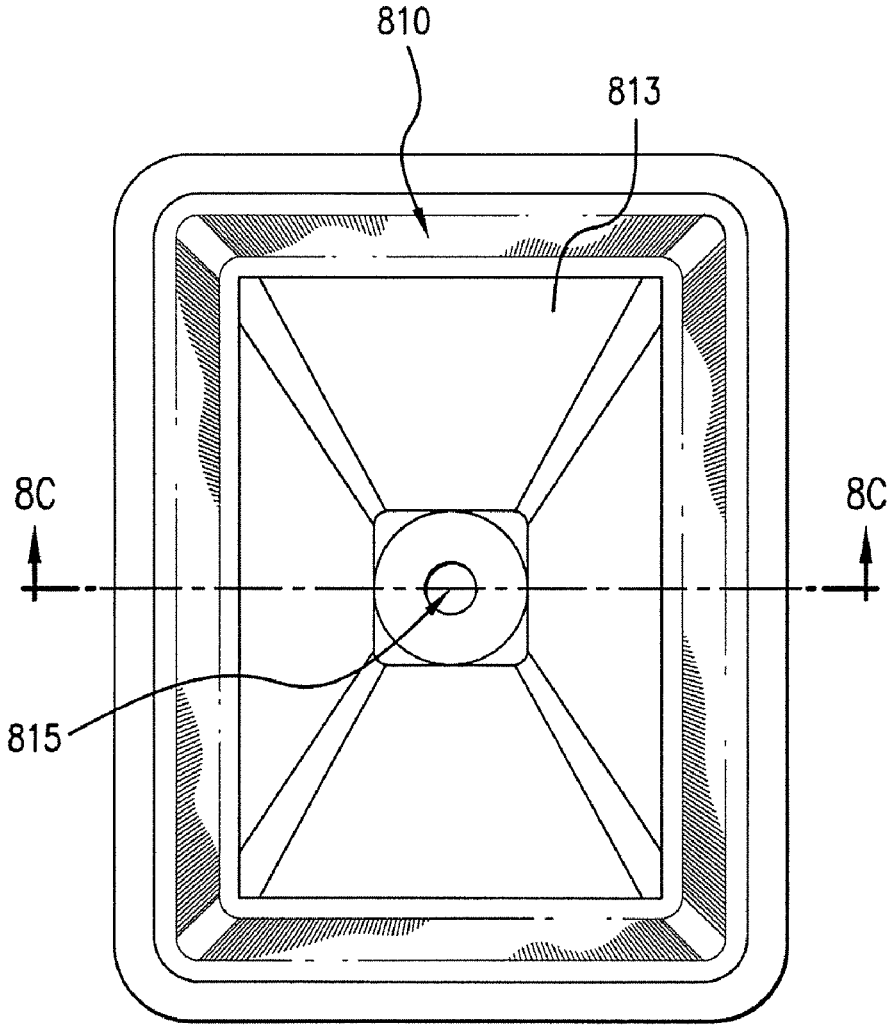
Figure 8C:
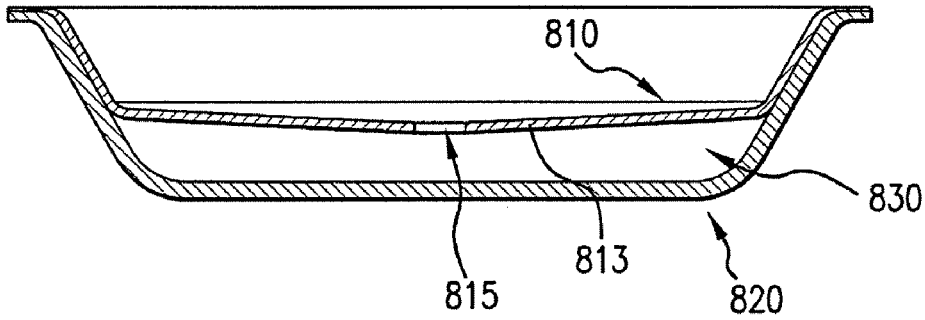

FIGS. 8*a*-8*c* illustrate an alternate embodiment of a container 800 in accordance with the invention. The container 800 includes a sloping bottom wall 813 of second tray 810 to guide liquids to the aperture 815 and into the reservoir 830. The reservoir is defined between the first tray 810 and second tray 820. In this embodiment, no surface features or side chambers are provided.

Figure 16:
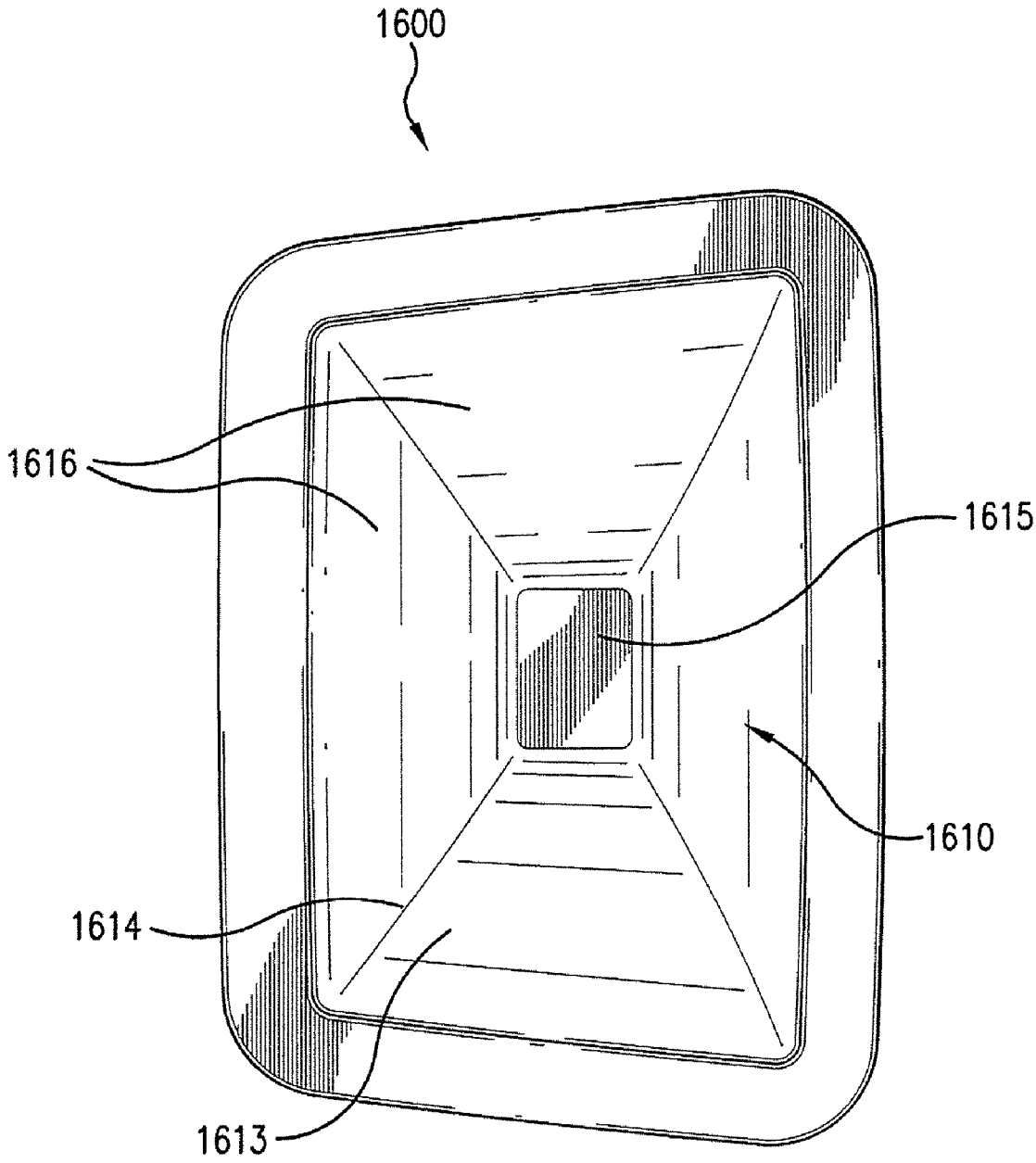
FIG. 16 is a top view of another representative embodiment of a container having an internal reservoir, in accordance with the invention.

Similarly, FIG. 16 illustrates another embodiment of a container in accordance with the invention. The container 1600 includes a first, outer tray 1620 and a second, inner tray 160 having a centrally located aperture 1615. In this embodiment, the floor 1613 of the second tray 1610 includes a plurality of substantially flat, sloped floor portions 1616 which intersect along substantially radial creases 1614 at each corner. As with the above embodiments, exuded liquid is guided down the floor 1613 of the container 1600 to the aperture 1615, and into a reservoir below. Additional features described herein, such as raised surface features, chambers and valves, can be included. Moreover, the reservoir (not shown) can include any or all of the above-described features. Likewise, alternative embodiments of the bottom wall are contemplated to provide a slope toward the aperture, such as radiused, parabolic and conical configurations.

Figure 5:
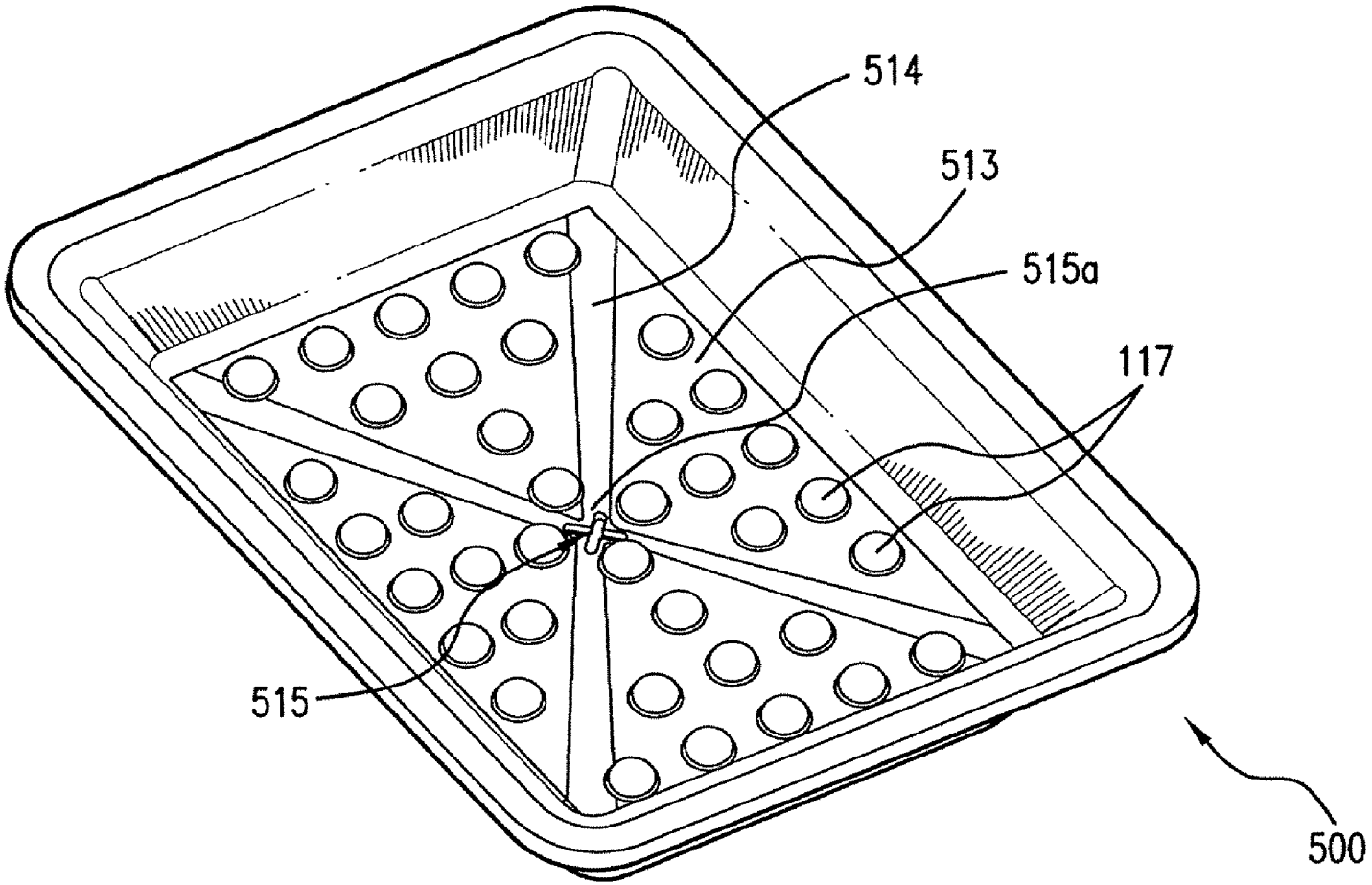
FIGS. 5-7 are isometric views of the container having an internal reservoir shown in FIG. 1, with variants of drain apertures.
Figure 6:
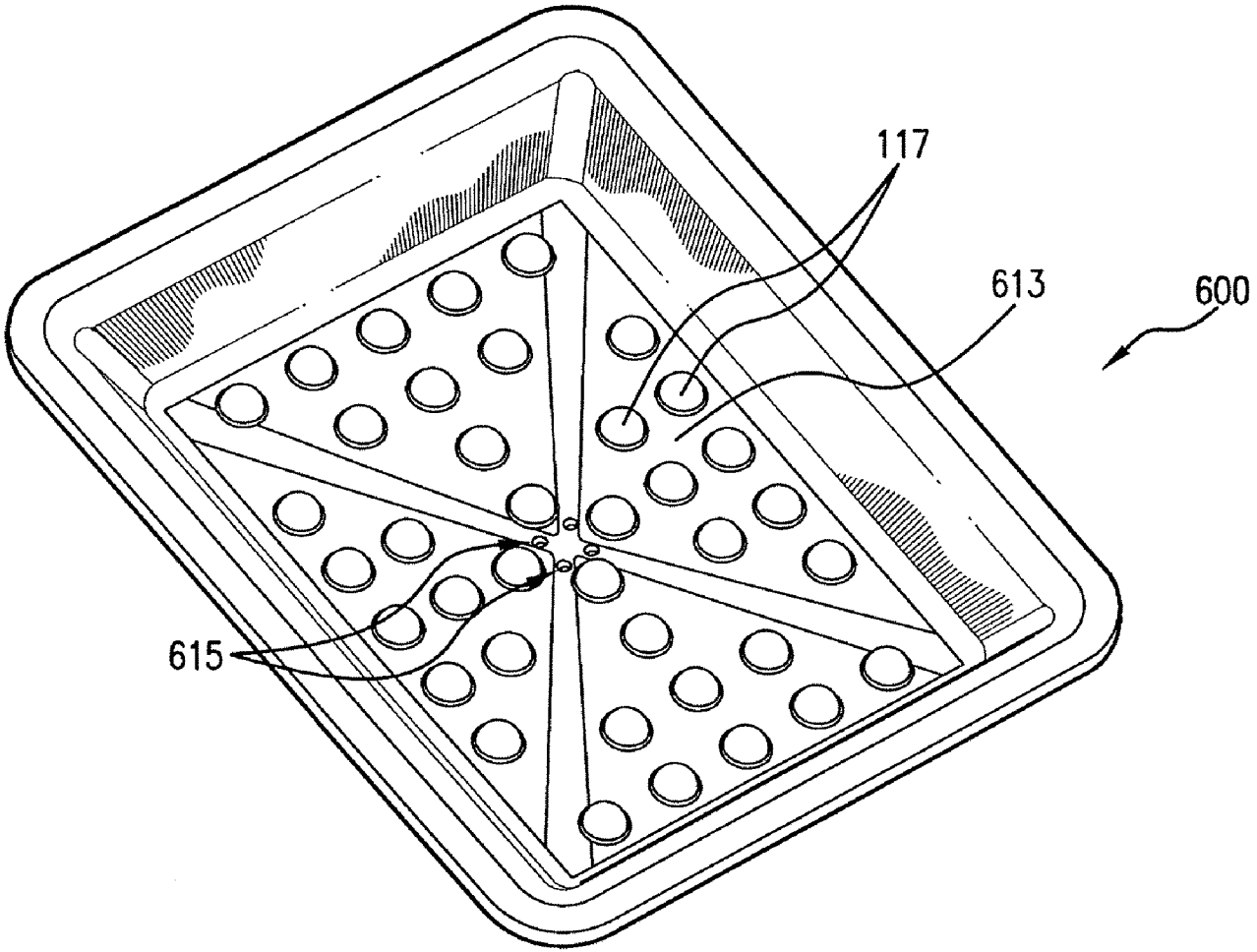
Figure 7:
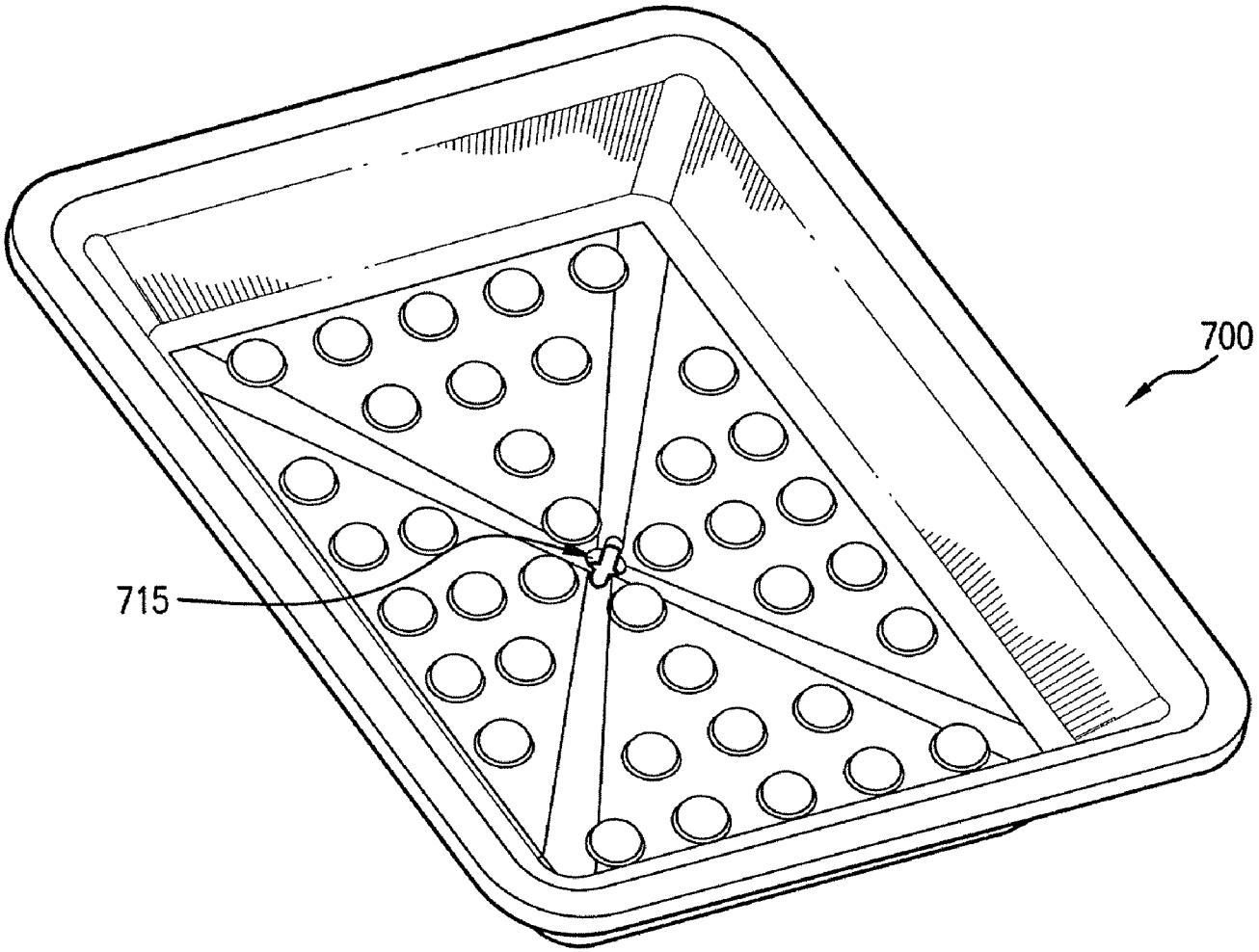

In any of the foregoing or following embodiments, the at least one aperture (e.g., central aperture 115, 415) can be of any suitable shape or size, and as stated above, can alternatively include a plurality of apertures within a central region. FIGS. 5-7 illustrate containers 500, 600 and 700, each having variations of centrally located apertures. The container 500 includes a roughly X-shaped aperture 515, with arms of the aperture 515*a* disposed between surface features 117, and vice versa of the second tray. Accordingly, the aperture 515 can be arranged between and very close to the surface features 117, thereby helping to ensure that the contents of the package do not obscure the aperture 515. Optionally, a trough 514 can be provided in bottom wall 513 to aide drainage of exuded liquids toward the aperture(s).

FIG. 6 illustrates container 600 having a plurality of apertures 615 defined in a central region of the bottom wall 613 of the second tray. As with the embodiment of FIG. 5, the apertures 615 are configured adjacent to the surface features 117 so as not to be obscured by contents placed within the container 600.

FIG. 7 illustrates a container 700 having a central aperture 715 that is elongate in shape. It is conceived that providing geometry other than circular will facilitate the use of the central aperture as a vent, in addition to a drain aperture.

Generally, the size of the apertures (e.g. apertures 115, 415, 515, 615) can be dimensioned in almost any size. It is preferable, however, to use an appropriate size that is sufficiently large to allow drainage and venting if needed, but sufficiently small to prevent spillage. The preferred aperture size therefore will depend upon the number of apertures provided, whether venting is required or provided by an alternative vent opening, the characteristics of the fluid (e.g., viscosity, surface tension), and the expected flow rate, among other factors.

For example, by providing a plurality of apertures, a smaller aperture size can be used to accommodate the same flow rate as a single aperture of larger size. The total amount of aperture area can be calculated by summing the entire area of each individual aperture. In this manner, providing a plurality of smaller apertures over a large area can reduce the risk of spillage as well as reduce any compromise to the integrity of the bottom wall of the second, or "upper" tray.

By contrast, however, it is beneficial to ensure adequate aperture area to accommodate the required functionality. While, for the foregoing reasons, a smaller aperture can be desirable, there are additional considerations to be made when reducing the size of the aperture. Firstly, for very small apertures, the surface tension of the liquid can provide a substantial obstacle to proper drainage. For these and even larger holes, if the aperture is not large enough to allow air from the reservoir to escape while liquid enters, then drainage will also be impeded. In this case, a separate venting arrangement can be provided, as described below. Furthermore, if a valve is utilized, the aperture must necessarily be large enough to accommodate the valve. Depending on the valve, venting may also be required. As an example, an aperture having a diameter of about 3/16 of one inch or larger, can typically accommodate the effluent from contents of a tray while still allowing air to escape from the reservoir.

Figure 9B:
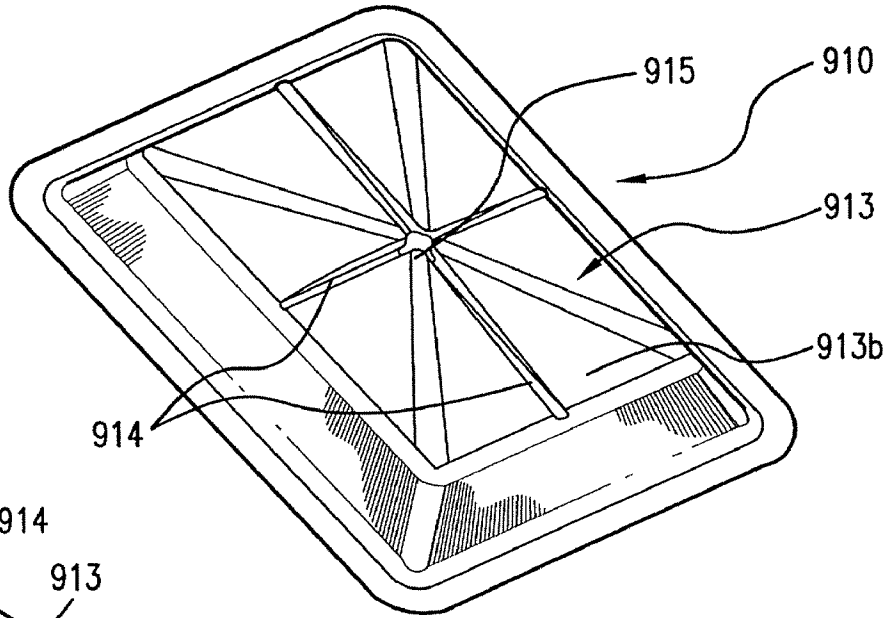
FIGS. 9A and 9B illustrate top isometric and bottom isometric views, respectively of a container tray, having axial ribs, in accordance with the invention.
Figure 9A:
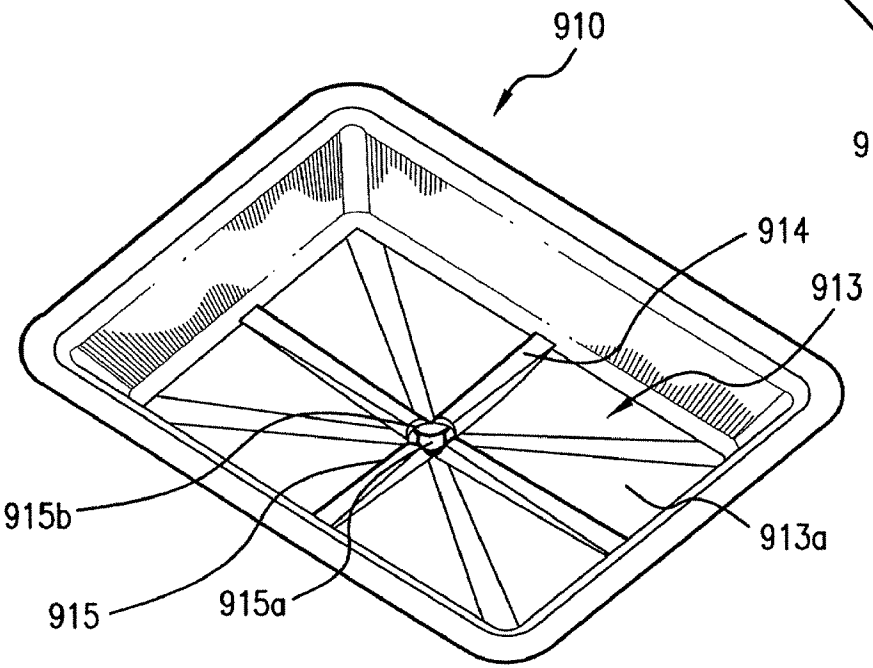
Figure 10A:
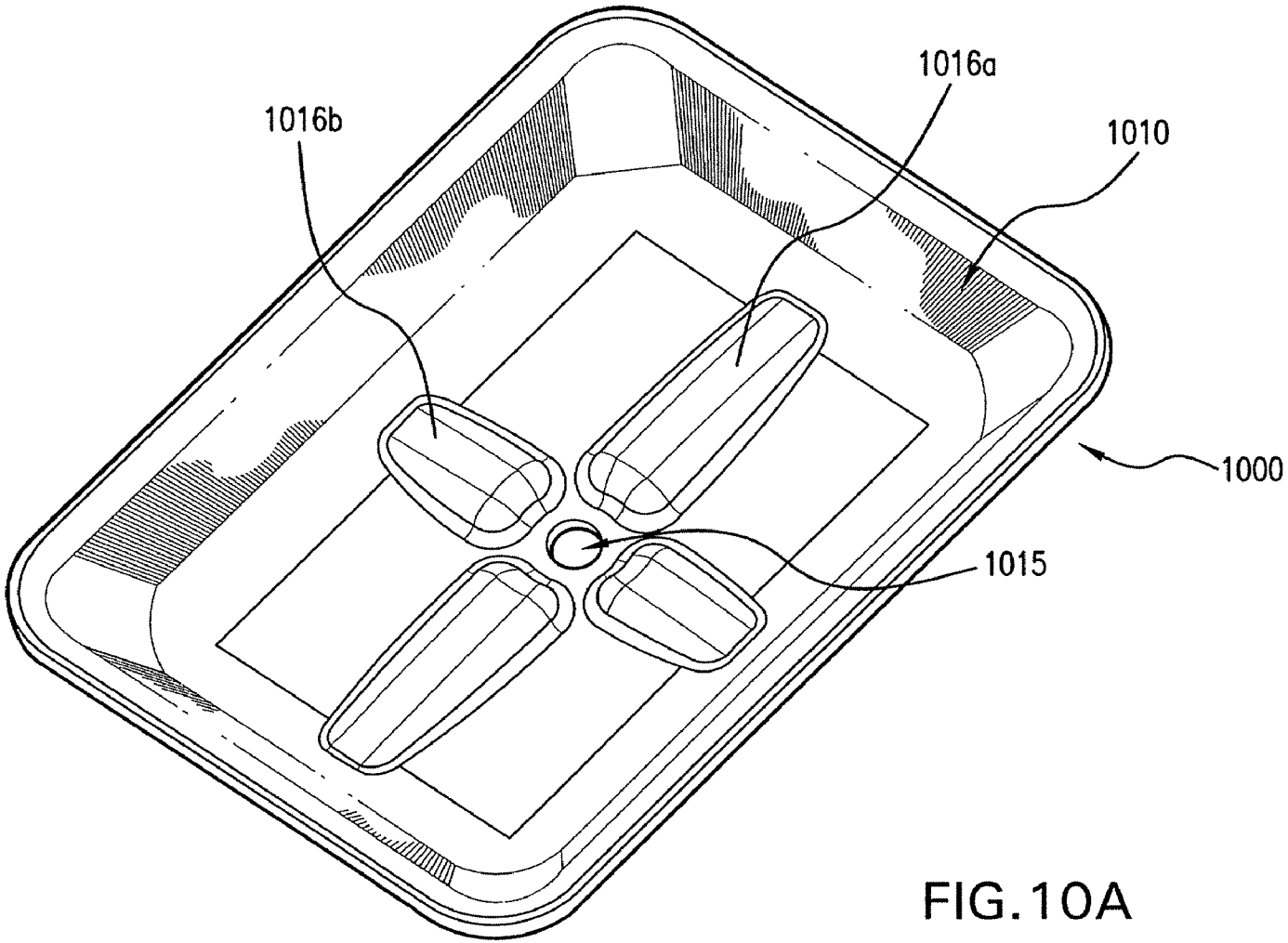
FIGS. 10A-D illustrate an alternate embodiment of the container having an internal reservoir, in accordance with the invention, where drain channels are provided.
Figure 10B:
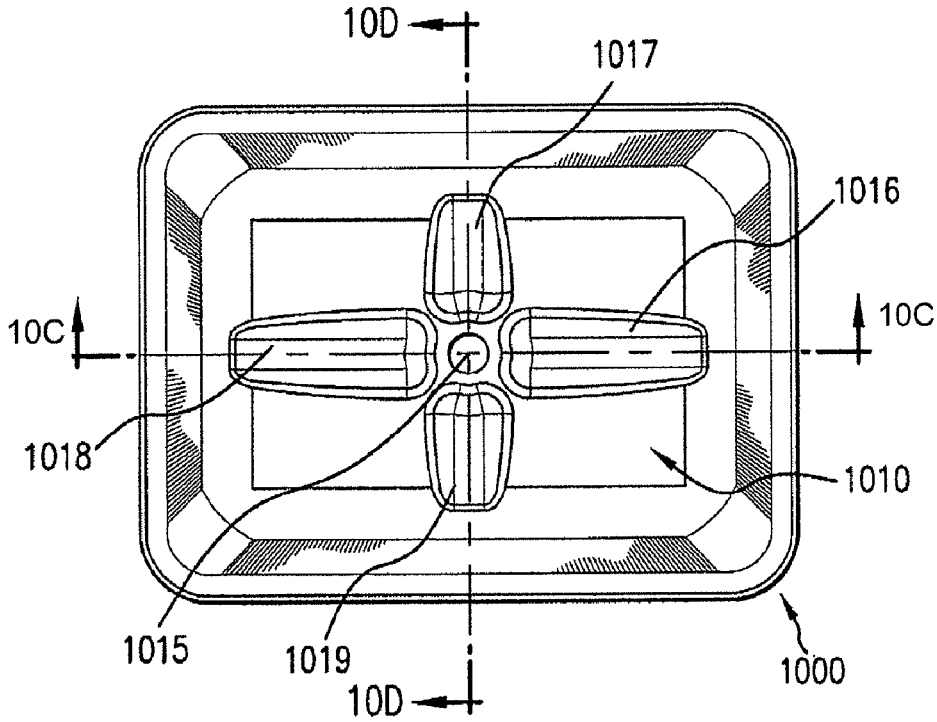
Figure 10C:
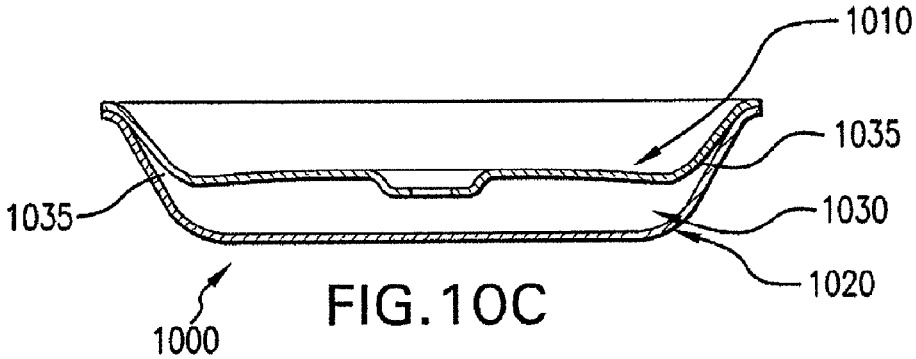
Figure 10D:
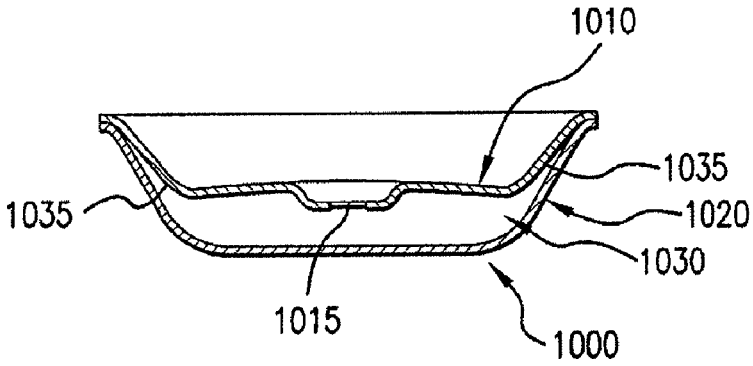
Figure 11A:
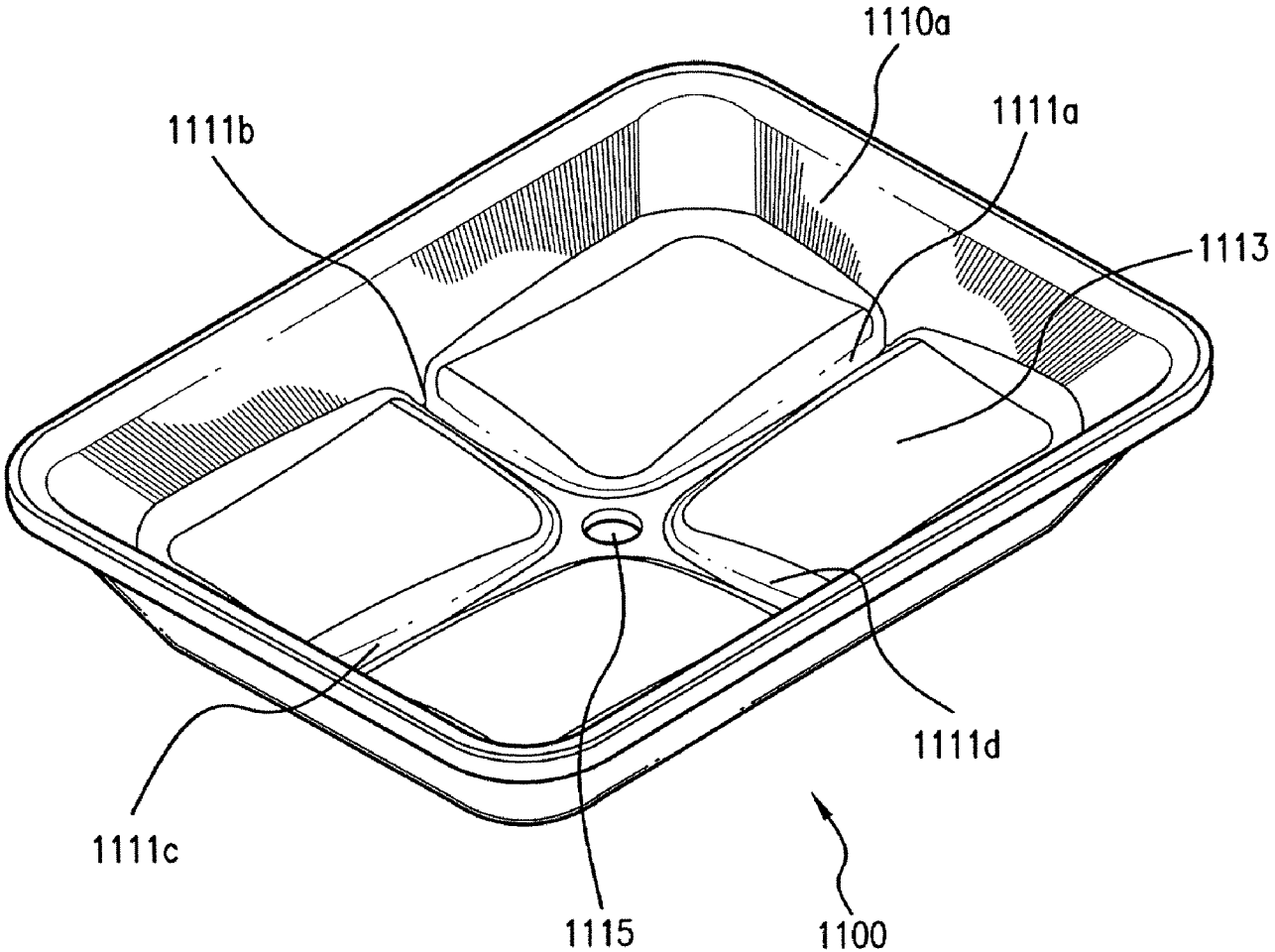
FIGS. 11A-D illustrate a further alternate embodiment of the container having an internal reservoir, in accordance with the invention, wherein drain channels are provided.
Figure 11B:
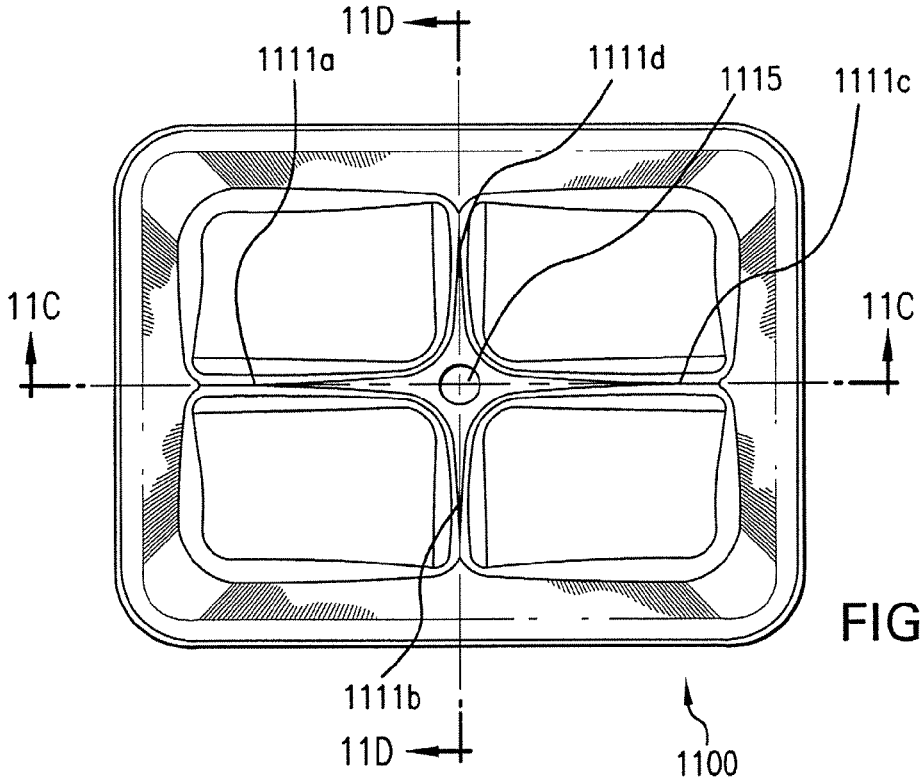
Figure 11C:
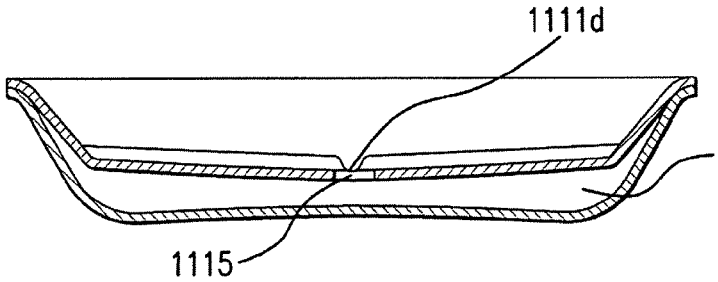
Figure 11D:
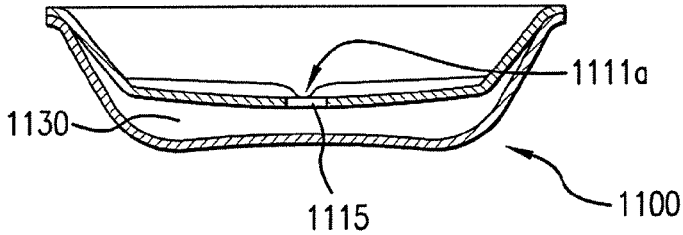

FIGS. 9*a* and 9*b* illustrate top isometric and bottom isometric views, respectively, of a variant configuration for a second or "top" tray 910. The second tray 910 includes lengthwise and widthwise, radially oriented ribs 914 arranged in the sloped bottom wall 913 thereof. These ribs help strengthen the container and prevent contents of the container from obscuring the central aperture 915. Though the aperture 915 can be configured with any shape, as described above, the aperture 915 is illustrated has having a circular body 915*a* with axial extensions 915*b*. These extensions can be aligned with one or more ribs to define a vent at the apex of each such rib 914. As can be seen from the bottom view of FIG. 9*b*, the ribs are formed in the bottom wall 913 to extend above the upper surface 913*a* of the bottom wall 913, while maintaining generally uniform wall thickness. Accordingly, material savings are achieved, while a more effective and stronger upper tray 910 is obtained.

FIGS. 10*a* through 10*d* illustrate a further embodiment of a container 1000 in accordance with the invention. The container 1000 includes a plurality of ribs 1016-1019 arranged longitudinally and laterally in the second tray 1010 of the container 1000. The ribs of FIGS. 10*a*-10*d* are wider and more contoured than those of FIGS. 9*a* and 9*b*. As with the container of FIGS. 9*a* and 9*b*, however, the ribs 1016-1019 define raised surface elements to support contents above the bottom wall, and channel exuded liquids from the contents of the package to the drain aperture 1015 and reservoir 1030. As embodied herein, reservoir chambers 1035 are provided between the sidewalls of the first tray 1010 and the second tray 1020, although are not necessary for this embodiment. In addition to channeling liquids toward the aperture 1050, the ribs 1016-1019 create a space below package contents, for liquid to pass to the aperture 1015. Moreover, the ribs 1016-1019 can help strengthen the second tray 1010.

In accordance with another aspect of the invention, FIGS. 11A-11D illustrate a container 1100 having a series of troughs 1111*a-d* provided in the bottom wall 1113 of the second tray 1110 of the container 1100. The function and advantages of these troughs 1111*a-d* are similar to those of the ribs of container 1000 of FIG. 10. That is, the troughs define raised surface elements to support the contents of the package above the aperture, to prevent blockage and to define flow paths to direct liquid toward the aperture. Advantageously, troughs 1111*a-d* depicted in FIGS. 11A-11D are narrow such that contents placed in the package can more easily bridge the troughs 1111*a-d*, thus preventing obstruction of liquid flow to the aperture 1115 and reservoir 1130.

Figure 12:
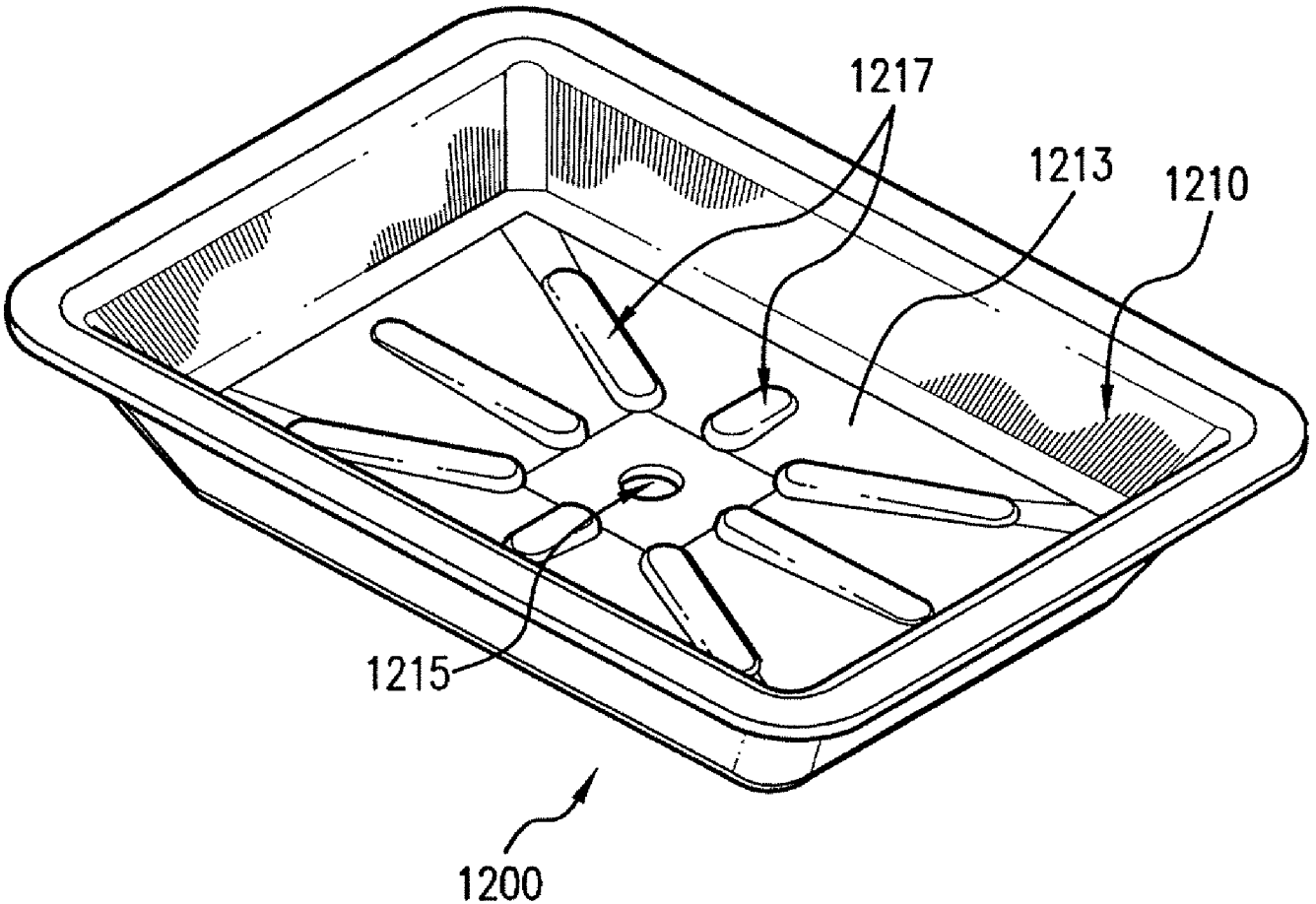
FIG. 12 illustrates a container having an internal reservoir, in accordance with the invention, wherein substantially radial supporting ribs are provided.
Figure 13B:
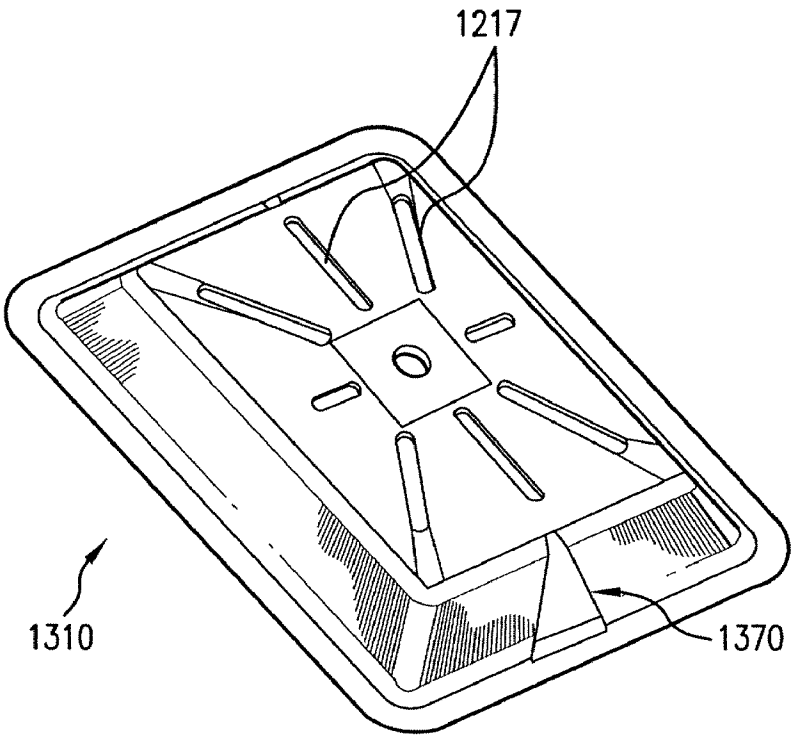
FIGS. 13A-B and 14A-B illustrate a container having an internal reservoir, in accordance with the invention, wherein substantially radial supporting ribs and vents are provided.
Figure 13A:
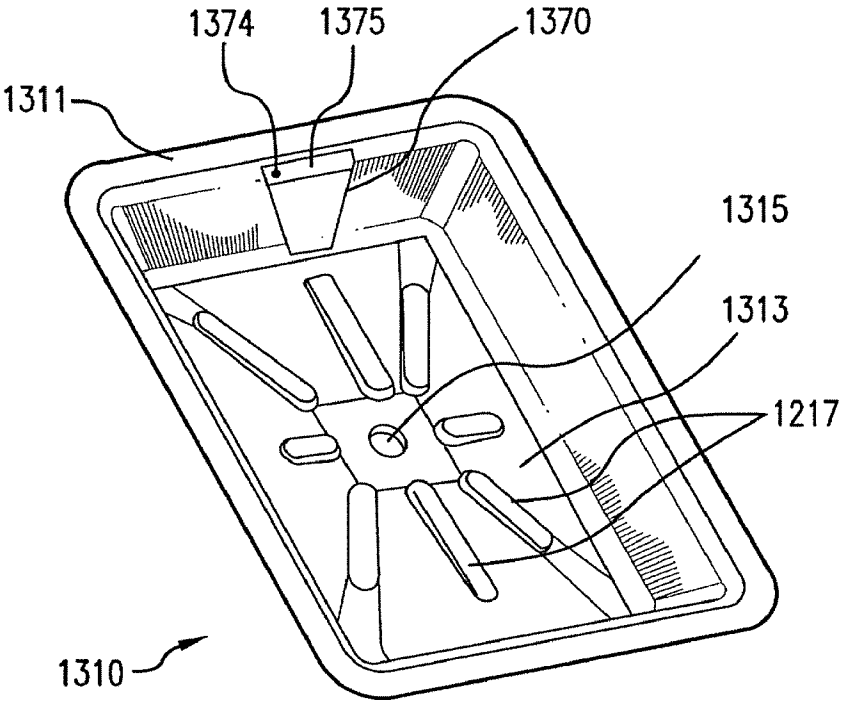
Figure 14B:
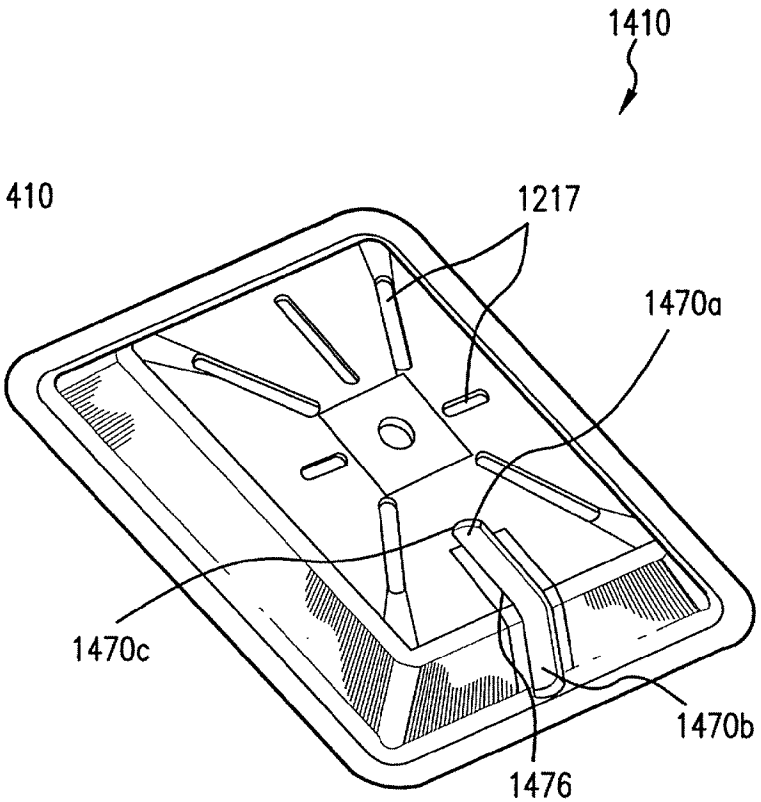

FIGS. 12, 13*a*-13*b* and 14*a*-14*b* each depict a container having a second tray with similar elongate, raised surface features. In FIG. 12, for example, the surface features 1217 are arranged generally radially relative to the central aperture 1215. As shown in FIGS. 13*b* and 14*b*, which illustrate a bottom view of second tray 1310 and 1410, respectively, the surface features are formed into the bottom wall of the second tray 1210, with a generally uniform wall thickness throughout. Alternatively, the raised surface features 1217, 1317 can be created by way of a thickened wall area, wherein the lower surface of the bottom wall would not have a recess corresponding to the raised area, but rather would be generally flat. As shown in FIG. 12, the bottom wall of each embodiment has an upper surface that slopes toward the central aperture, while the top surface of the surface features are relatively planar. This aspect provides decreased resistance to liquid flowing under the contents of the package 1200, by lifting the contents further off of the bottom wall 1213 of the container 1200, nearer the aperture 1215.

The embodiment of the second or "top" trays 1310 of FIGS. 13*a* and 13*b* is substantially similar to that of FIG. 12, but includes a vent 1370 for venting the reservoir, which is below the surface of bottom wall 1313. While not always essential for adequate operation, if the aperture 1315 is small, or an un-vented valve is inserted in the aperture, venting may be desired and/or required to allow gas within the reservoir to escape while liquid is entering the reservoir. The vent of the embodiment of FIGS. 13*a* and 13*b* is in liquid communication with the reservoir and extends essentially to the upper edge of the rim or flange 1311 of the second tray 1310. A vent aperture 1374 can be placed anywhere along the vent 1370, but preferably at an upper end surface 1375 of the vent 1370. The vent aperture can itself include a valve, or can simply be an aperture. The size of the vent aperture can be preselected to be small enough so that gasses can escape from the reservoir, while the surface tension of liquid in the reservoir prevents the escape of the liquid. For example, an aperture in the form of a "pinhole" may be desirable. When the second tray 1310 is joined with a corresponding first tray, the main body of the vent 1370 assures the free passage of gasses out of the reservoir through an opening other than the central aperture. Furthermore, the embodiment illustrated in FIGS. 13*a* and 13*b* allows venting of the reservoir even if the sidewalls of the first and second trays are in contact with one another. That is, the tray need not be provided with side reservoir chambers, such as chamber 1335 of FIG. 3, to allow venting of the reservoir.

Figure 14A:
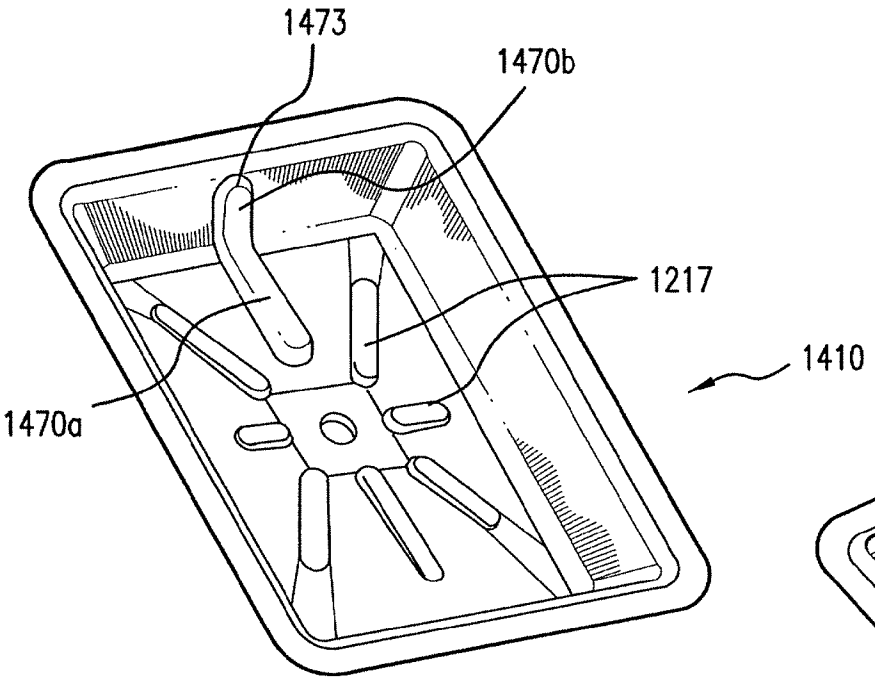
Figure 15A:
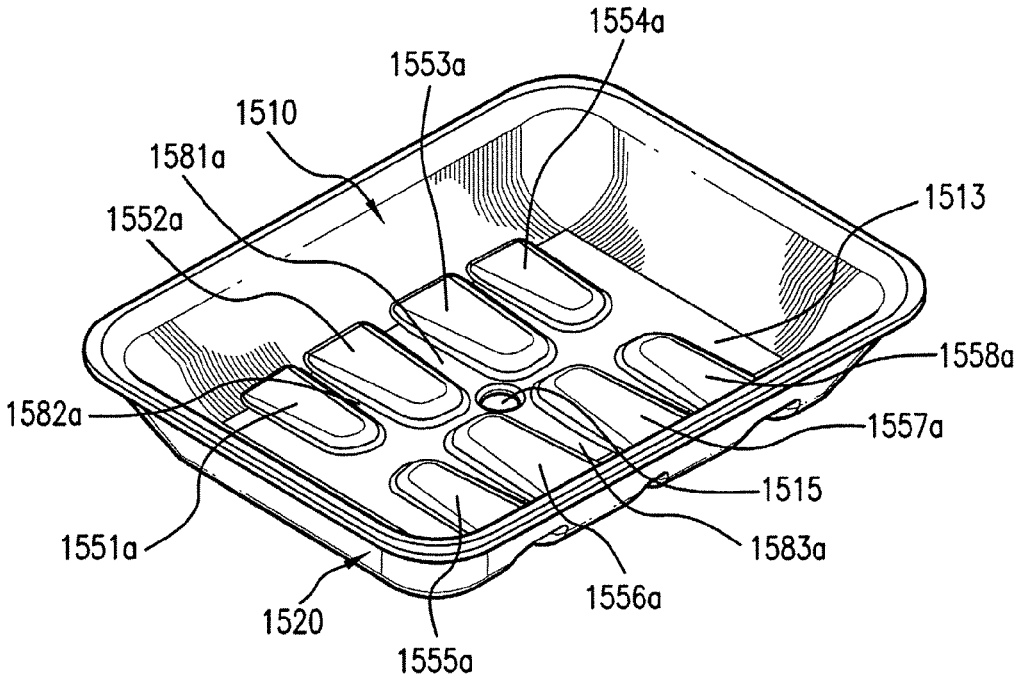
FIGS. 15A-F illustrate an alternate embodiment of a container having an internal reservoir, in accordance with the invention, wherein transverse raised surface features are provided on the lower tray to support the upper tray.
Figure 15B:
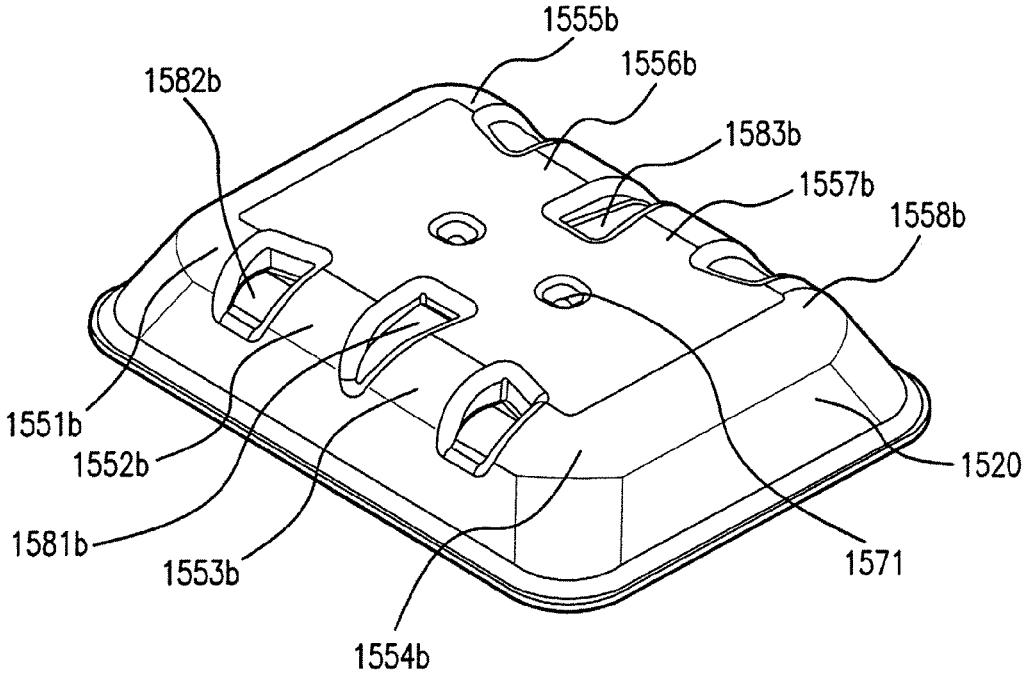
Figure 15C:
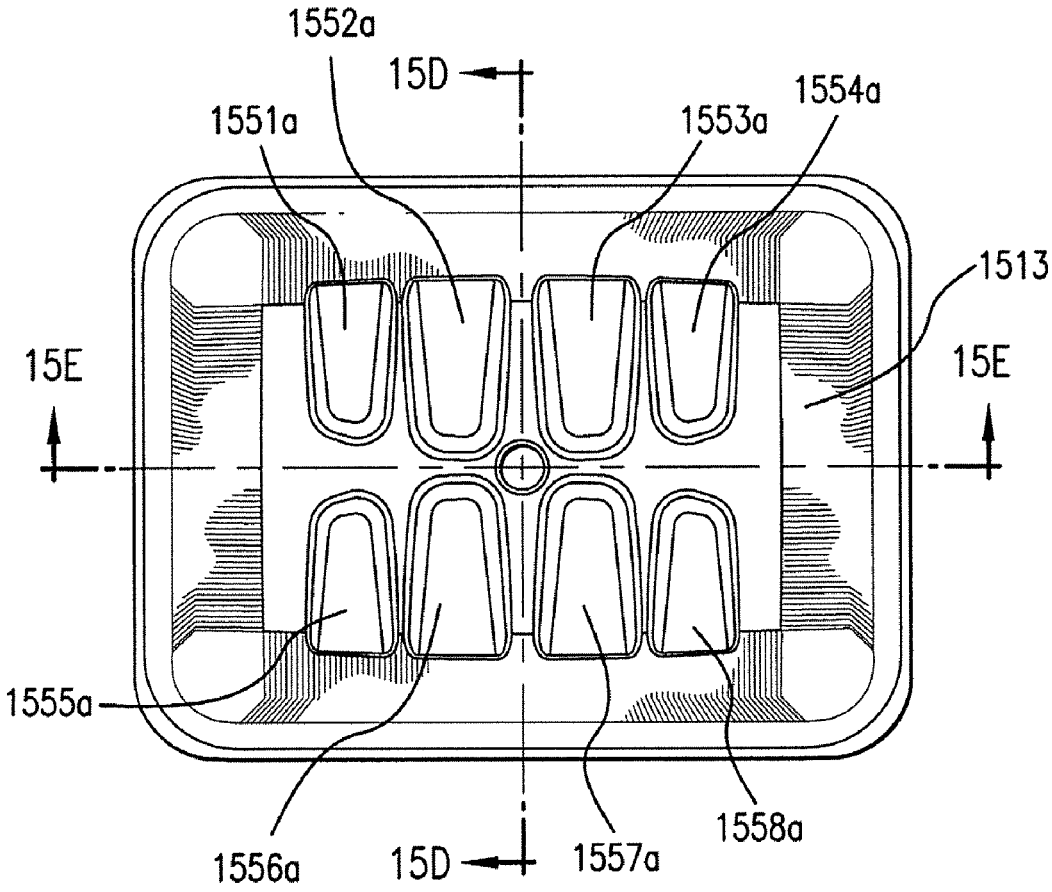
Figure 15F:
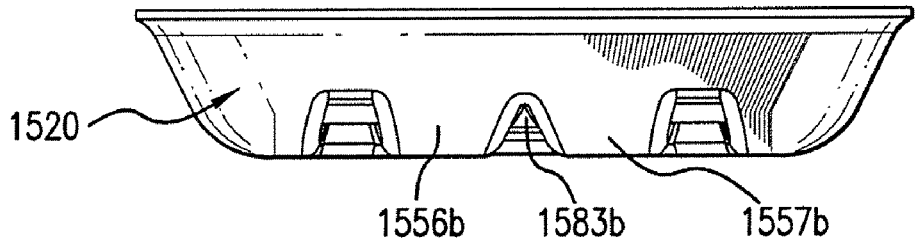
Figure 15D:
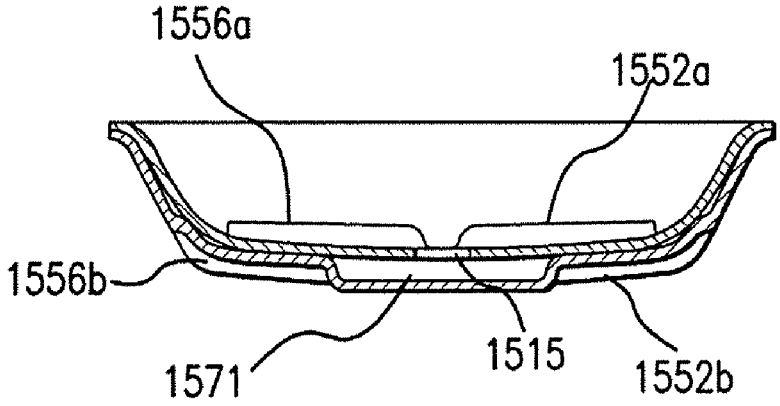
Figure 15E:
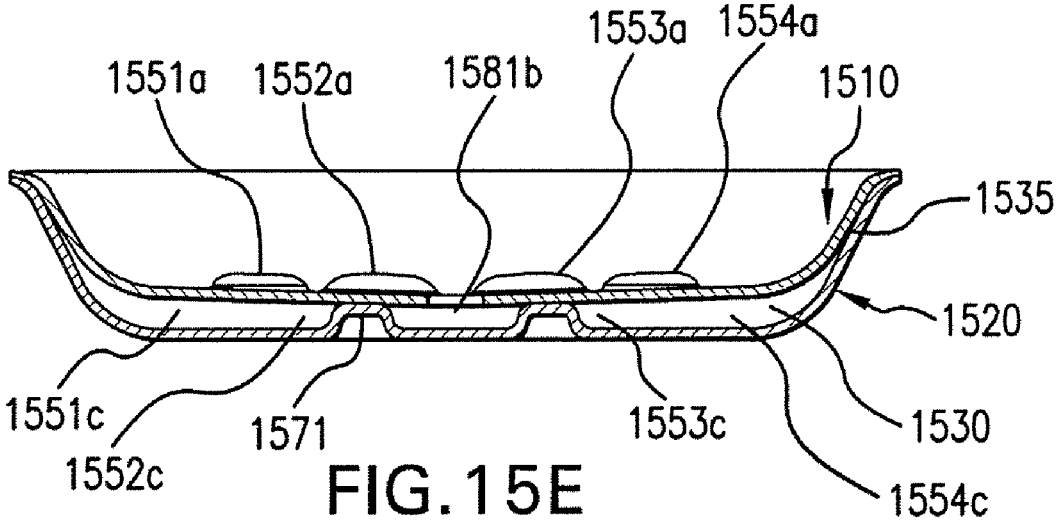

Similarly, the second tray portion 1410 of FIGS. 14*a* and 14*b* includes an integral vent and surface feature 1470. The vent and surface feature 1470 extends along the bottom wall of the second tray and up the sidewall of the second tray portion 1410. A vent hole 1473 is provided at the upper end of the surface feature 1470. As seen from the bottom isometric view of FIG. 12*b*, a panel 1476 can be applied to a bottom surface of the second tray portion 1410, to form a substantially enclosed vent duct within the vent and surface feature 1470. This duct allows easy passage of gasses but is a further encumbrance to liquids that may tend to flow toward the vent aperture 1473. If, for example, a tray having the vent and surface feature 1470 as shown, were turned on end or upside down so that the portion 1470*b* were directed downward, liquid in the container would be obstructed from reaching the vent aperture 1473 by the panel 1476, since liquid would have to enter through opening 1470*c*. The panel 1476 can be of any suitable form, including but not limited to a self-adhesive plastic film.

FIGS. 15*a*-15*f* illustrate another embodiment of a container in accordance with the invention. Container 1500 includes a second tray 1510 having raised transverse surface features 1551*a*-1558*a* defining raised surface features to elevate tray contents above a lower drainage region 1517. The surface features 1551*a*-1558*a* also create reservoir chambers between the second tray 1510 and the first tray 1520. The reservoir 1535 is comprised at least partly of these chambers 1551*c*-1558*c*, which can be best seen in FIG. 15*e*. These chambers correspond to and are defined on an upper border by the surface features 1551*a*-1558*a*, respectively and corresponding features of the first tray 1520. The first tray can be free of any surface contours, or can be provided with surface contours aligned (e.g., 1582), or out of alignment (e.g., 1552*b*, 1553*b*, 1556*b* and 1557*b*) with the surface features of the second tray to adjust the volume of the chamber.

The reservoir chambers (e.g., chambers 1551*c*, 1552*c*, 1553*c* and 1554*c*, which are shown) retain liquid, but advantageously prevent stored liquid from moving freely within the reservoir 1530 and thus reduce the likelihood of leakage out of the reservoir 1530 through the aperture 1515.

Moreover, the recessed portions formed in the first tray 1520, such as recessed portions 1581*b* and 1582*b*, define cooperating elements to support the second tray 1510, and therefore also help support the contents placed in the second tray 1510. The recessed portions (e.g., 1581*b* and 1582*b*) contact the lower surface of the bottom wall 1513 of the second tray 1510 in respective regions as indicated by reference numbers 1581*a* and 1582*a*, respectively. Central detents 1571 in the first tray 1520 also can be provided to support the second tray 1510.

Non-recessed portions of the first tray 1520 designated by reference numbers 1555*b*, 1556*b*, 1557*b* and 1558*b* therefore cooperate with respective raised transverse surface features 1555*a*, 1556*a*, 1557*a* and 1558*a* to create a symmetrical set of chambers 1551*c*, 1552*c*, 1553*c* and 1554*c*. As with the above-described embodiments, the reservoir 1530 and chambers (e.g., chambers 1551*c*, 1552*c*, 1553*c* and 1554*c*) can extend along the sidewalls of the first tray 1520 and the second tray 1510 to define chambers therebetween.

Figure 17A:
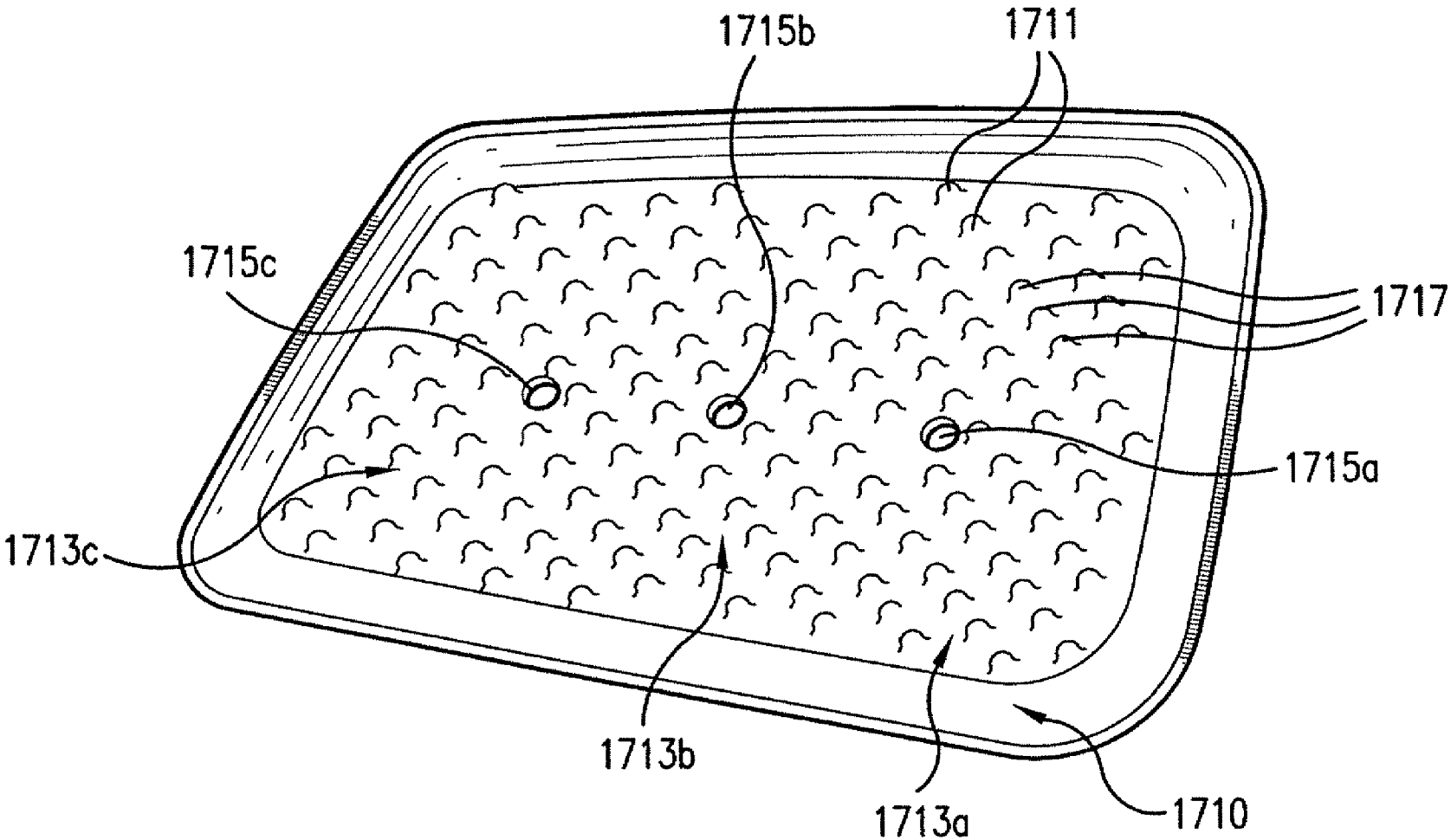
FIG. 17A is an isometric view of an alternate embodiment of a container having multiple drain regions and separate internal reservoir cells, in accordance with another aspect of the invention.
Figure 17B:
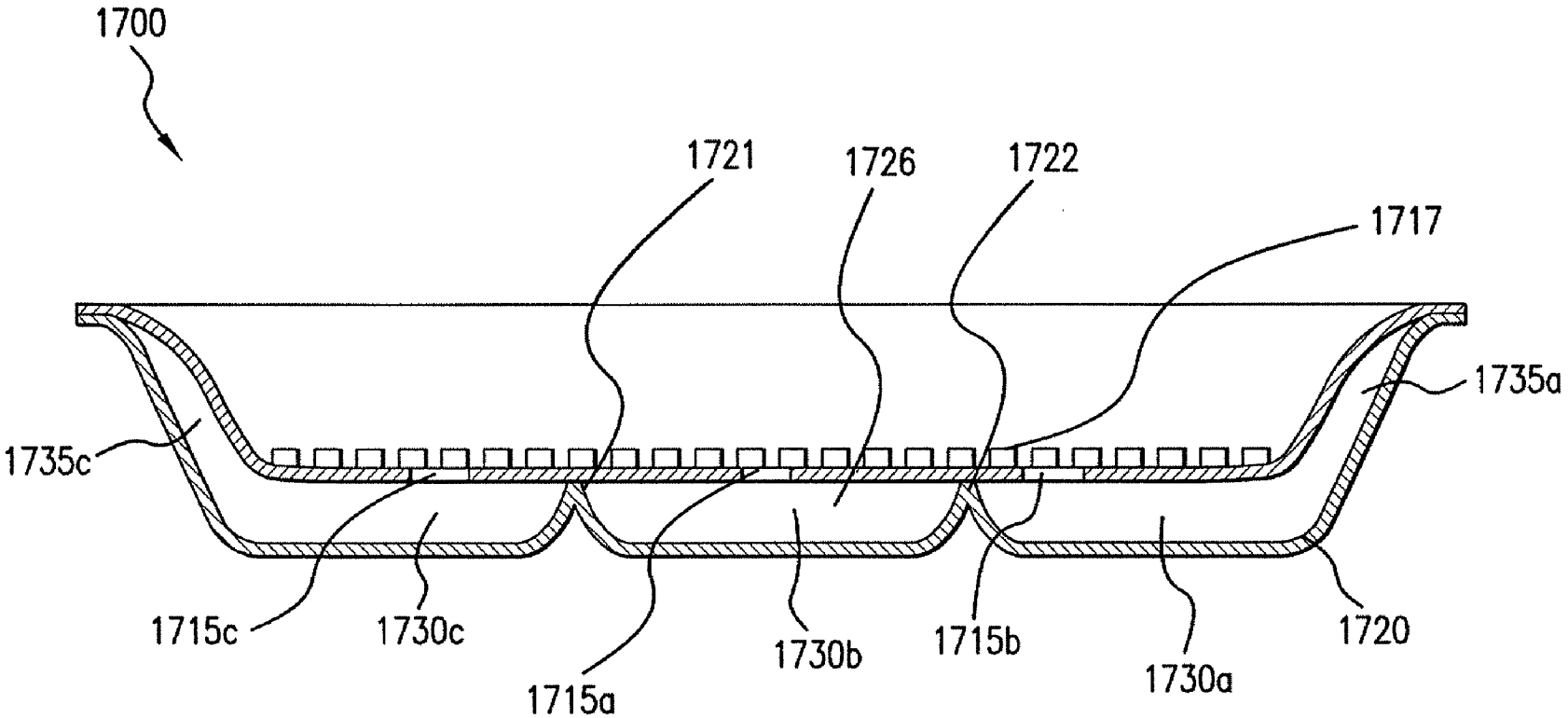
FIG. 17B is a cross-sectional view of the container of FIG. 17A.

FIGS. 17*a* and 17*b* illustrate a tray in accordance with another aspect of the invention, wherein a plurality of drain areas 1713*a-c* are provided. Such a feature is particularly useful in relatively large trays, but can also be incorporated in small trays. Each drain area 1713*a-c* includes at least one respective aperture 1715*a-c* in a central region thereof. The bottom wall of each drain area 1713*a-c* of the second tray 1710 preferably slopes toward its respective aperture(s). Raised surface features 1717 as previously described can be provided on the second tray 1710.

The first tray is divided into a plurality of cells, with each cell corresponding to a respective drain area. The aperture(s) 1715*a-c* of each drain area is in fluid communication with a respective cell 1730*a-c*, such that a reservoir is defined therebetween. Each reservoir is defined between a bottom surface of the second tray 1710 and an upper surface of the first tray 1720. The cells 1730*a-c* are divided from one another by walls 1721, 1722 formed in the first tray 1720. As embodied herein, the walls 1721 extend across the width of the tray, substantially perpendicular to the intersecting sidewall. FIG. 17*b* shows the walls 1721 essentially equidistant from the apertures (e.g., two of 1715*a-c*) associated to the respective adjacent drain areas (e.g., two of 1715*a-c*) being separated. The walls 1721 can terminate at each sidewall (e.g., sidewall 1726), or can continue up the sidewall if a chamber between the first and second trays, such as chamber 1735*c*, is provided. The container 1700 is provided with reservoir chambers 1735*a* and 1735*c*, associated with cells 1730*a* and 1730*c*, respectively. Manufacture of container 1700 preferably includes assembling and joining at least two pieces (e.g., first tray 1720 and the second tray 1710). If desired, the cells 1730*a-c* can be further sealed from each other by providing a sealant or adhesive along the top of walls 1721 and 1722. Alternatively, a close fit can be sufficient, so that the pressure at the joint prevents leakage of liquid around the wall. Alternatively still, a mechanically interlocking interface can be used. Finally, ribs 1711 (FIG. 17A) can be provided to improve the rigidity of the container sidewalls and further, help keep the contents of the tray off of the sidewall. This can facilitate drainage of liquid from the top of the contents to drain between the contents and the sidewall to flow to the reservoir cells 1730*a-c*.

Figure 18A:
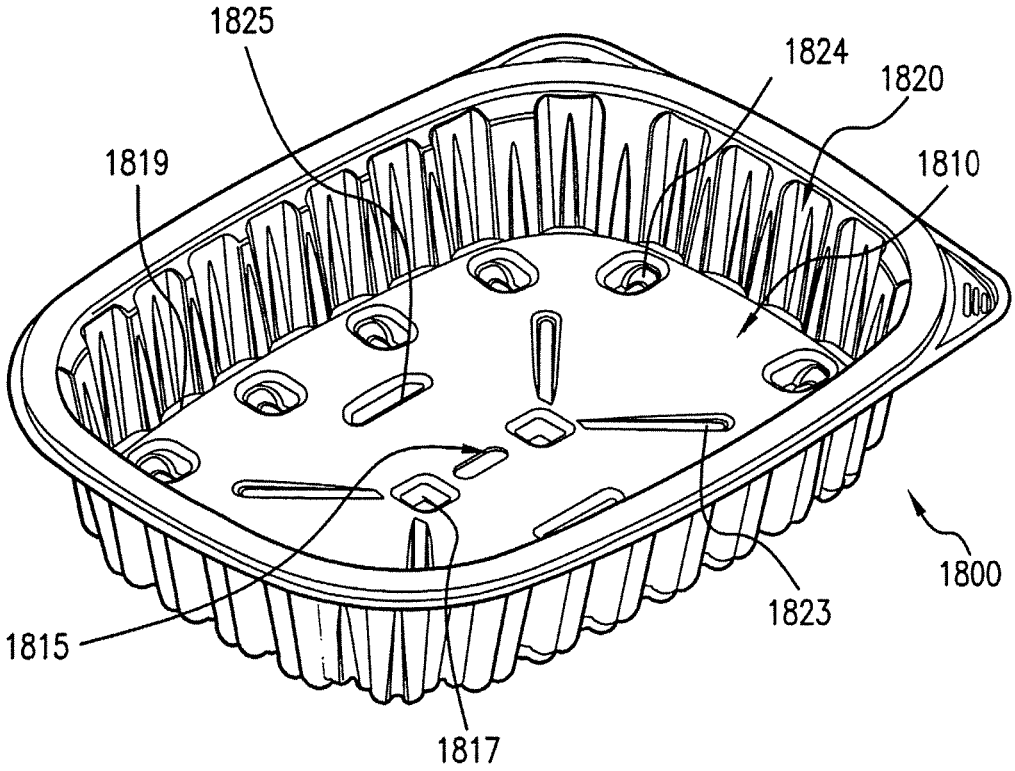
FIGS. 18A-B illustrate an alternate embodiment of a container having an internal reservoir, in accordance with the invention, which is particularly suited to use with relatively large and heavy contents.
Figure 18B:
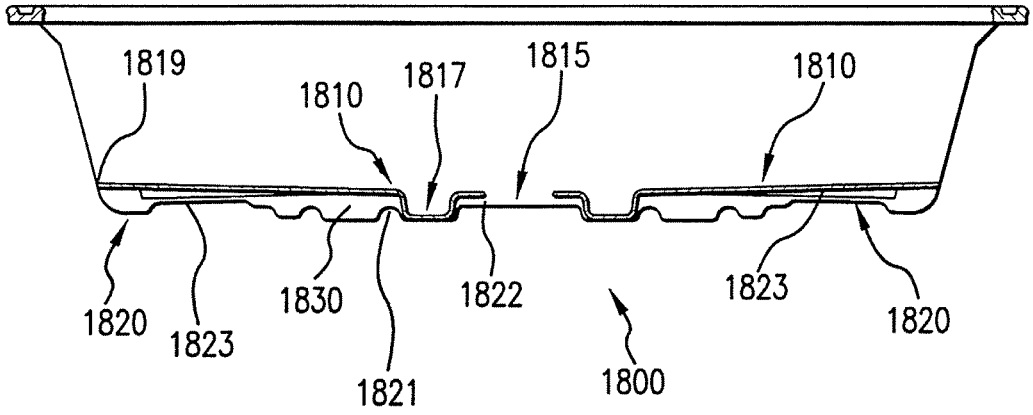

FIGS. 18*a* and 18*b* illustrate a further embodiment of a container in accordance with the invention. Container 1800 is particularly suited for use as a container for cooking, displaying and/or storing larger products, such as roasts or whole chicken. Similar to the previous embodiments, the container is provided with an outer first tray 1820 and an inner second tray 1810, having at least one central aperture 1815 to allow liquids to drain into a reservoir 1830. The materials of this embodiment are preferably selected to withstand oven temperatures, so that food can be cooked in the trays, or alternatively, stored on a hot plate and/or under heat lamps without melting or becoming less stable. As with certain of the above embodiments, the first tray 1820 and second tray 1810 cooperate to provide support to the second tray 1810 and the contents resting thereon. For example, a recess or standoff 1817 is provided in the second tray 1810, which rests between two protrusions 1821 and 1822 that are provided in the first tray 1810. Further cooperating standoffs 1823, 1824 and 1825 are provided in the second tray 1810. As embodied herein, standoffs 1823 are tapered so that the weight of the contents on the bottom wall of the second tray 1810 flexes the bottom wall downward to allow the exuded liquid to flow toward the aperture. Although not shown in the embodiment of FIGS. 18*a* and 18*b*, reservoir chambers can be defined between sidewalls of the first and second containers, to further contain exuded liquids in the concealed reservoir. Further, the first and second trays shown in this embodiment are sealed in some manner along the edge region, designated by reference number 1819. A "snug" fit may be sufficient to prevent liquids from leaking from reservoir 1830, however, sealant, or a bonding process, such as heat welding, can be used.

FIGS. 19A-C, and 20A-B illustrate alternate embodiments of a container in accordance with a different aspect of the invention. In these embodiments, rather than including a central aperture for drainage of exuded liquid, a peripheral gap is provided along at least a portion of the bottom wall of the second tray, to allow liquid to drain off the edge of the second (inner) tray and into a reservoir 1930.

Figure 19A:
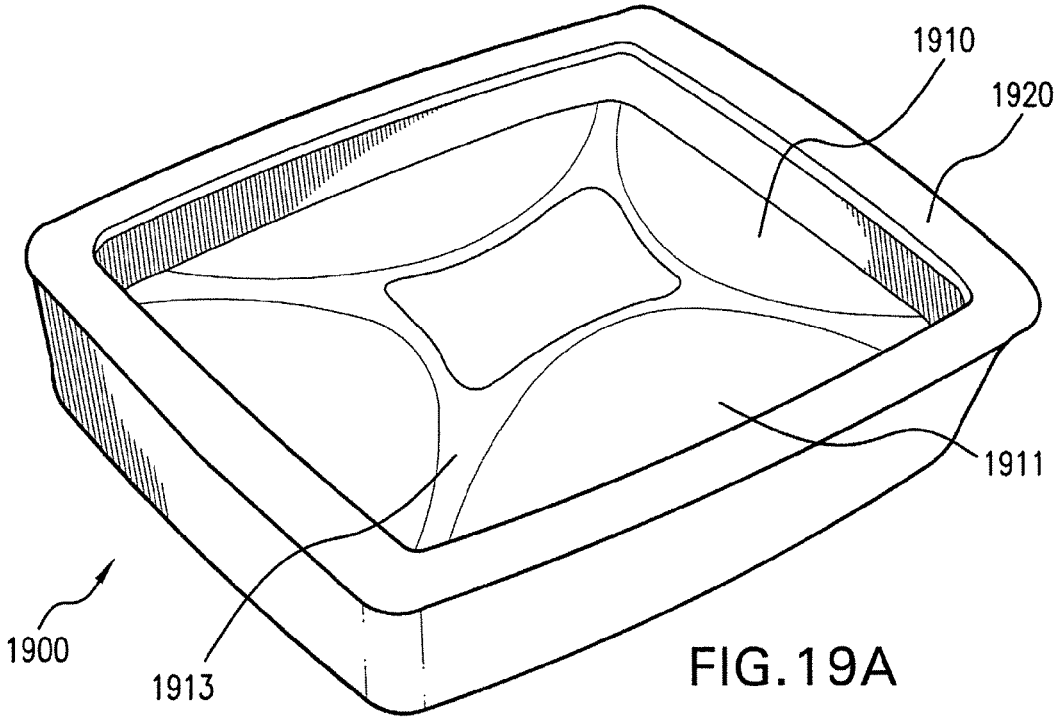
FIGS. 19A-C and 20A-B illustrate alternate embodiments of a container having an internal reservoir, in accordance with another aspect of the invention, wherein liquid drains along a circumferential edge of an inner tray.
Figure 19C:
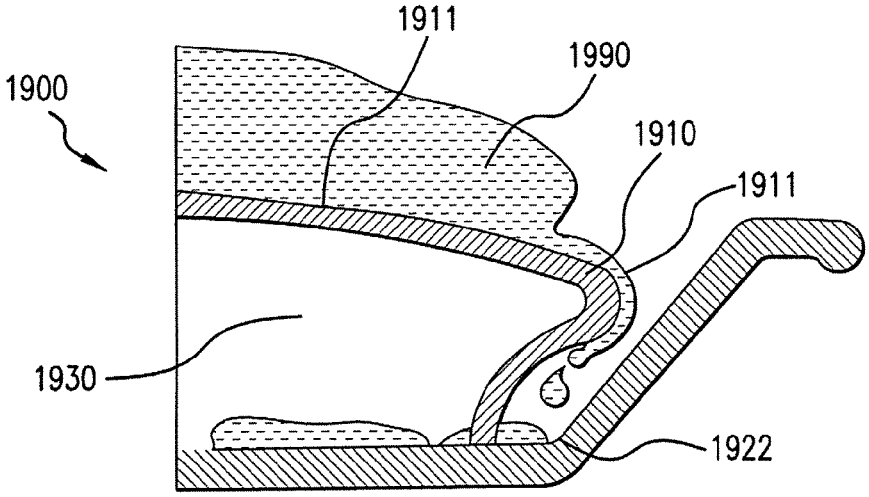
Figure 19B:
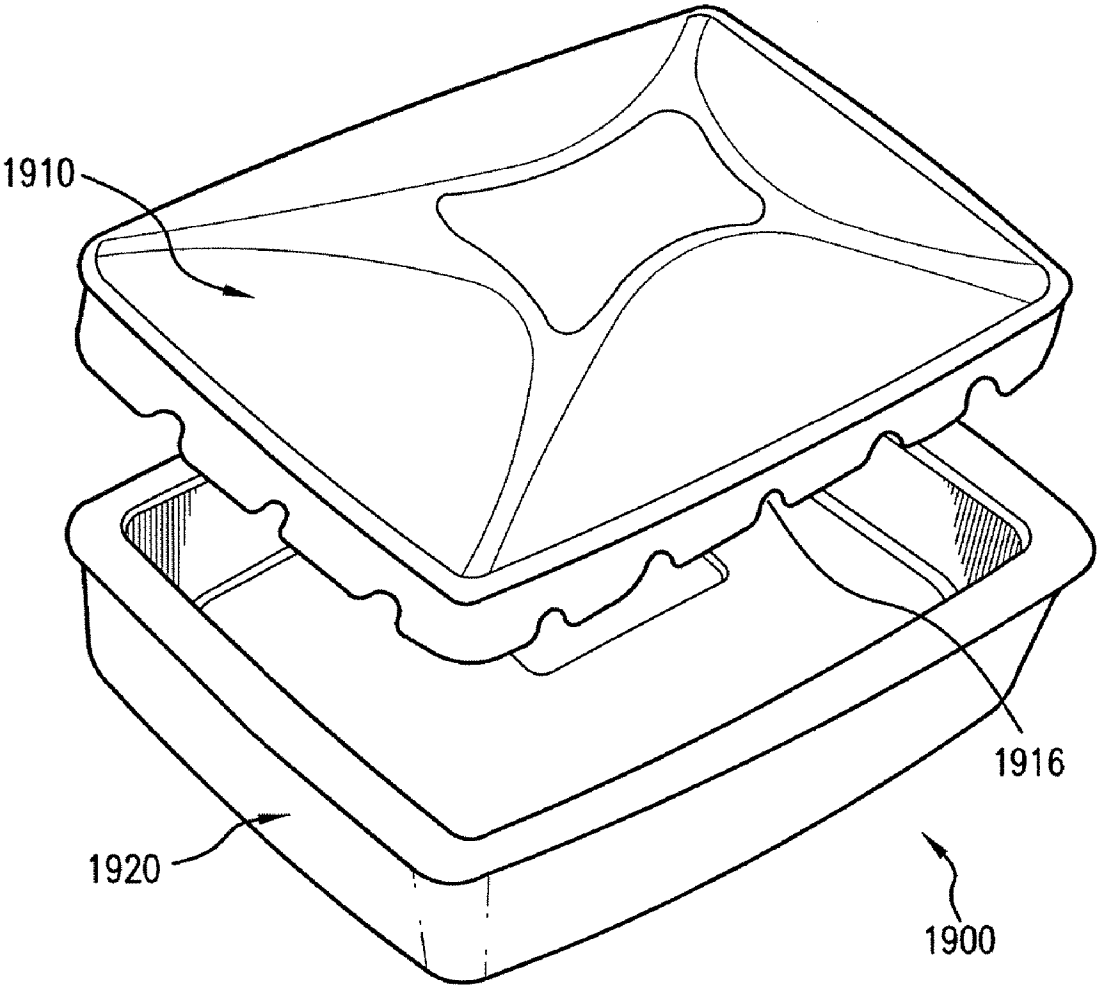
Figure 20A:
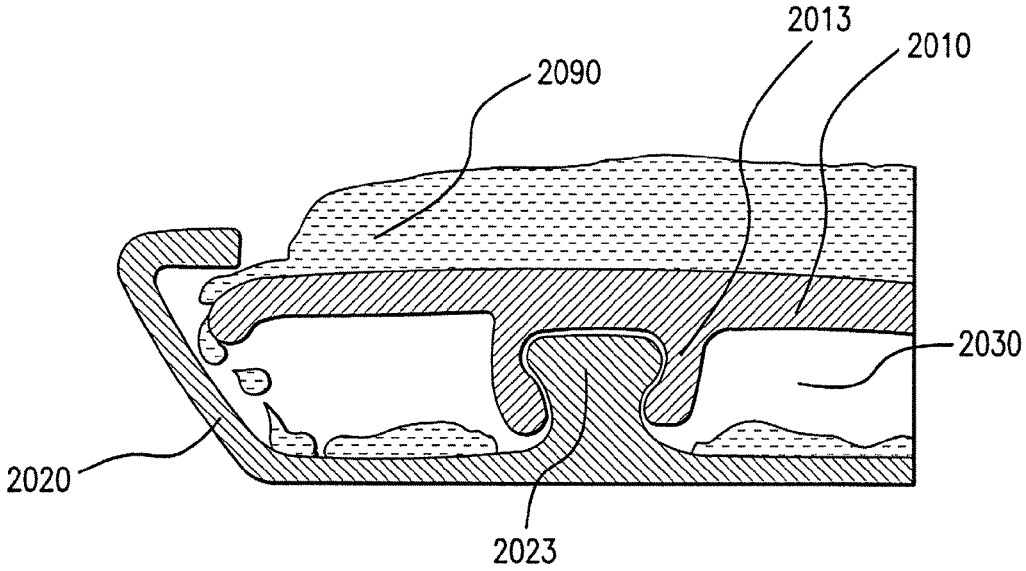
Figure 20B:
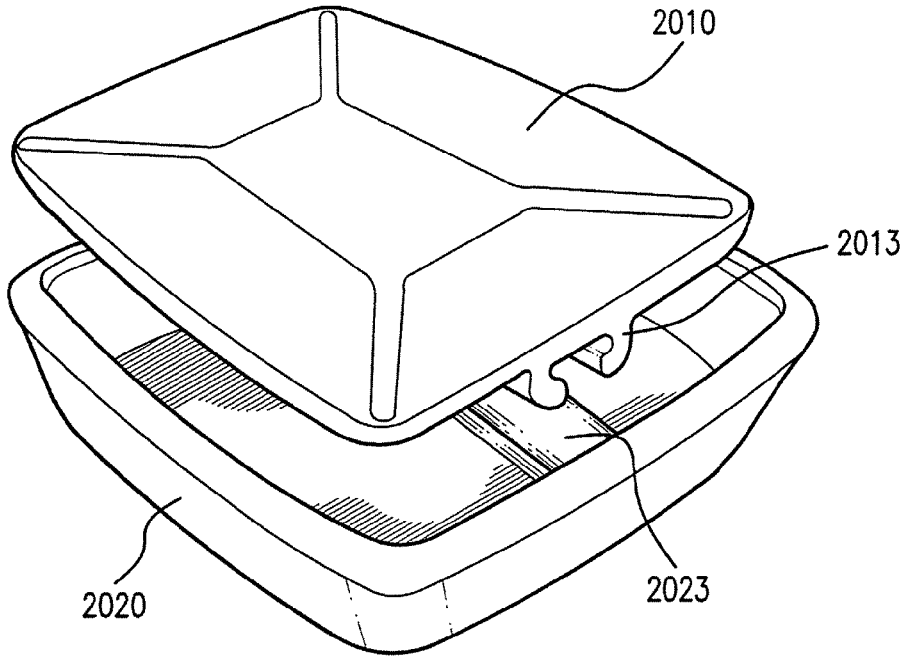

The first and second trays can be connected or joined in a variety of different was. For example, containers 1900 and 2000 show two alternate ways in which the second trays (1910, 2010) can be connected to a respective first tray. When assembled, the two embodiments appear similar, as depicted in the assembled isometric view of FIG. 19A. As seen in FIGS. 19A and 19C, the second tray 1910 has ridges 1913 for support, as it is substantially hollow underneath. Although not essential, it provides for an increased reservoir volume. Liquid is exuded from the contents 1990 and drains along the upper surface 1911 to peripheral channel 1922. In the connection of FIGS. 19B and 19C, the second tray 1910 nests within the first tray 1920, and includes grooves 1916, through which liquid can pass to a reservoir region. These trays can be joined, if desired, in any conventional manner, such as by adhesives or fusion. In FIGS. 20A and 20B, the second tray 2010 snaps onto a cooperating portion 2023 of the first tray 2020. In this embodiment, a longitudinal rib 2023 cooperates with a clasp 2013, which grips around the rib 2023 and holds the second tray 2010 to the first tray 2020. As such, liquid only need pass under the second tray 2010 to be out of sight. A variety of alternatives for this construction can be used.

Compared with the above-described embodiments, the containers 1900 and 2000 have the benefit that the contents of the containers would typically not be able to block flow to the reservoir, since the drain essentially circumscribes the border of the container. However, since the liquid drains via the edge of the containers 1900 and 2000, the containers cannot, without a valve, be placed on edge without liquid leaking from the reservoir. Accordingly, a valve can be provided, as are set forth below.

Figure 21:
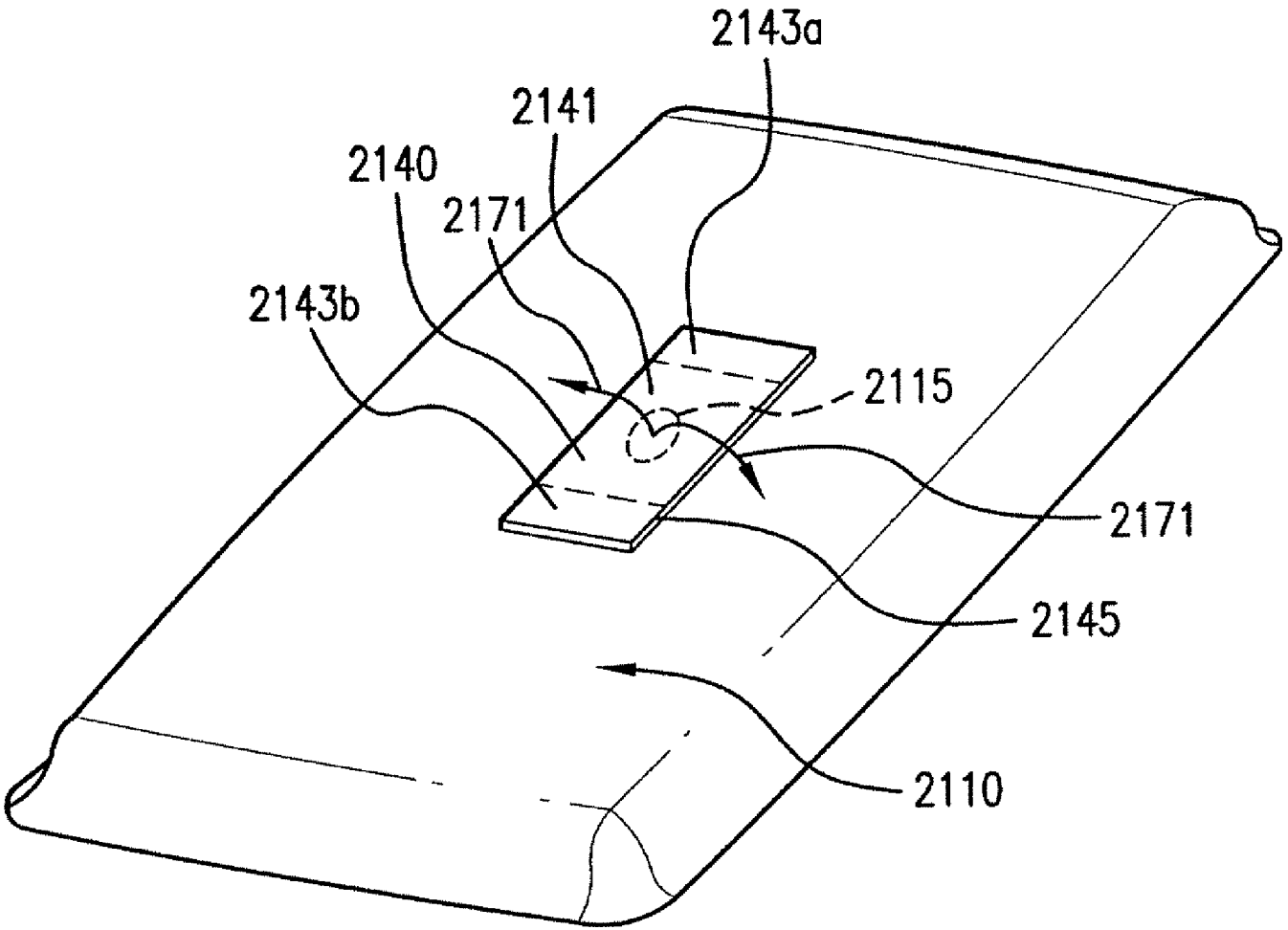
FIG. 21 illustrates a reed-type valve for use with a container having an internal reservoir, in accordance with the invention.

FIG. 21 illustrates the use of a reed-type valve 2140 for preventing backflow of liquid from any of the above-described reservoirs. Though this valve is shown placed over an aperture 2115 in a tray similar to that of FIG. 1, the valve likewise can be used with a tray having a plurality of apertures as shown in FIG. 6, or with multiple drain region tray of FIGS. 17A and 17B.

Generally, the reed valve is a flexible web attached along at least one edge to the lower surface of the bottom wall of the second tray. Preferably the web is attached along opposing edges to allow flexure of the web. As illustrated, the reed valve 2140 is applied to a lower surface of the bottom wall of the second tray, in this case, second tray 2110 which is shown without a first tray for the purpose of clarity. As in the foregoing embodiments, liquid 2171 drains downward through one or more apertures, as indicated by broken line 2115. The liquid impinges a portion of the reed valve 2140 in the area of the aperture(s) 2115. The liquid deflects the central portion 2141 of the reed valve 2140, or is otherwise diverted by capillary effect is diverted to the sides, passes between an upper surface of the reed valve 2140 and a lower surface of the second tray 2110, exiting via one or both sides 2145 of the valve into a respective reservoir or reservoir cell. The reed valve can be attached to the second tray 2110 in any suitable manner to allow the valve to flex sufficiently. As shown, an adhesive is applied in end regions 2143*a* and 2143*b*, between the tray 2110 and the reed valve 2140.

When a container having a reed-type valve 2140 is inverted, the reed valve prevents the liquid in the reservoir from escaping the reservoir.

The materials used for the reed valve should have an appropriate flexural stiffness so that liquid can deflect the valve sufficiently to allow the flow of liquid, and yet to also prevent the escape of liquid as described above. Preferably, a plastic material is used for construction of the reed valve 2140, such as a polystyrene film, polyethylene (PE), or extruded polyethylene terephthalate (EPET). Preferably, the same material is used for the reed valve as for the rest of the container to facilitate recycling. For example, a combination of an expanded polystyrene container with a polystyrene film reed valve would be advantageous.

Figure 22:
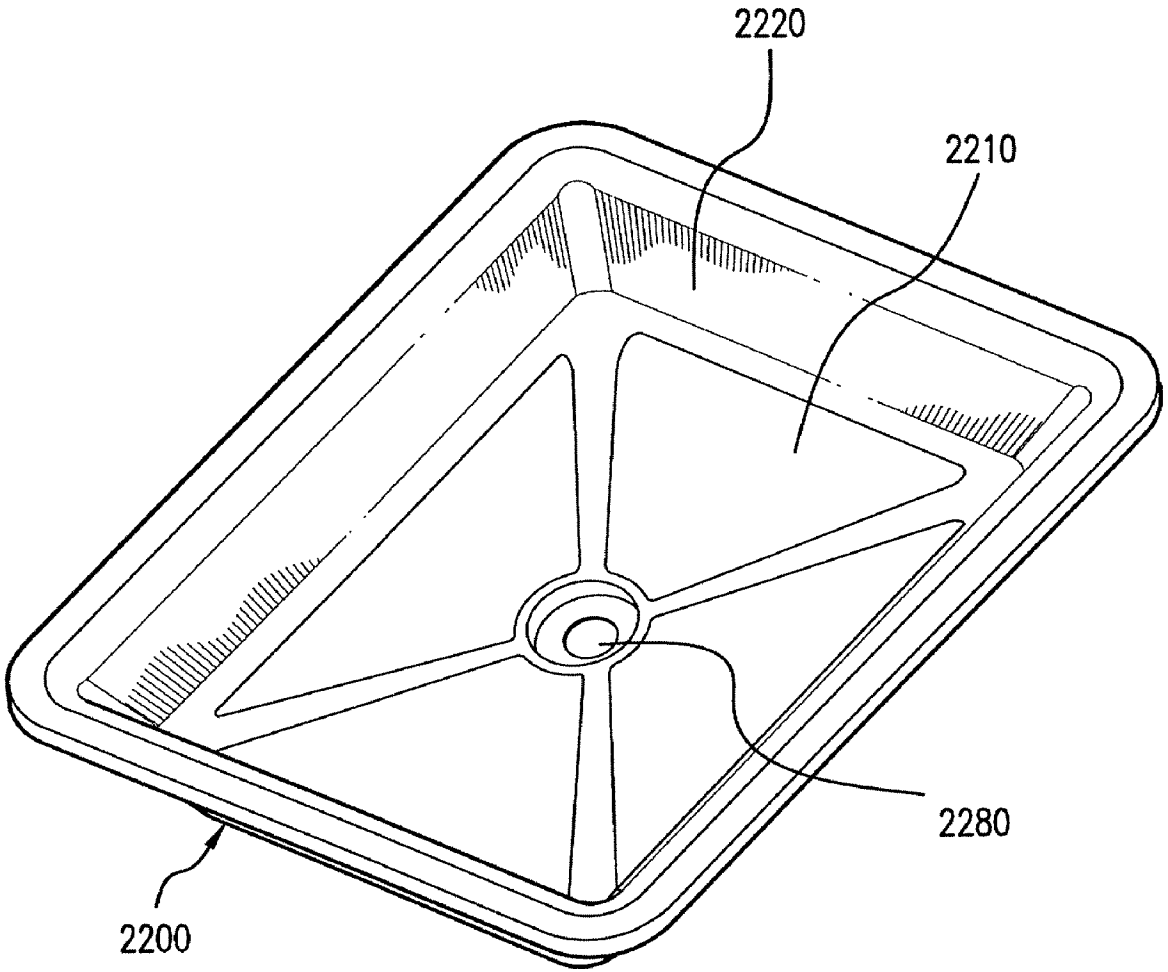
FIG. 22 illustrates a tray having a ball valve and internal reservoir, in accordance with the invention.

Any of a variety of alternative valve configurations can be used, depending on need and costs. FIGS. 22-28 illustrate various ball-type valves. As with the above embodiments, an outer tray 2220 and an inner tray 2210 is provided. In the embodiment of FIG. 22, a valve 2280 is provided in a center portion of the second tray (e.g., in aperture 115).

Figure 23A:
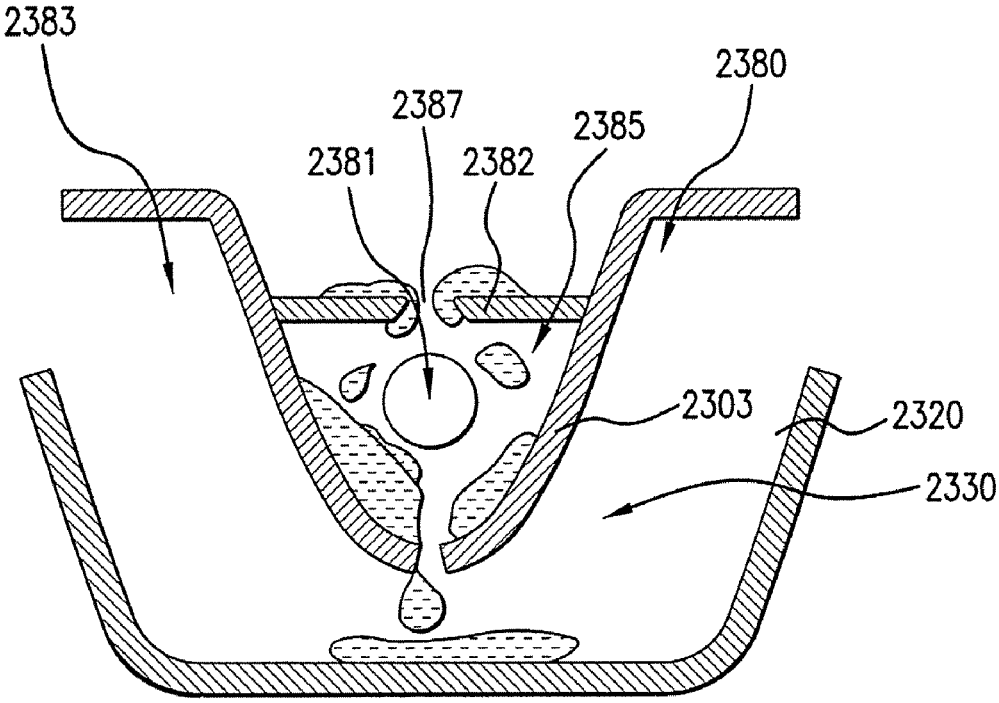
FIGS. 23A-B, 24A-C, 25A-B, 26A-D and 27 A-D illustrate variants of ball valves for use with a container having an internal reservoir, in accordance with the invention.
Figure 23B:
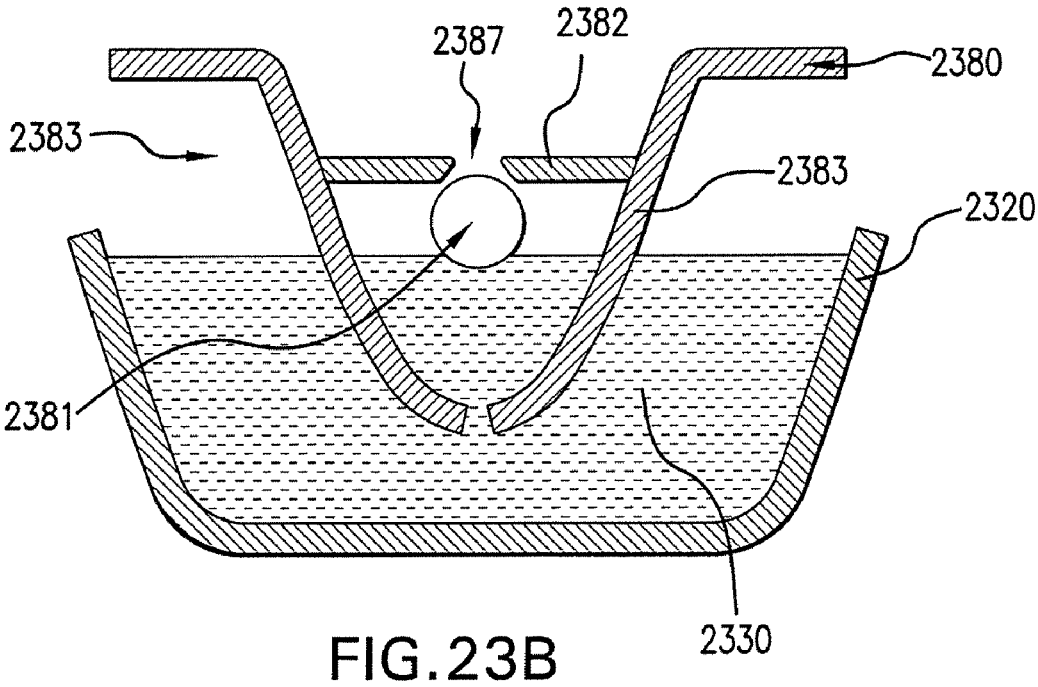

FIGS. 23A and 23B illustrate schematics of a ball valve and the general principles in which the ball valve 2383, in accordance with the invention, will function. The ball 2381 is constrained within a ball cage 2380, which includes a lower restraint 2383 and an upper restraint 2382. The assembly 2383 is shown in relative relation to a first tray 2320, and liquid in a reservoir 2330 thereof. As liquid enters, the ball 2381, which is less dense than the liquid, floats above the liquid and allows the liquid to pass through the assembly 2383. As the level of liquid rises, such as be tilting the container, the ball 2381 closes the aperture 2387, which is provided in the assembly.

Figure 24A:
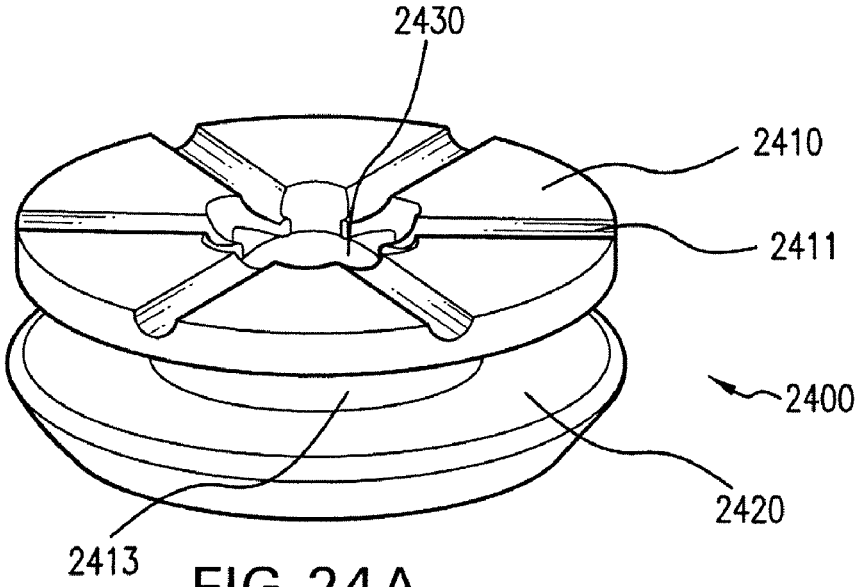
Figure 24B:
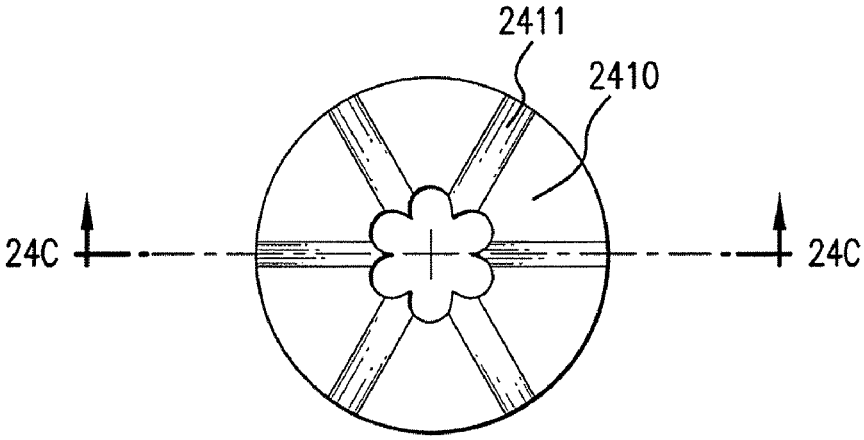
Figure 24C:
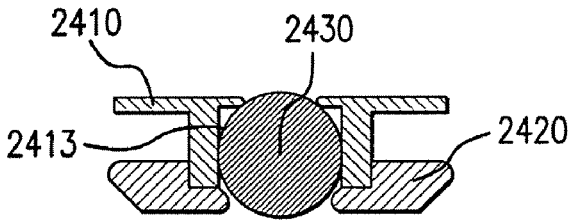

In practice, the ball valve need not travel as far as illustrated in FIGS. 23A and 23B. In the embodiment of FIGS. 24A-C, the ball 2430 is constrained fairly tightly between a sidewall 2413, top flange 2410 and bottom flange 2420. The top flange 2410 includes troughs 2411 to guide liquid into the valve 2400. To aide assembly, this embodiment, as with others, includes three parts to facilitate assembly into an aperture formed in a tray. The top flange 2410 and bottom flange 2420 hold the valve assembly to the tray. The bottom flange is preferably a separate part from the top flange 2410 and sidewall 2413, attached thereto by any suitable means, such as by a screw-type connection, an adhesive or by a bonding process.

Figure 25A:
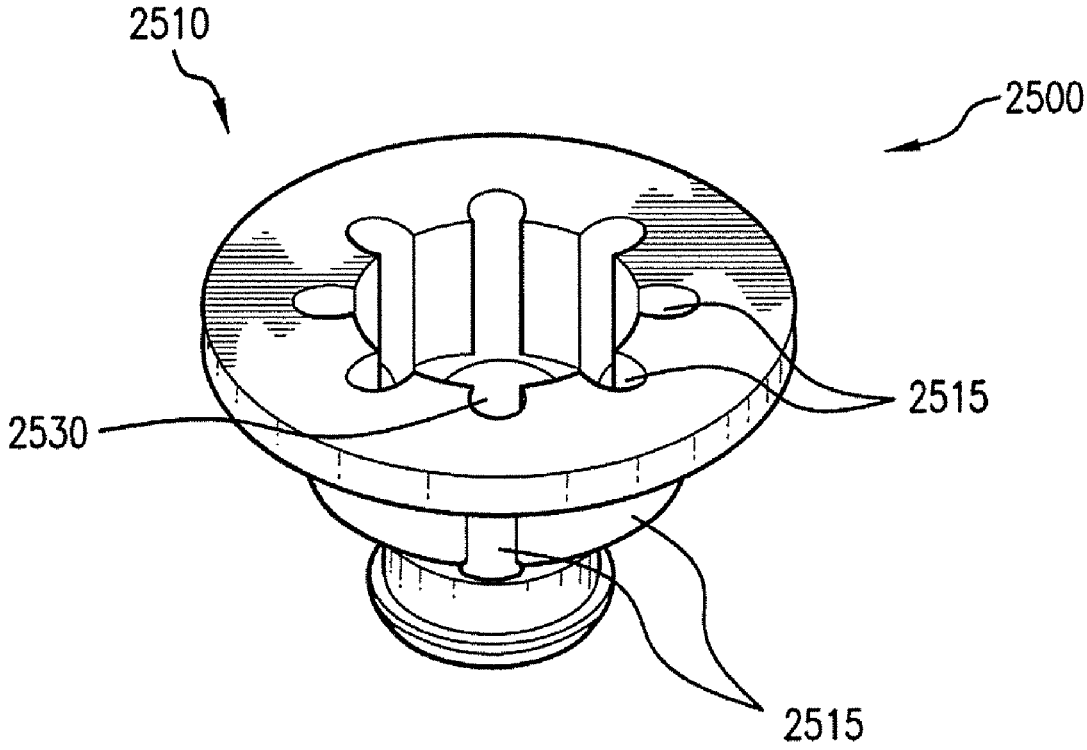
Figure 25B:
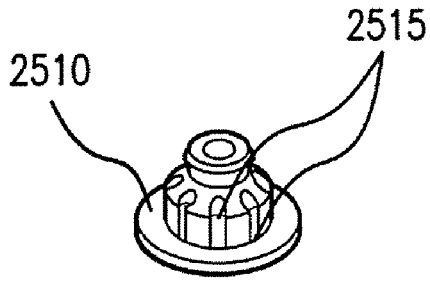
Figure 26D:
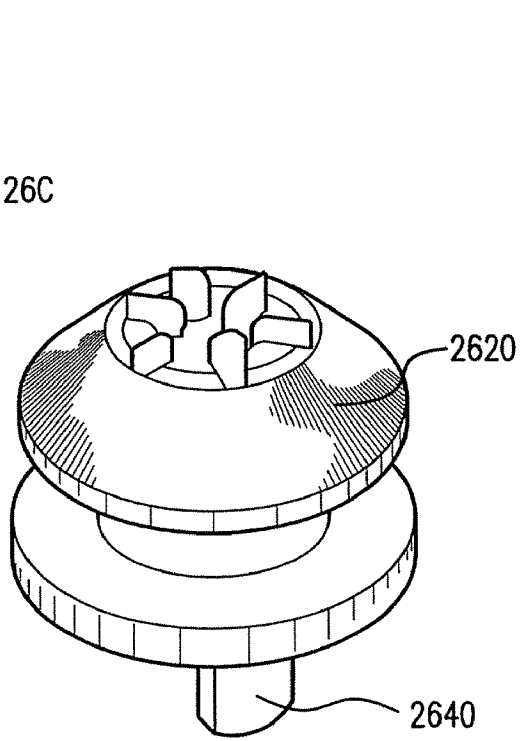
Figure 26B:
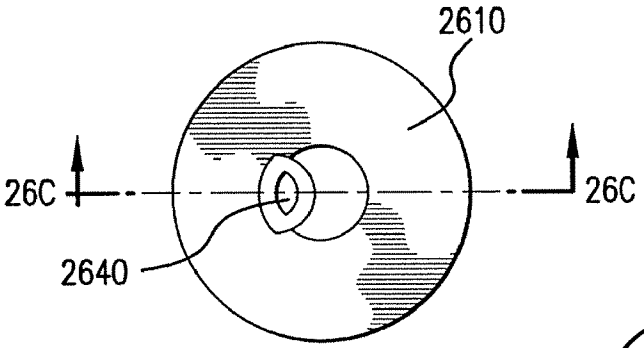
Figure 26C:
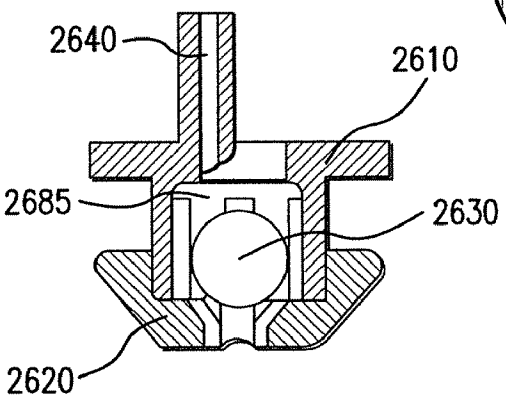
Figure 26A:
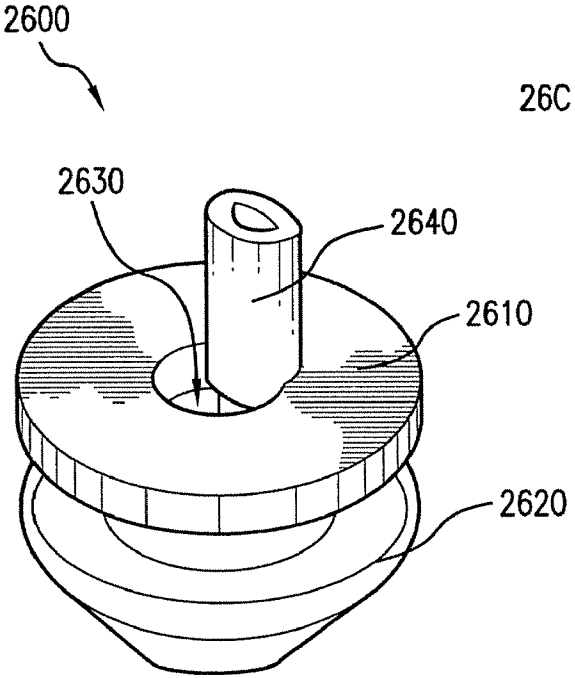
Figure 27A:
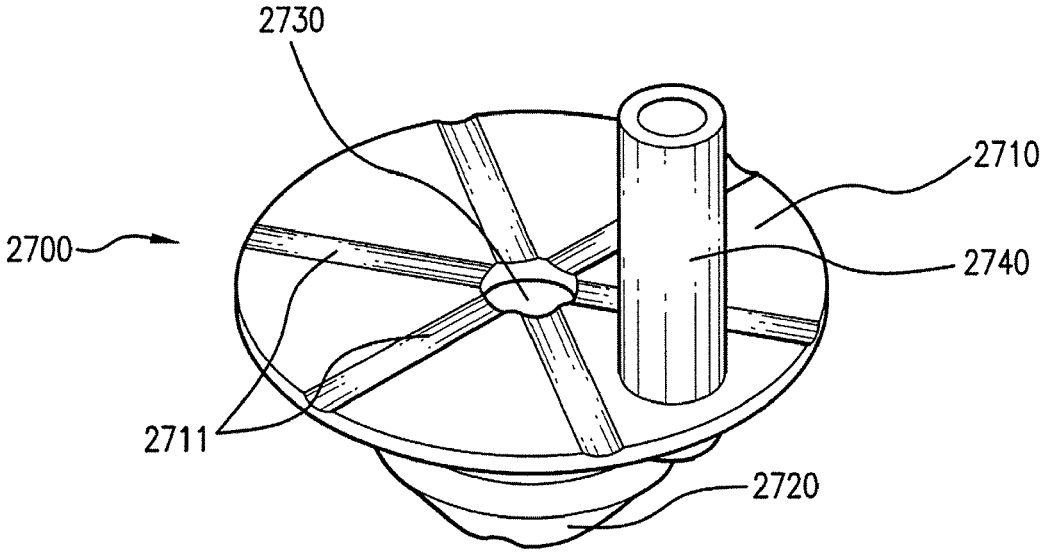
Figure 27B:
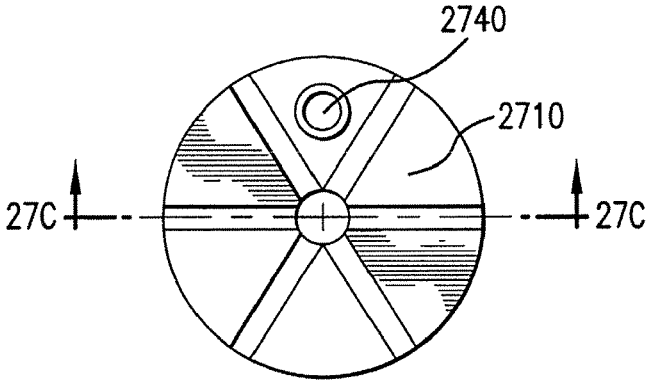
Figure 27C:
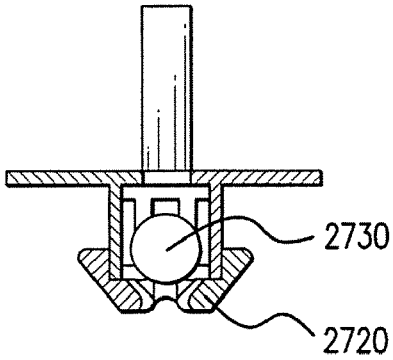
Figure 27D:
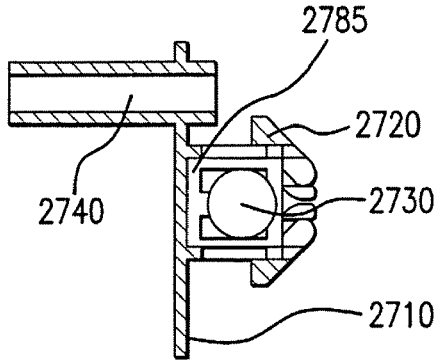

The embodiment of ball valve 2500 of FIGS. 25A-B includes a top flange 2510, a ball 2530 and drain passages 2515. Though a bottom flange is not illustrated, one can be applied, or the valve 2500 can simply be inserted into a wall of a tray and secured thereto.

FIGS. 26A-D and 27A-C illustrate valves 2600 and 2700 having integral vents to allow air and other gasses to escape the reservoir while liquid enters. This is beneficial if space in the pocket surrounding the ball (e.g., space 2385) is not provided to allow gasses to escape as liquid enters. As with the above embodiments, an upper flange 2610, 2710 and lower flange 2620, 2710 are provided, as are balls 2630, 2730. The vents 2640, 2740, however are arranged in different locations relative to the ball valve. In valve 2600, the vent 2640 is in fluid communication with the space 2685 surrounding the ball 2630. In valve 2700, the vent 2740 is arranged near an outer edge of the upper flange 2710, and is in fluid communication with a reservoir, separately from the space 2785 surrounding the mall 2730.

Figure 28:
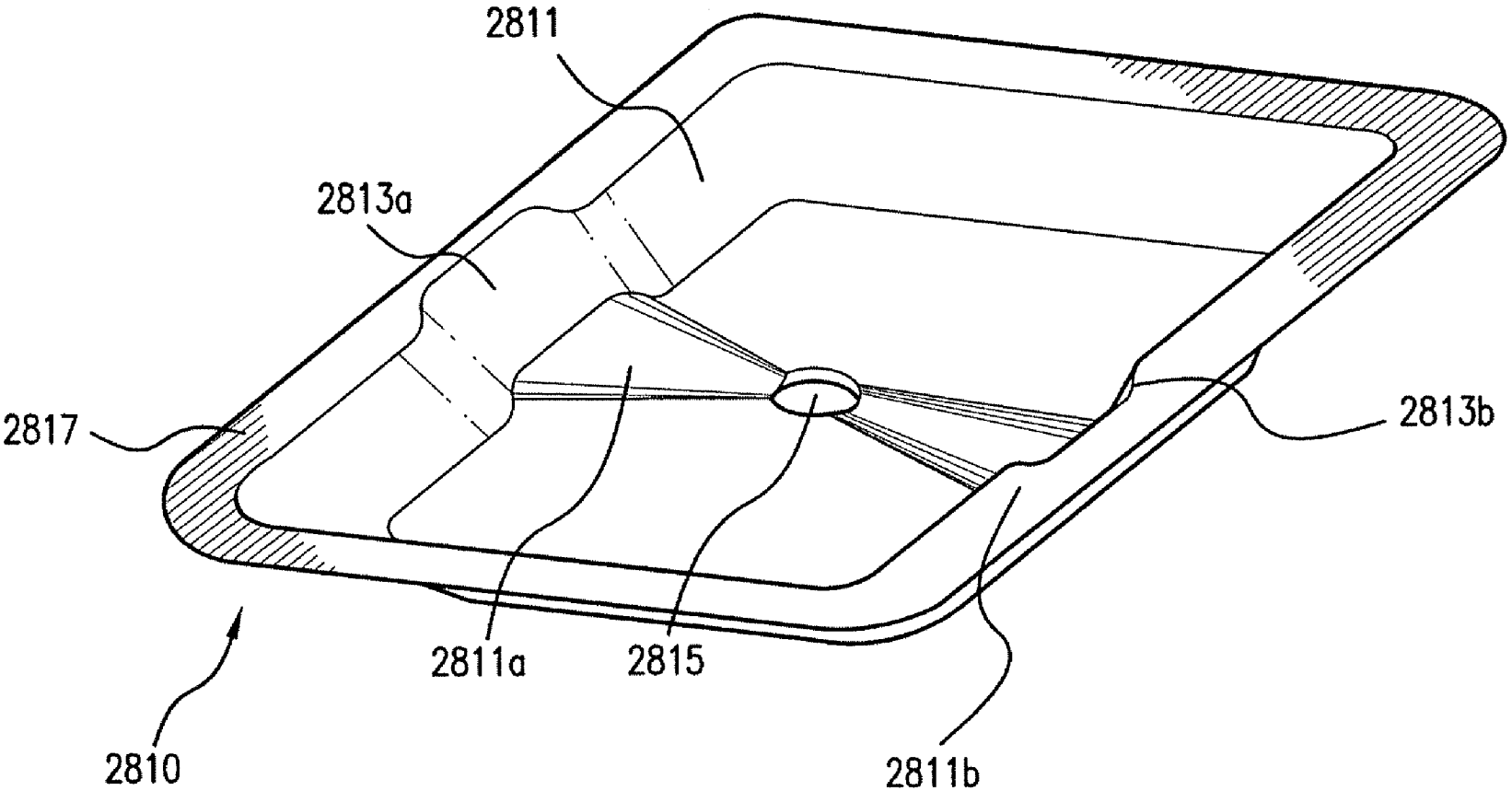
FIG. 28 illustrates an alternate embodiment of an inner tray for use with a container having an internal reservoir, in accordance with the invention, wherein the upper tray is provided with drain elements to guide exuded liquid from an upper surface of packaged contents.

FIG. 28 illustrates another embodiment of a second, or upper tray 2810 having drain recesses 2813*a* and 2813*b* in sidewalls 2811 thereof to allow liquid on top of the contents of the container to drain to the reservoir. Though illustrated in opposing sidewalls, only one drain recess 2813*a* may be sufficient. Alternatively, more than two drain recesses can be provided if desired. As illustrated, the drain recess 2813*a,b* are associated with floor channels 2811*a,b*, which lead exuded liquid to the drain aperture 2815. The features of this embodiment, as with other embodiments, can be combined with the features of any other embodiment. For example, the surface features 117 of FIG. 1 can be utilized. Each drain recess 2813*a,b* intersects the tray flange 2817 at its upper end. The flange 2817 therefore can be made wider than otherwise required, to accommodate the drain recess 2813*a,b*. This provides the necessary rigidity to the container, and also allows attachment of a bottom tray and a lid, if desired, as well as handling of the container by a consumer.

Figure 53:
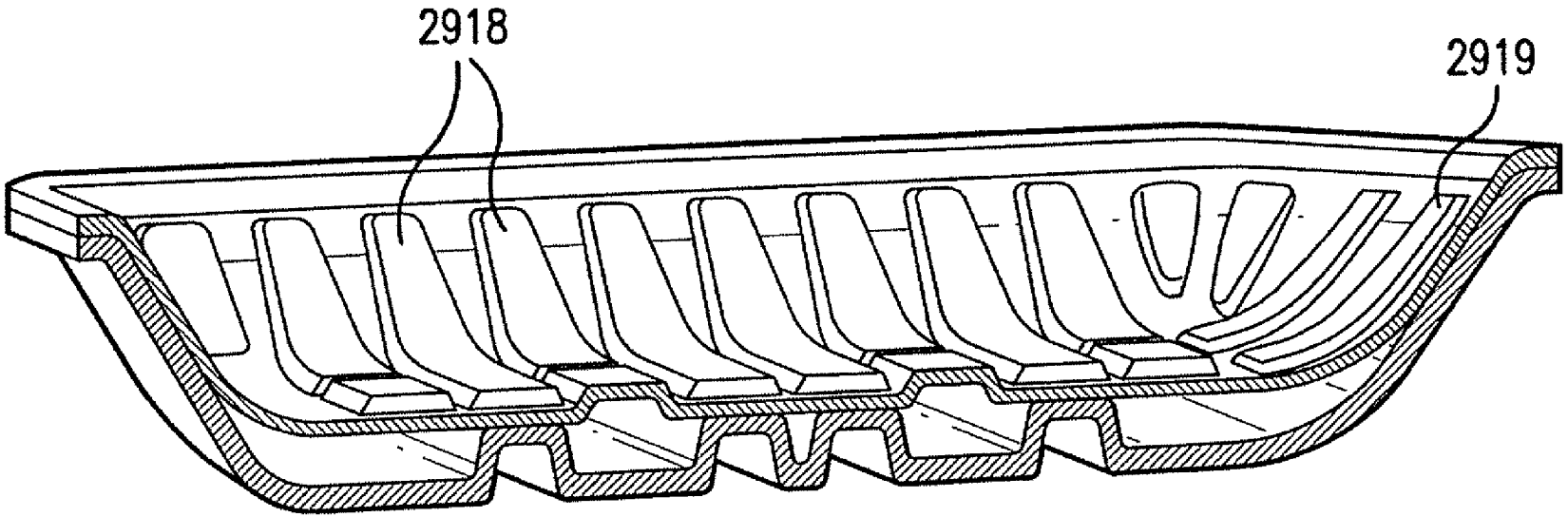
FIG. 53 illustrates an embodiment of a container having an internal reservoir, in accordance with another aspect of the invention, where strengthening surface features extend up the sidewall to a height below the flange.

FIGS. 29-31 and 32A-C illustrate one preferred embodiment of a container in accordance with the present invention. As can be seen, a first tray 2920 and a second tray 2910 are joined along interface 2925 by way of respective flanges 2922, 2912. While heat sealing techniques are preferred for this purpose, adhesive, cohesive, lip rolling, mechanical crimping, ultrasonic welding, vibration welding, chemical bonding, mechanical snap fitting and induction welding, or combinations thereof can also be used to join the first and second trays. The second tray 2910 includes a plurality of raised surface features 2917, similar to other embodiments, but also includes surface features 2918 and 2919 that extend from the surface 2913 of the bottom wall 2936 of the second tray and continue up the sidewalls 2921 of the second tray. The portion of the latter type of raised surface features 2918, 2919 that extends up the sidewalls 2911 create channels 2929 therebetween that allow liquid to escape from the top of packaged contents and reach the aperture 2915 and reservoir 3030. The surface features 2918 and 2919 further serve to rigidify the sidewalls 2911 and the container 2900 as a whole, and as described above serve to prevent excessive fluid motion within the reservoir 3030, in combination with corresponding surface features 2928 of the first tray 2920. In a preferred embodiment, the surface features 2918 and 2919 extend only partially up the sidewall to terminate at a position below the interface of the flanges of the first and second tray, as illustrated in FIG. 53. Such a configuration enhances the sidewall structural integrity and provides improved crush strength characteristics.

Figure 29:
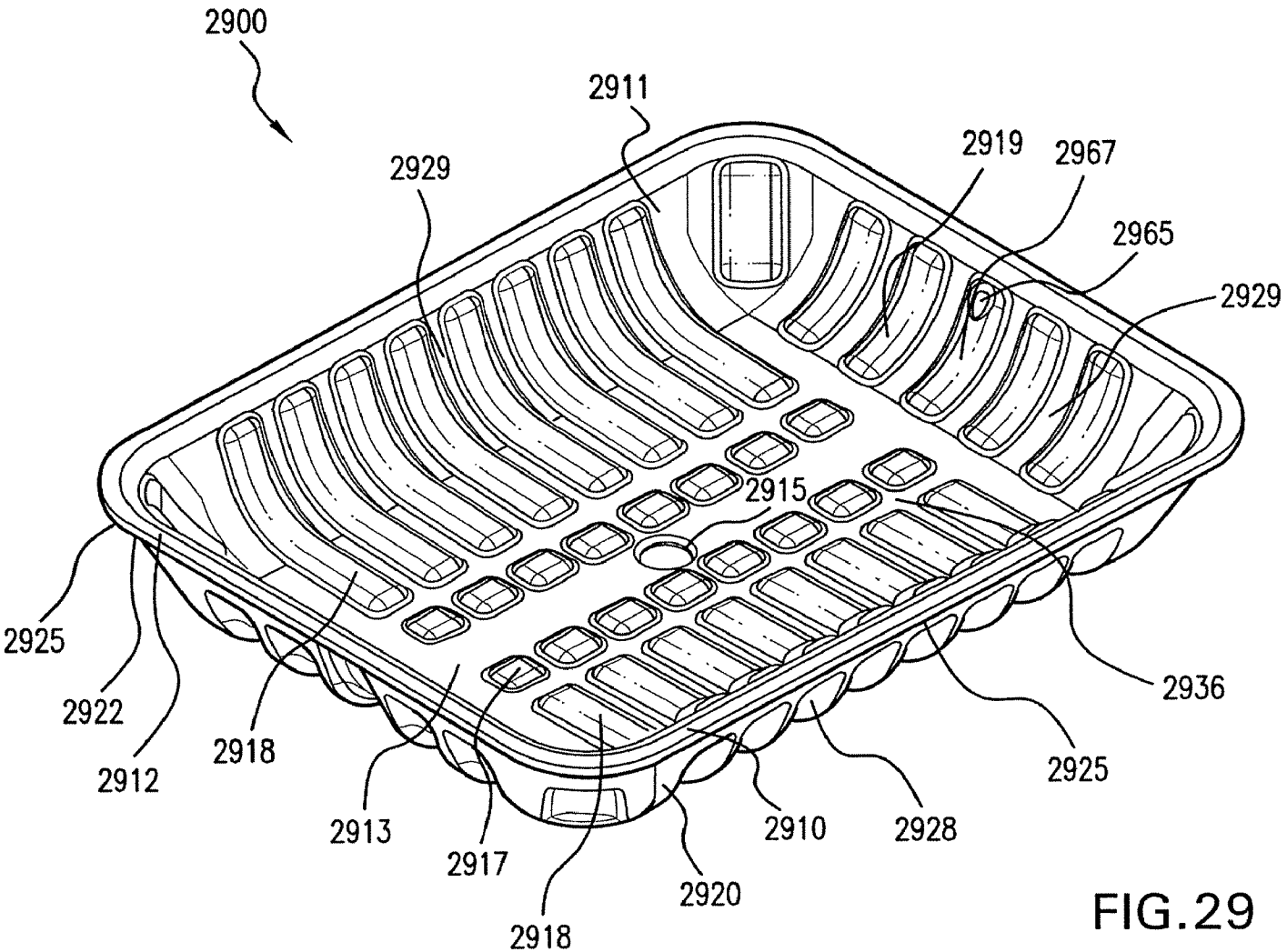
FIGS. 29-31 and 32A-C illustrate one preferred embodiment of a container having an internal reservoir, in accordance with another aspect of the invention.

Furthermore, the embodiment of FIG. 29 and the related figures includes a venting arrangement that terminates at one end at venting aperture 2965. The middle raised surface feature 2967, which is otherwise similar to the other raised surface features 2919, acts as a vent channel or chamber. The vent channel is defined between a lower surface of the second tray 2910 and another element, which may be the upper surface of the first tray 2920 or alternatively an additional member, such as an adhesive label or the like, as described above in connection with FIG. 14*b*.

Figure 30:
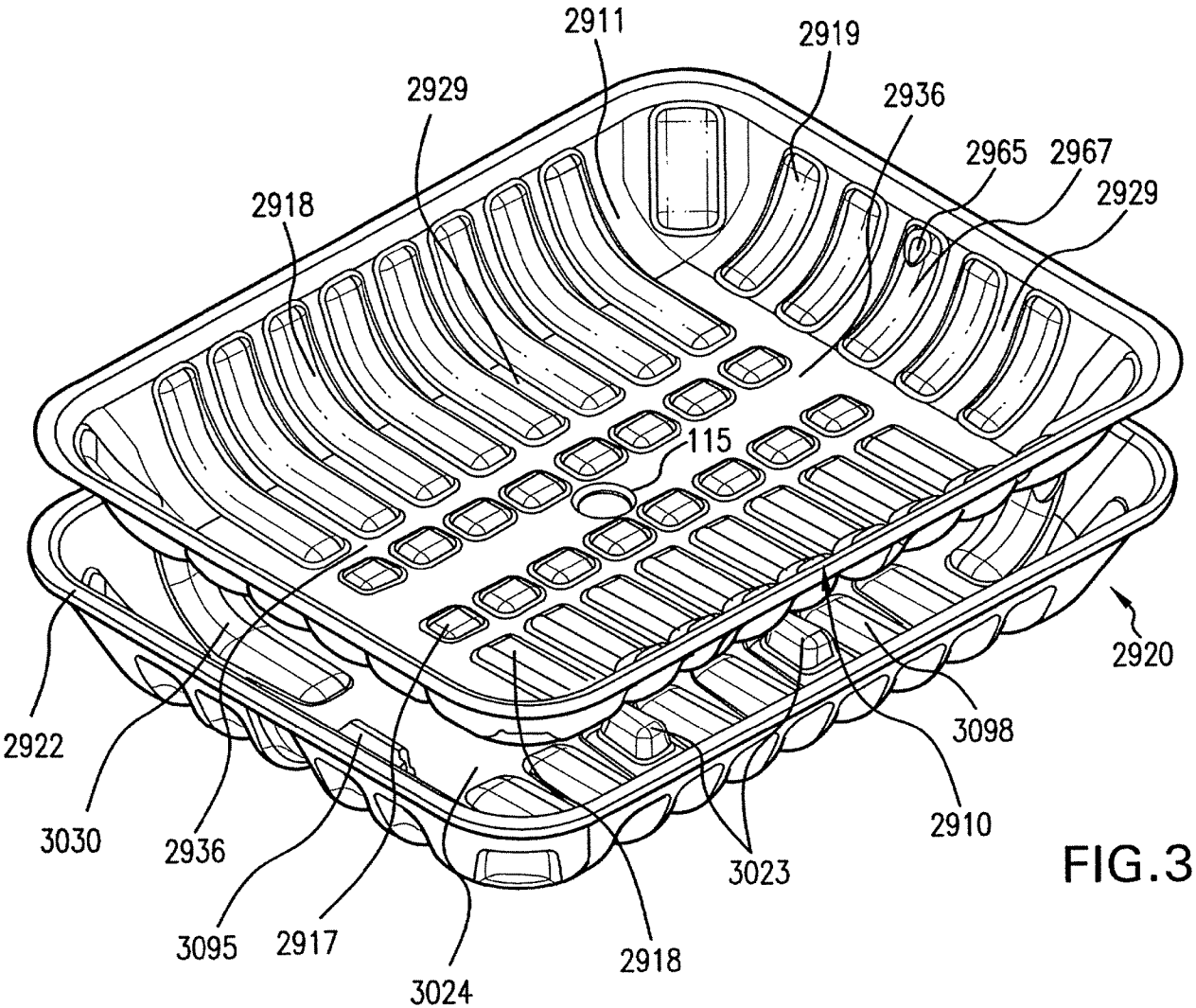
Figure 32A:
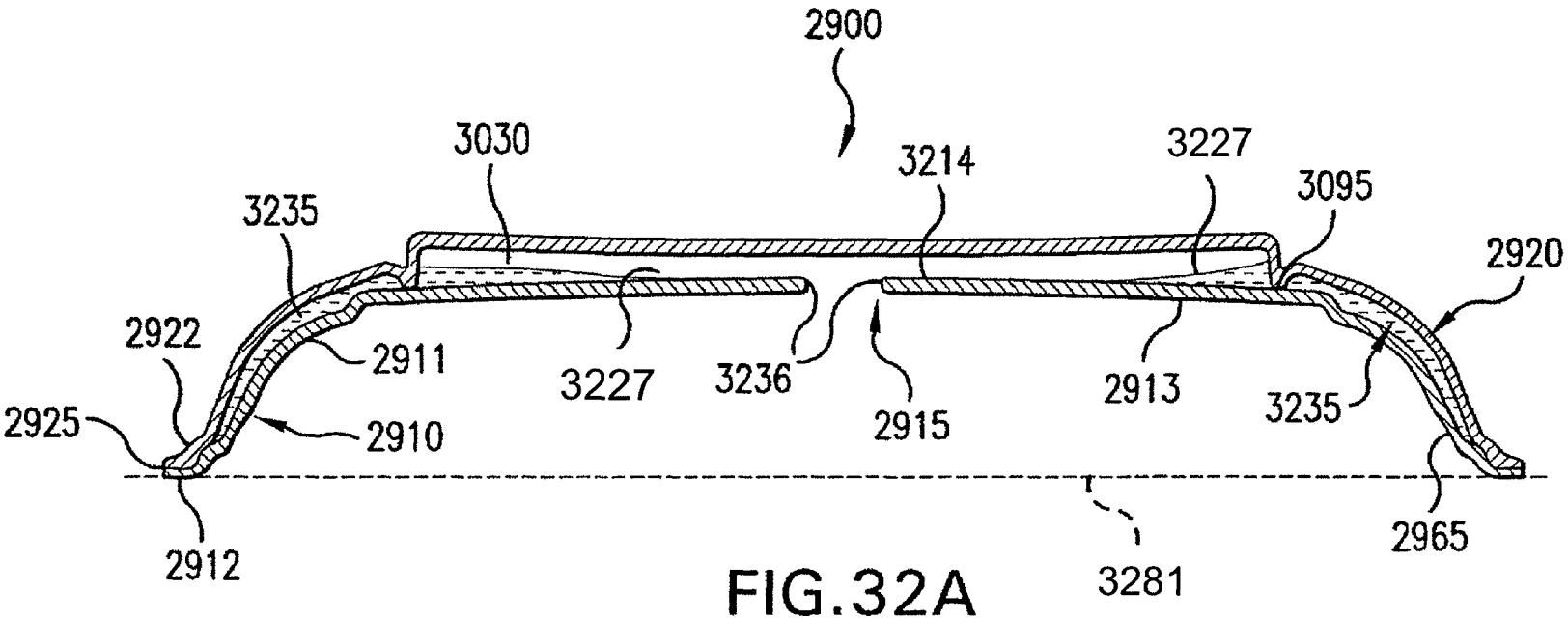

As can better be seen in FIG. 30, the reservoir 3030 is formed between the first and second trays 2920, 2910. Supporting elements 3023 in the first tray 2920 support the second tray 2910, and prevent the weight of contents in the tray from excessively deforming the tray 2910 and thus prevent a change of storage volume of the reservoir 3030. The second tray 2910 in this and any other embodiment can be of less thickness than the first tray 2920. If the second tray 2910 is manufactured as such, material savings can be realized, but more importantly, a thinner cross section allows more radical or abrupt geometry of the tray, specifically, of the raised surface features. As such, contents of the tray don't easily conform to the contours of the tray, and therefore, don't easily obstruct flow channels therebetween, as described below in connection with FIGS. 47 and 48. As also can be seen in FIG. 30, as well as in FIG. 43, raised surface features 3098, formed in the first tray 2920, correspond to surface features of the second tray, such as surface features 2918. These further rigidify the container 2900 as a whole, and prevent excessive movement of liquid contained in the reservoir 3030. Moreover, these corresponding surface features facilitate stacking of the containers 2900 with one another and save space when the containers are stacked for storage and transport. As can be seen in FIGS. 30 and 32A, for example, the surface features in the sidewalls of the first container 2920 can form a support 3095 for the second container 2910.

Figure 31:
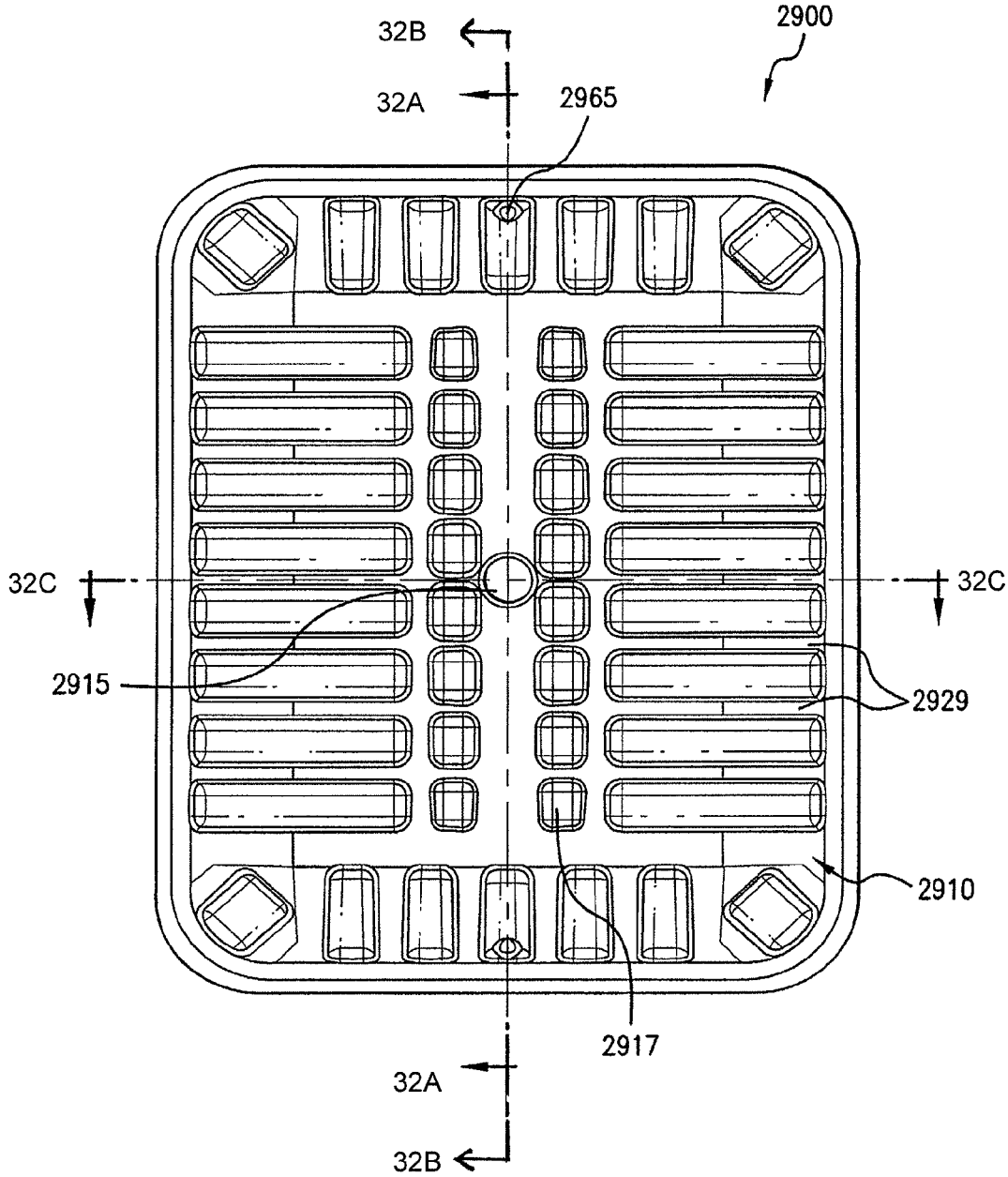

FIG. 32A illustrates a schematic cross-section of the container 2900 cut along line 32A-32A of FIG. 31, illustrated with liquid 3227 in the reservoir 3030, and with the surface of the top flange 2912 resting on a ground plane 3281. As can be seen, the liquid 3227 fills sidewall reservoir chambers 3235, and the sloping inside face 3214 of the bottom wall of the second tray 2910 encourages flow of the liquid 3227 away from the aperture 2915. Moreover, a lip, which is optionally provided on the underside of the bottom wall of the second tray 2910, surrounding the drain aperture 2915, provides a further encumbrance to liquid in the reservoir 3330 that might otherwise reach and exit through the aperture 2915.

Figure 32B:
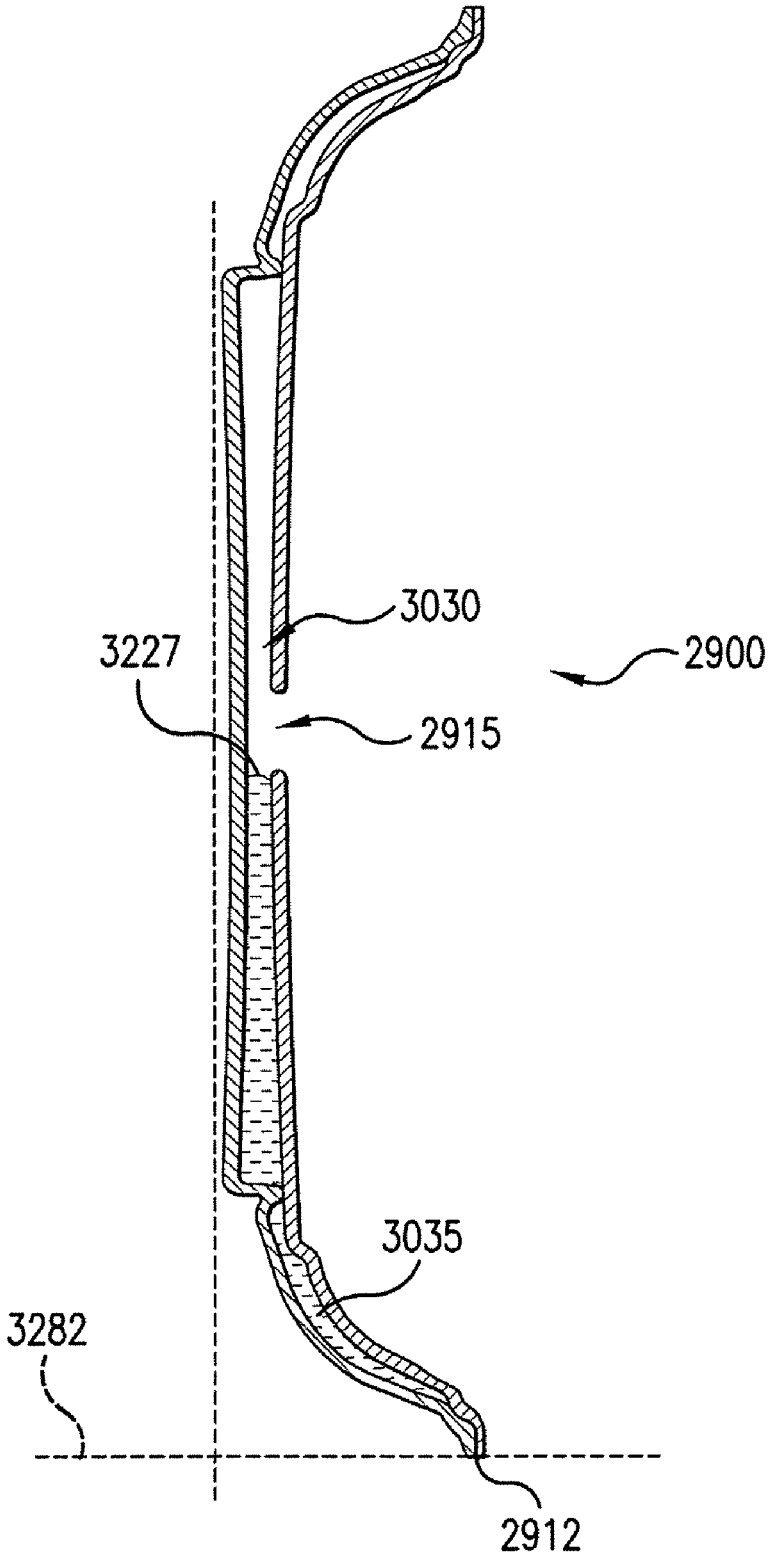

FIG. 32B shows a schematic cross-section of the container 2900 cut along line 32B-32B of FIG. 31, and also illustrates liquid 3227 in the reservoir 3030, with one edge of the top flange 2912 resting on a ground plane 3282. Accordingly, the liquid 3237, due to gravity, collects in what has become in this orientation the lower end of the reservoir 3030. The ultimate storage volume in this or any other position is, of course, limited by the position of the aperture(s) 2915. The storage volume provided between the sidewalls of the first and second trays, by the reservoir chambers 3035, is particularly advantageous in this orientation, as can be seen.

Figure 32C:
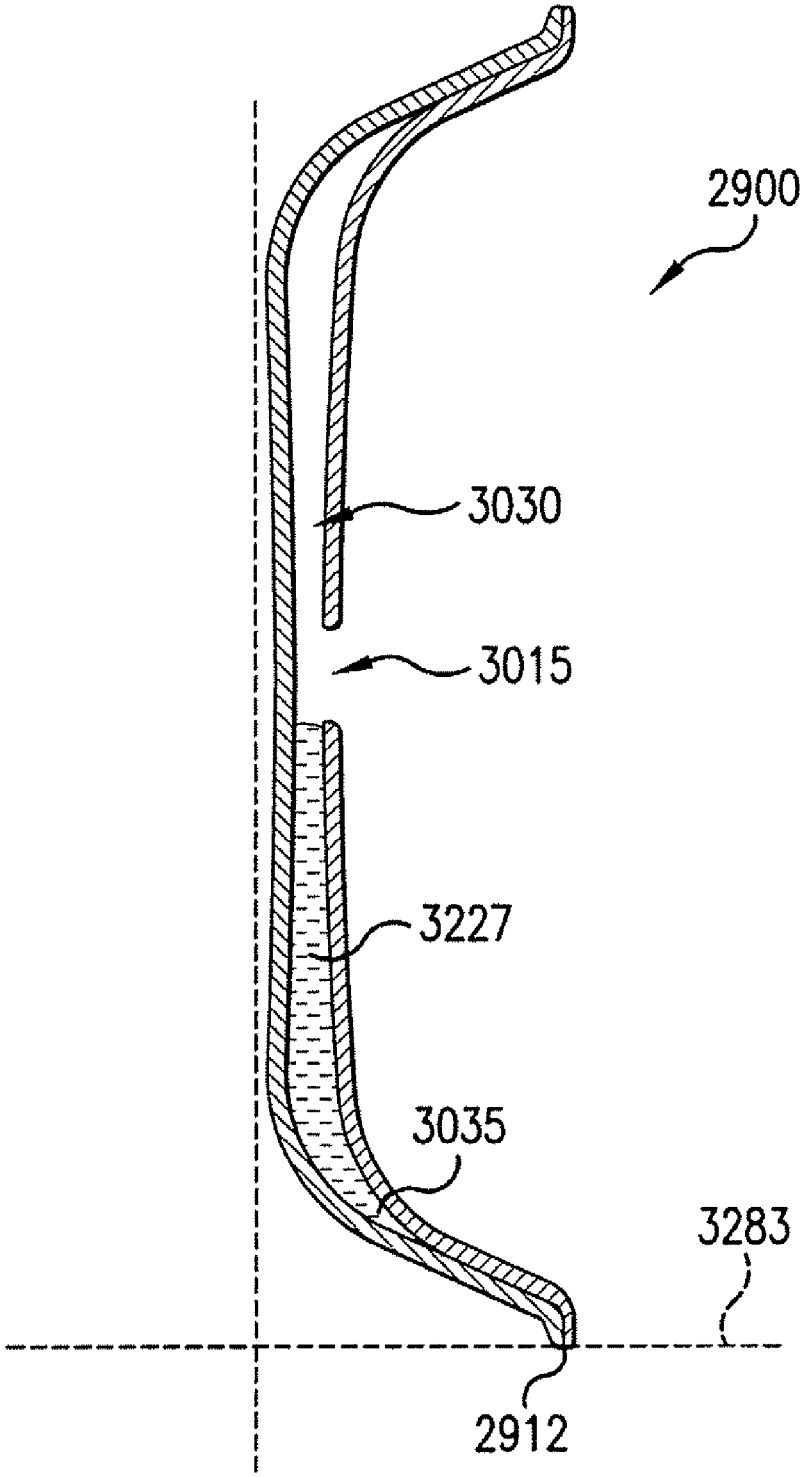

Similarly, FIG. 32C illustrates a schematic cross-section of the container 2900 cut along line 32C-32C of FIG. 31, and also illustrates liquid 3227 in the reservoir 3030, with one edge of the side flange 2912 resting on a ground plane 3283. The reservoir chamber 3035 defined by the sidewalls of the first and second tray is substantially similar to that illustrated in FIG. 23B, but since the view has been taken across a channel 2929 of the second tray 2910 (See FIG. 31), the chamber 3250 appears to be smaller in this Figure, when it is merely a reduced width portion of the sidewall chamber 3035.

FIGS. 33-41, 42A-D and 43-46 illustrate yet another embodiment of a container 3300 in accordance with the present invention, and variations thereof. In this embodiment, raised surface features 3317 are distributed at regular intervals across the bottom wall 3313 of the second tray 3310 of the container 3300. Similarly to the container 2900 of FIG. 29, some raised surface features 2218, 2219 extend up the sidewalls 3311 of the second tray 3310. The first tray 3320 is attached to the second tray 3310 by respective flanges 3312, 3322 at a common interface 3325. Any sealing method described herein, such as adhesive, crimping or rolling can be used.

Figure 33:
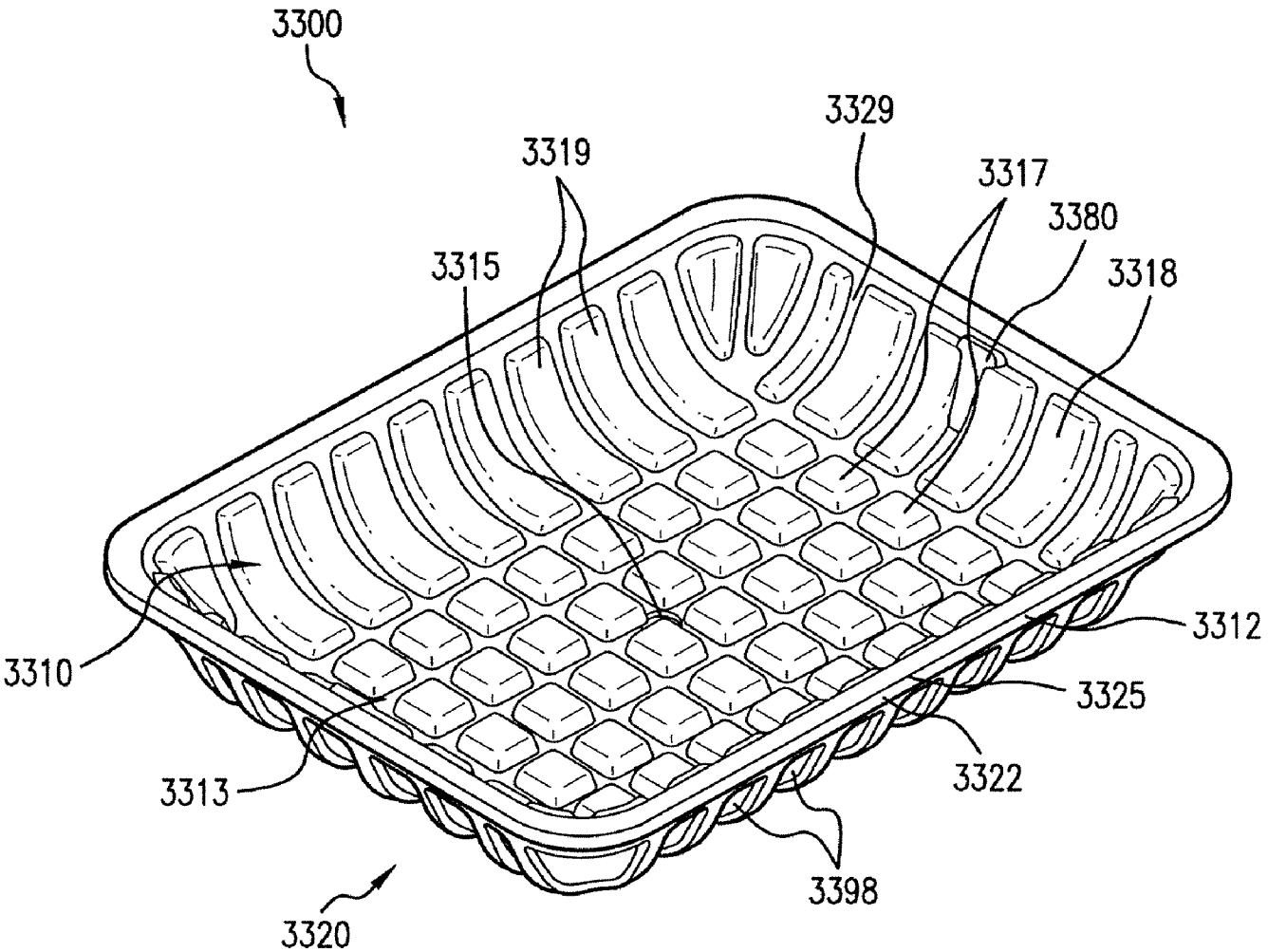
FIGS. 33-41, 42A-D and 43-46 illustrate alternate embodiments of a container having an internal reservoir, in accordance with the invention.
Figure 34:
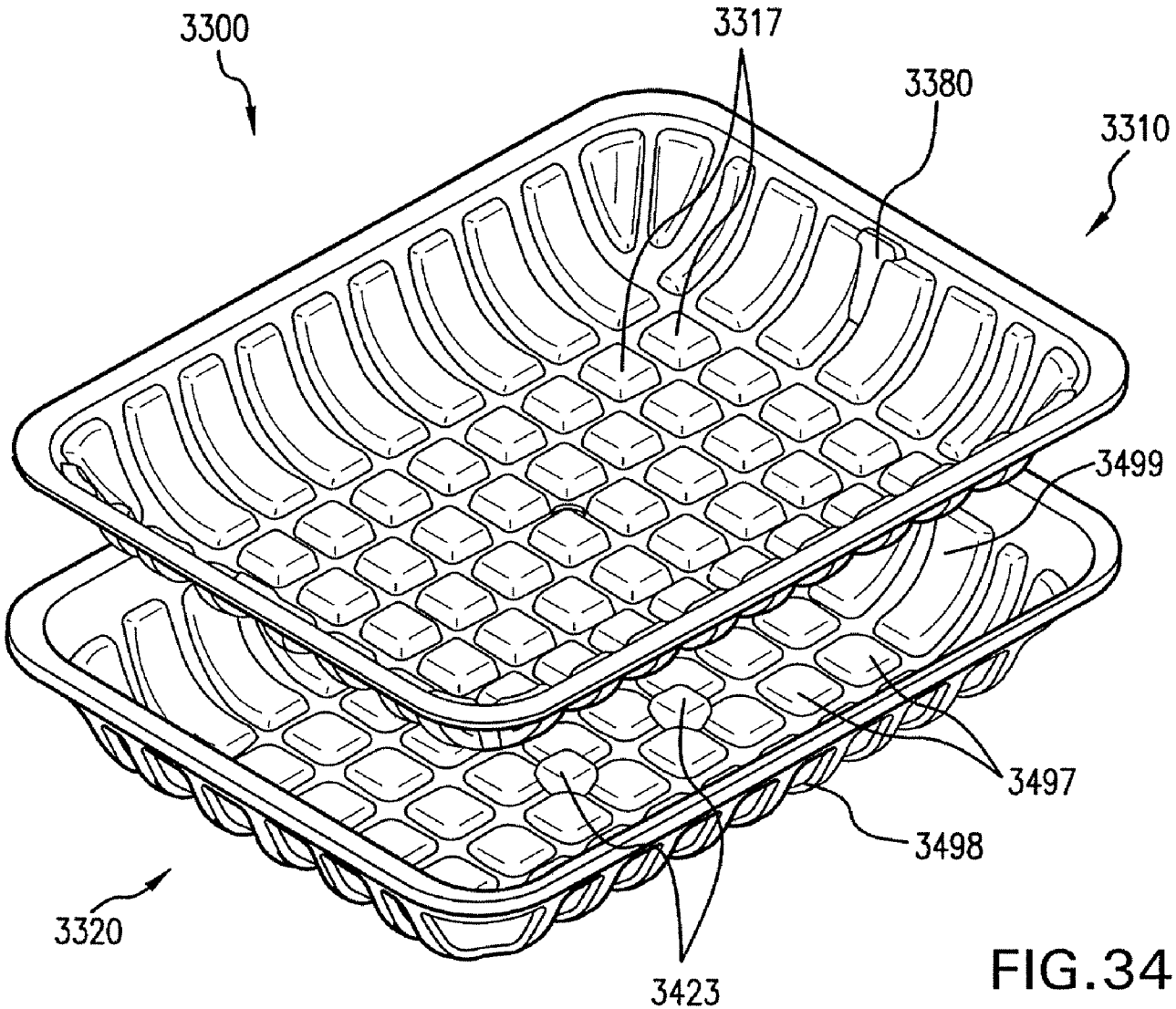
Figure 36:
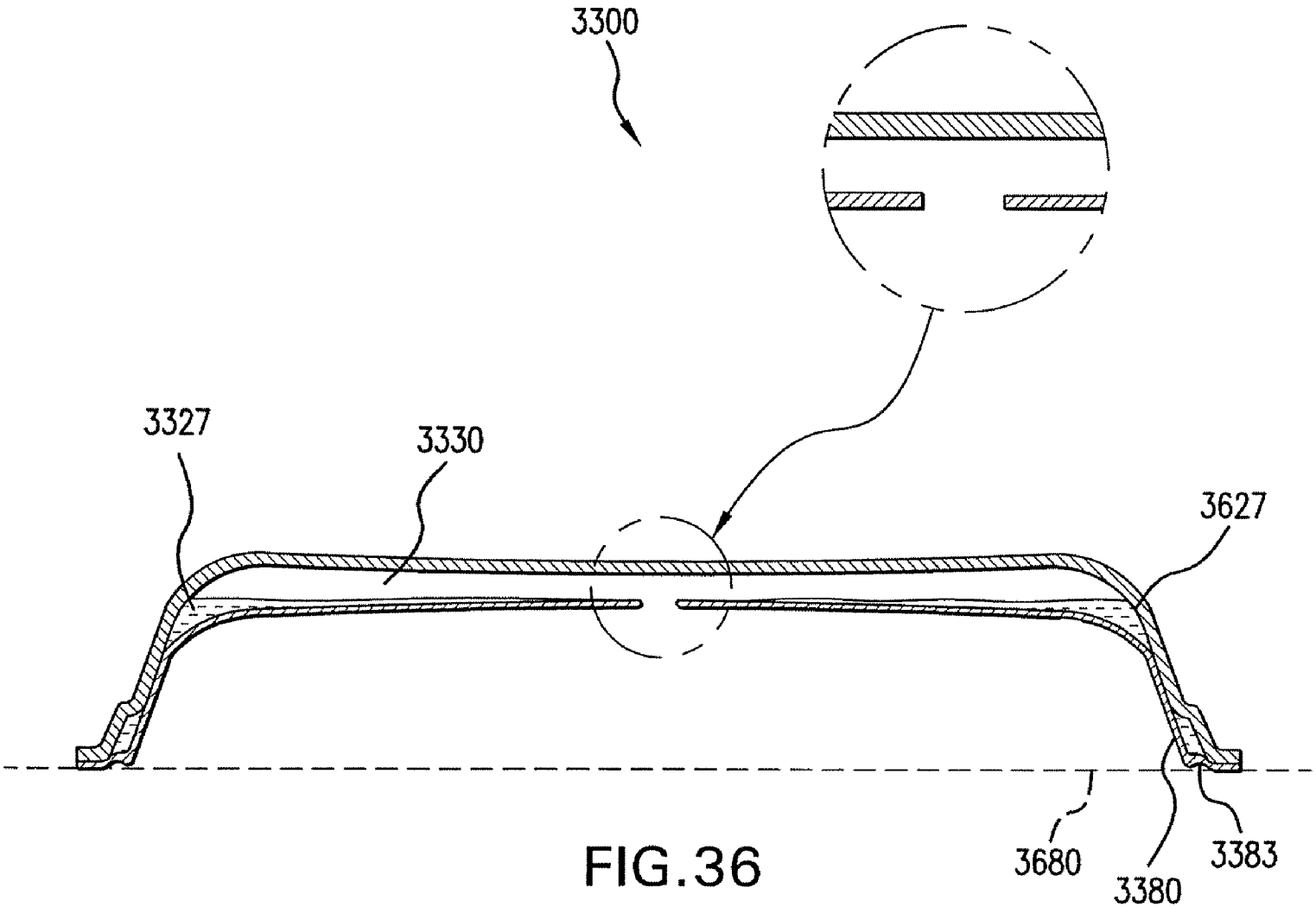
Figure 37:
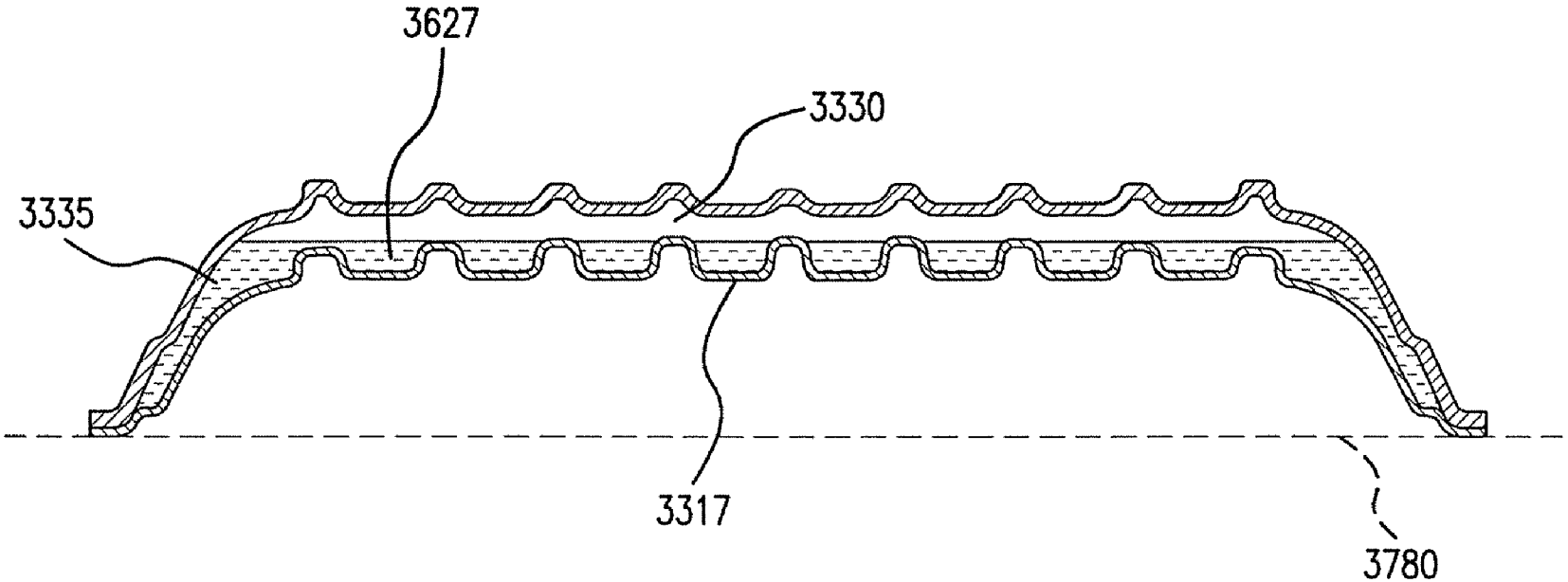
Figure 38:
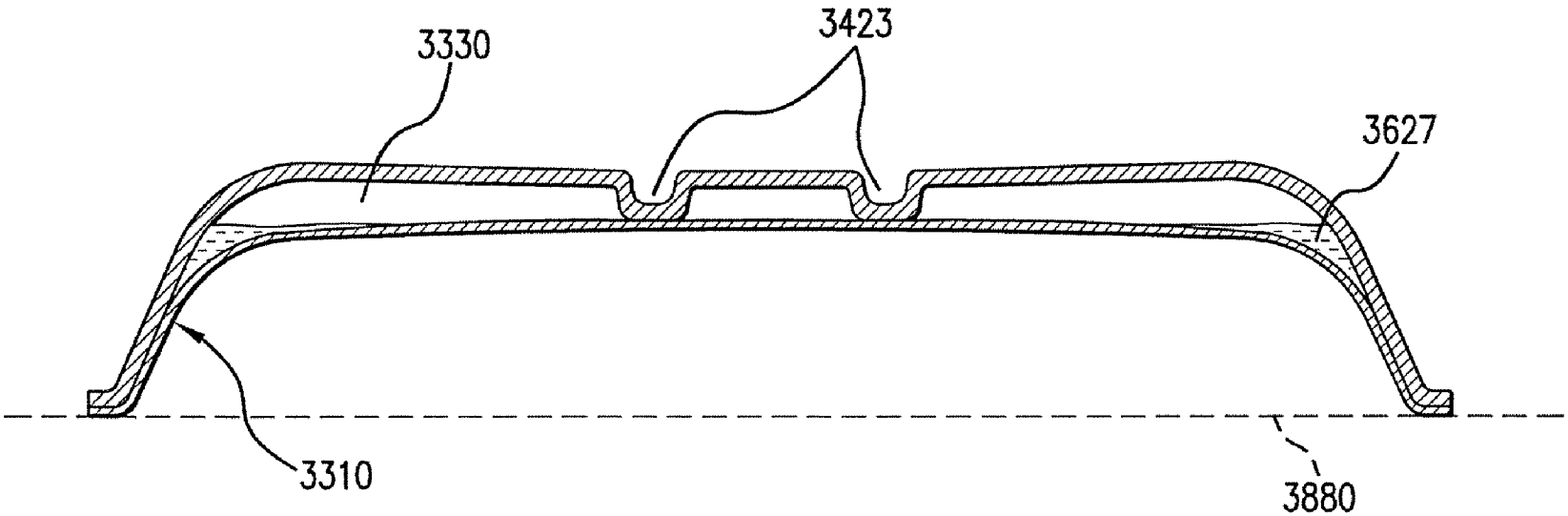
Figure 39:
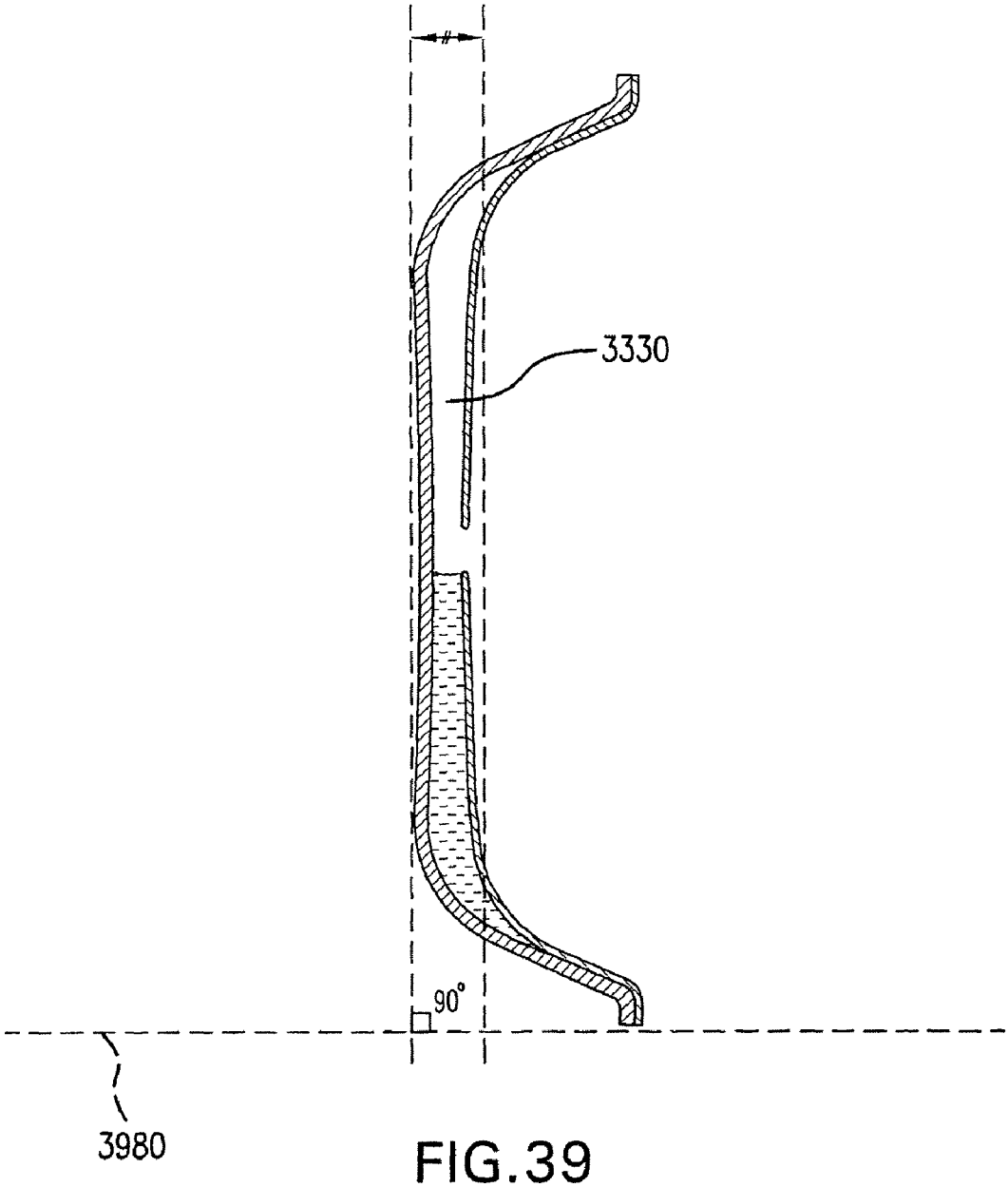
Figure 40:
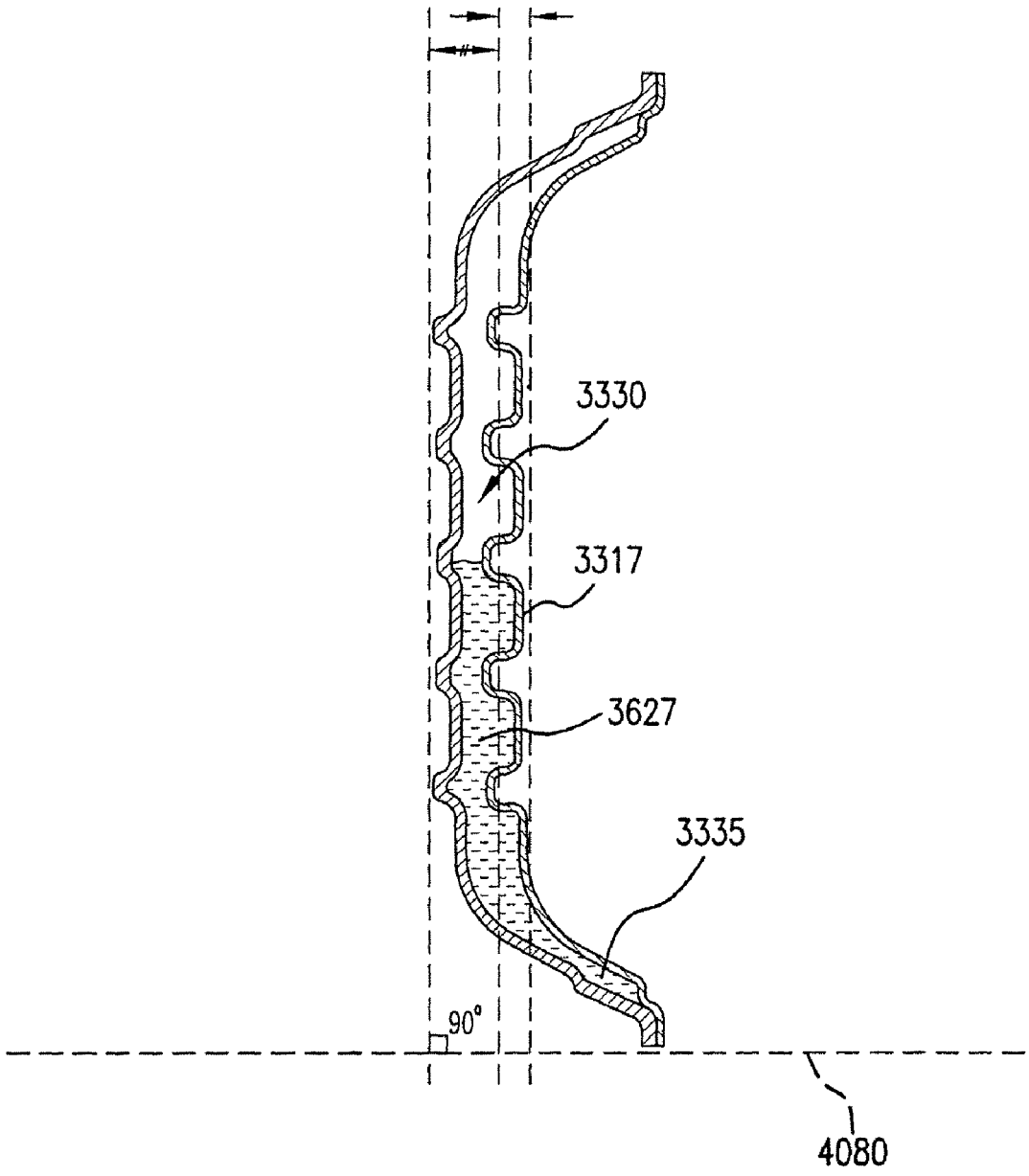
Figure 41:
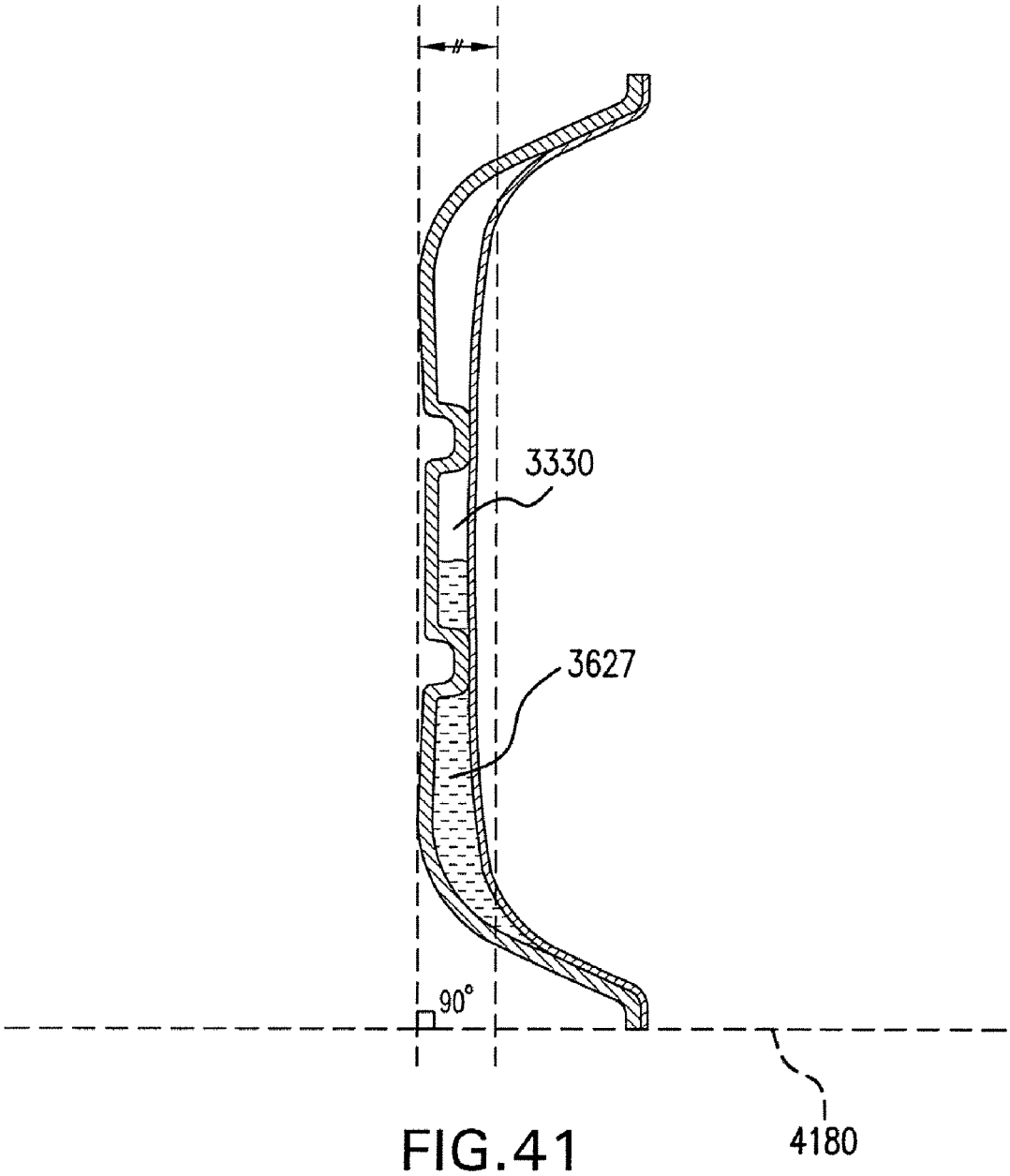

As seen in FIG. 34, a plurality of supports 3423 are provided in the first tray 3320 to support the second tray 3310. Though only two are illustrated in this embodiment, four are present, but any number of supports can be provided, depending on the desired strength of the container and volume of the reservoir. Raised surface features 3497, 3498 and 3499 are also provided for the reasons set forth above in connection with similar elements of the container 2900 of FIG. 29. As can be seen in FIGS. 33, 34 and 36, for example, a protrusion 3380 is provided in which a vent aperture can be formed. As best seen in FIG. 36, the vent aperture can be formed in a recess 3383 in the protrusion 3380. As such, any lid material or overwrap used on the tray will not block the aperture, and thus will not prevent air from escaping the reservoir.

Figure 35:
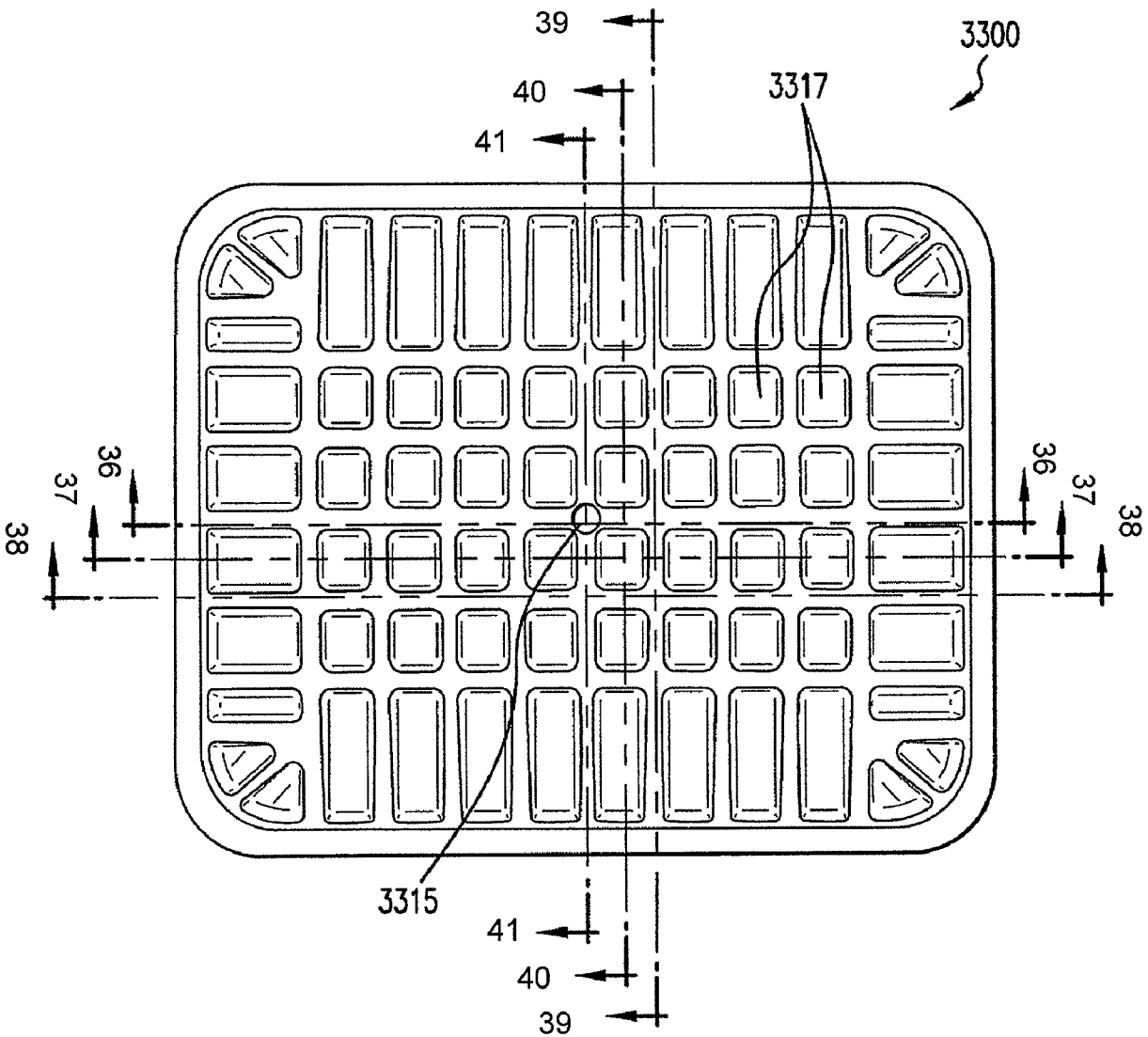

FIGS. 36-41 are schematic cross-sectional views of the container 3300 taken across lines 36-36 through 41-41 shown in FIG. 35, respectively. These schematic cross-sectional views are shown to illustrate the manner in which liquid 3327 in the reservoir 3330 is retained in the reservoir, even when the container 3300 is placed in different orientations relative to the ground plane (3680, 3780, 3880, 3980, 4080, 4180, respectively). The manner in which the liquid 3327 fills the available voids and chambers of the reservoir 3330 can be seen, as can the benefit to storage volume of having raised surface features such as surface features 3317 shown in FIGS. 37 and 40, for example.

Figure 42A:
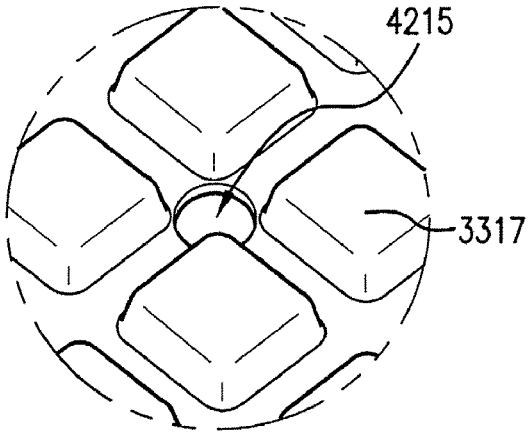
Figure 42B:
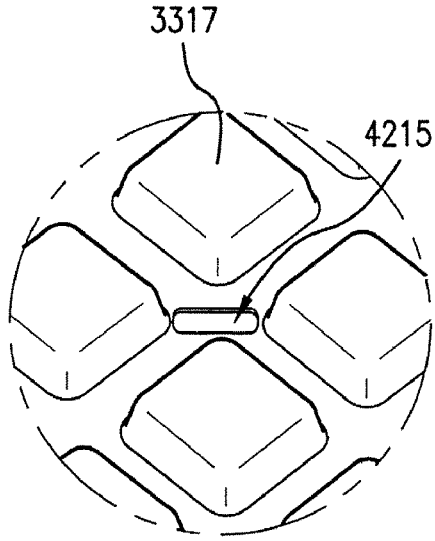
Figure 42C:
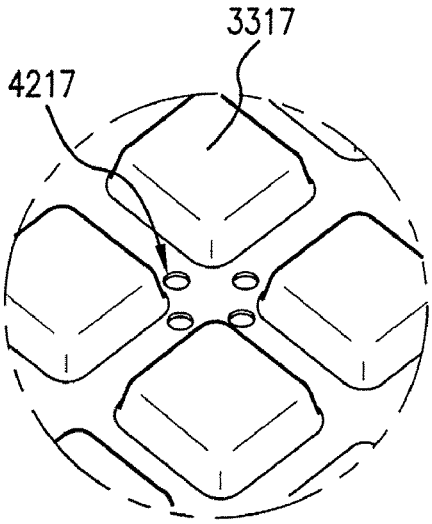
Figure 42D:
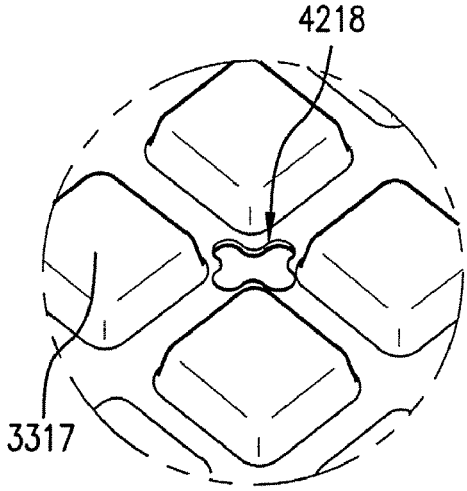

FIGS. 42A-D illustrate alternative shapes and configurations for drain aperture(s). As shown, the aperture can be circular 4215 or substantially rectangular 4216 as shown in FIGS. 42A and 42B, respectively. Alternatively, a plurality of apertures 4217 can be provided between raised surface features 3317. Other shapes, such as the rounded roughly X-shaped aperture 4218 illustrated in FIG. 42D for the aperture(s) are also possible.

Figure 43:
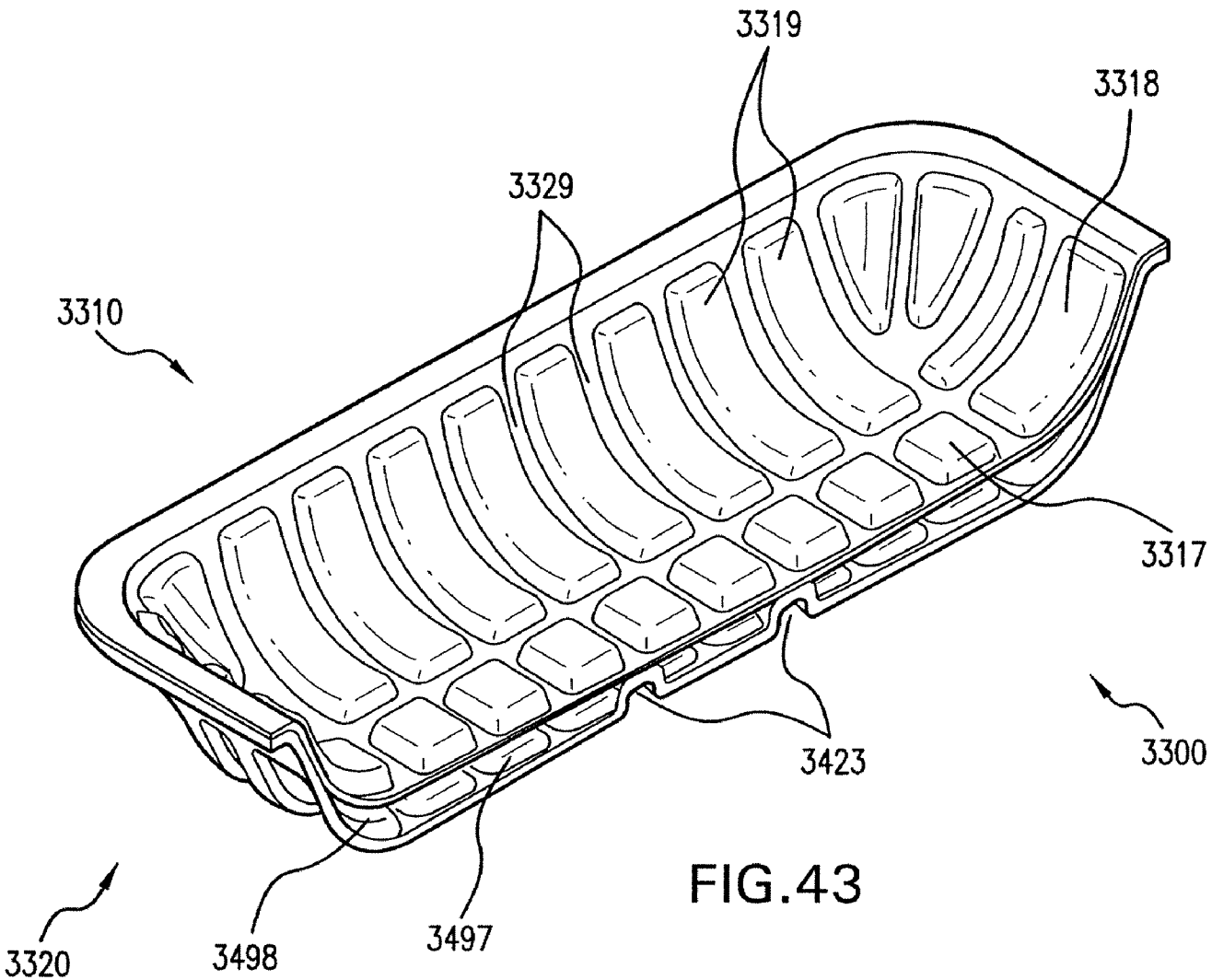

The cross-sectional view of FIG. 43 illustrates the manner in which the raised surface features (e.g., 3317, 3318, 3319) of the second tray 3310 correspond to raised surface features (e.g., 3497, 3498) of the first tray 3320. Supporting elements 3423, for supporting the second tray 3310, are also clearly seen in this figure.

The aperture(s) can be arranged near raised surface features 3317, or can be located a predetermined distance therefrom. Typically, however, the closer to the raised surface portion an aperture can be, the less likely it is that the aperture will become blocked by the contents of the container. Other steps can be taken to prevent blockage of the aperture(s) by the contents of the container, such as increasing surface feature height, providing more radical geometry to the surface features, and/or application of a member to raised surface features surrounding one or more apertures, as described in further detail below.

Figure 44:
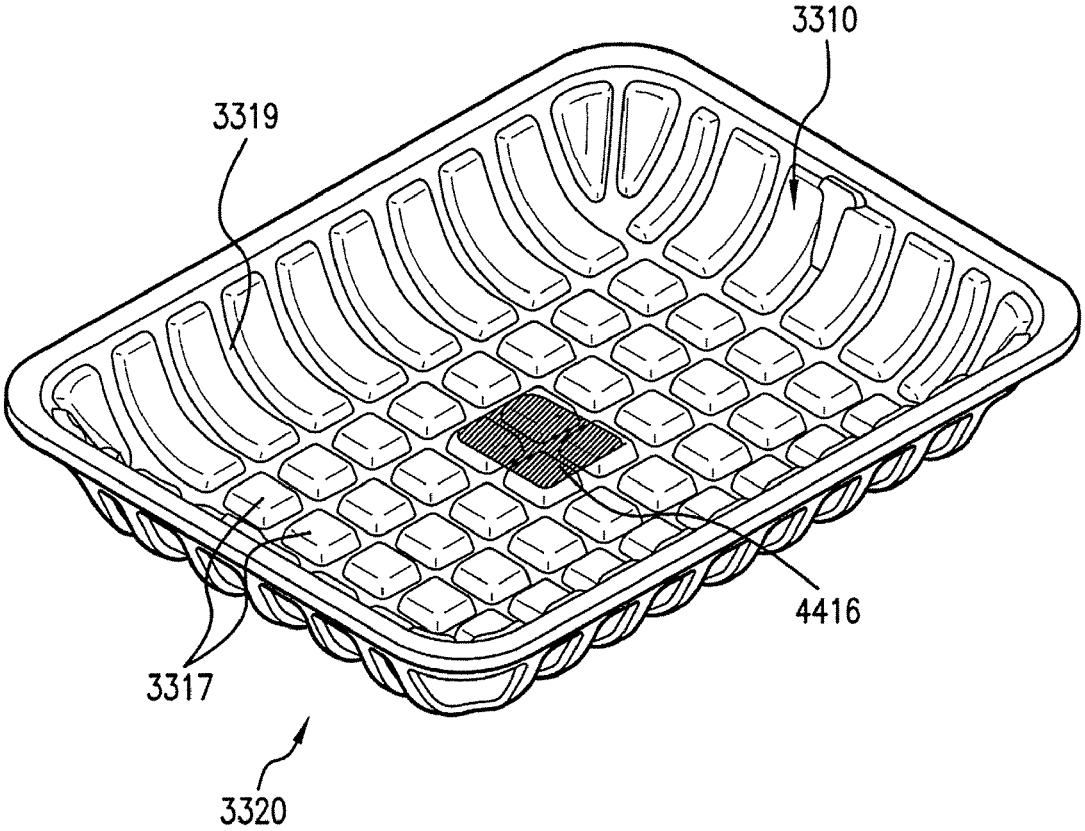

FIG. 44 illustrates a variation of the embodiment of FIG. 33, in which a protective member 4416 is applied over a region of the second tray 3310 above the drain aperture. This protective member 4416 prevents the contents of the tray from blocking the drain aperture of the container 3300, but still allows liquid to pass under the contents, through the aperture(s) and into the reservoir. The protective member 4416 can be relatively large or small, can cover one or multiple apertures in one or multiple areas, can be impermeable or permeable and can be made from any suitable material. Preferably, however, the protective member 4416 is made from the same material or a material that is compatible with that of the container itself in order to facilitate recycling. For example, a polystyrene sheet material can be used in conjunction with expanded polystyrene trays. The protective member 4416 can be perforated or made from a permeable material to allow liquids to pass therethrough, or can be substantially impermeable, only allowing liquids to pass under the member and into the reservoir. If desired, the protective member 4416 can cover essentially the entire bottom surface of the second tray 3310. As such, liquid can enter through channels 3319 along edges of the protective member, or through the protective member itself if it is permeable to liquid.

Figure 45:
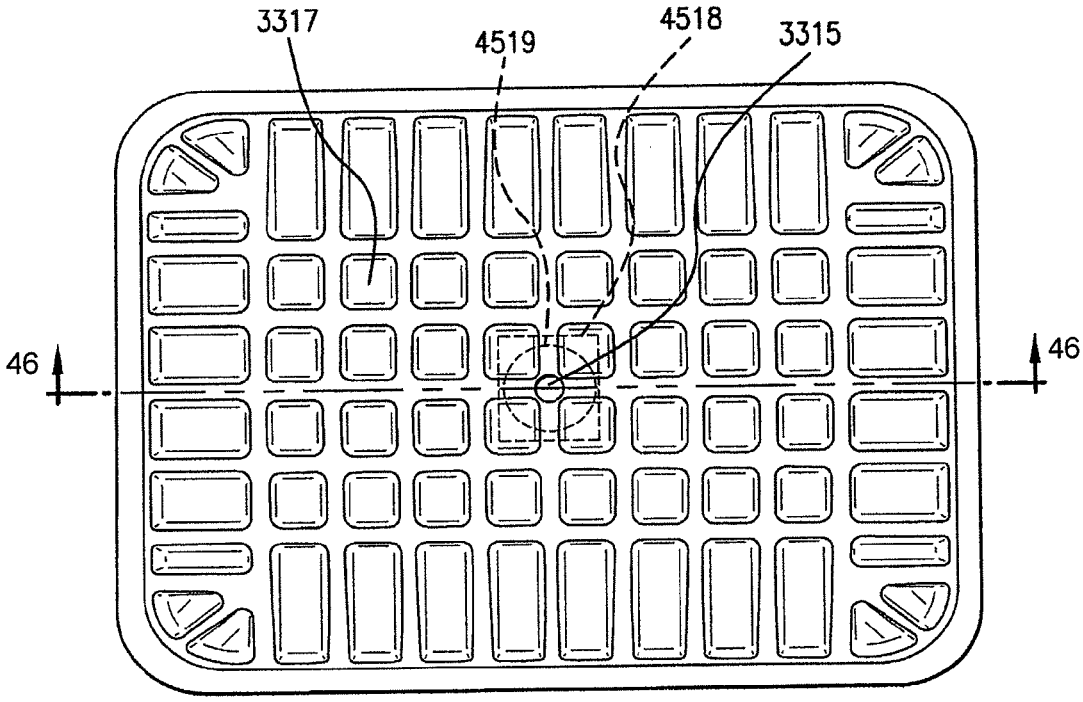
Figure 46:
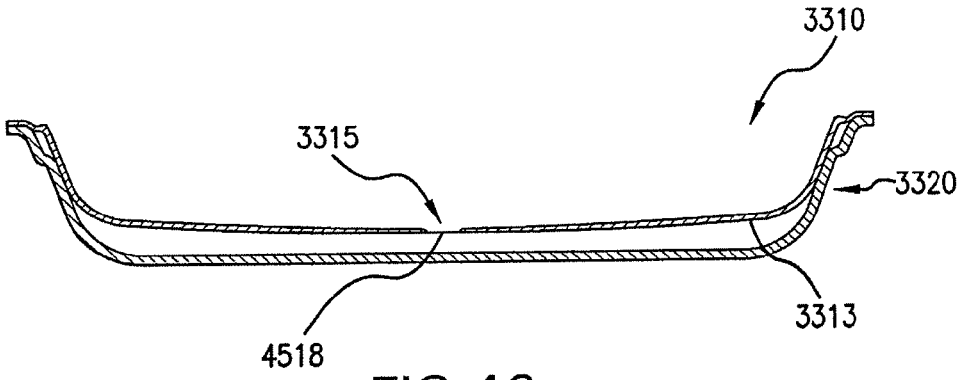

FIGS. 45 and 46 illustrate top and schematic cross-sectional views taken along line 46-46 of FIG. 45, respectively, of the container 3300 where a reed valve (4518 or 4519) has been applied to a bottom face 3313 of the second tray 3310. The reed valve can be square in shape, as indicated by line 4518 or substantially circular in shape, as indicated by line 4519. Such reed valve functions as described above in connection with the reed valve 2140 of FIG. 21.

Figure 47:
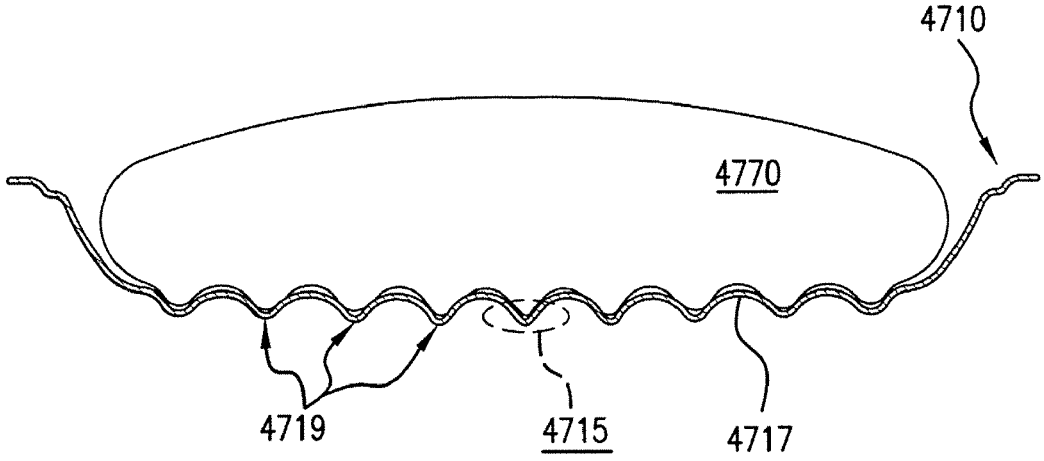
FIGS. 47 and 48 are schematic views illustrating advantages of particular tray geometry, in accordance with the invention.
Figure 48:
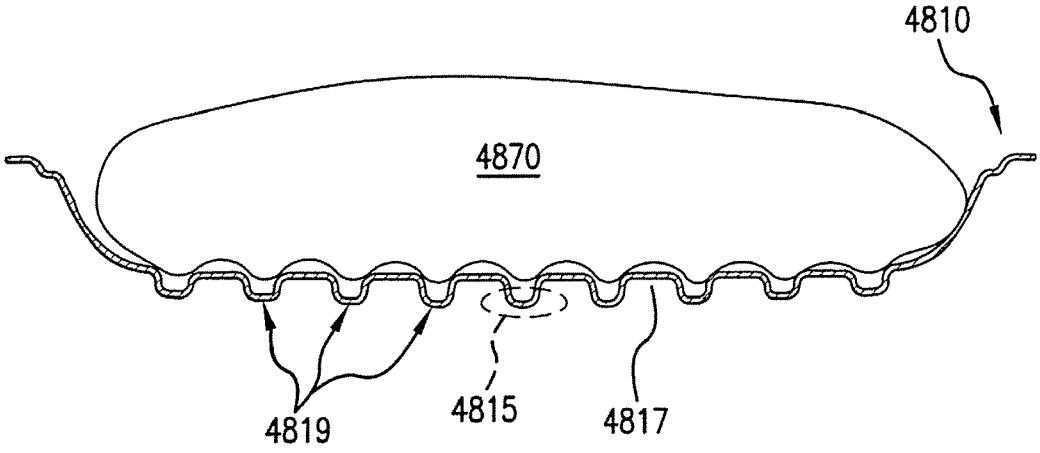

FIGS. 47 and 48 illustrate the advantage of providing the second tray (e.g., 4710, 4810), or any of the embodiments herein, with a relatively "radical" or abrupt geometry. As shown in FIG. 47, shallow raised surface features 4717, which have relatively large radii and smooth contours allow the contents 4770 of the tray to obscure the drain passages 4719 and drain aperture 4715. In contrast, in the embodiment of FIG. 48, the relatively sharp corners of the raised surface features 4817 of FIG. 48 help prevent the contents 4870 from obscuring the drain passages 4819 and the drain aperture 4815. Further, as the height of the raised surface features increases with respect to the bottom of the drain passages, the less likely will it be that the passages will become blocked by the contents.

Figure 49:
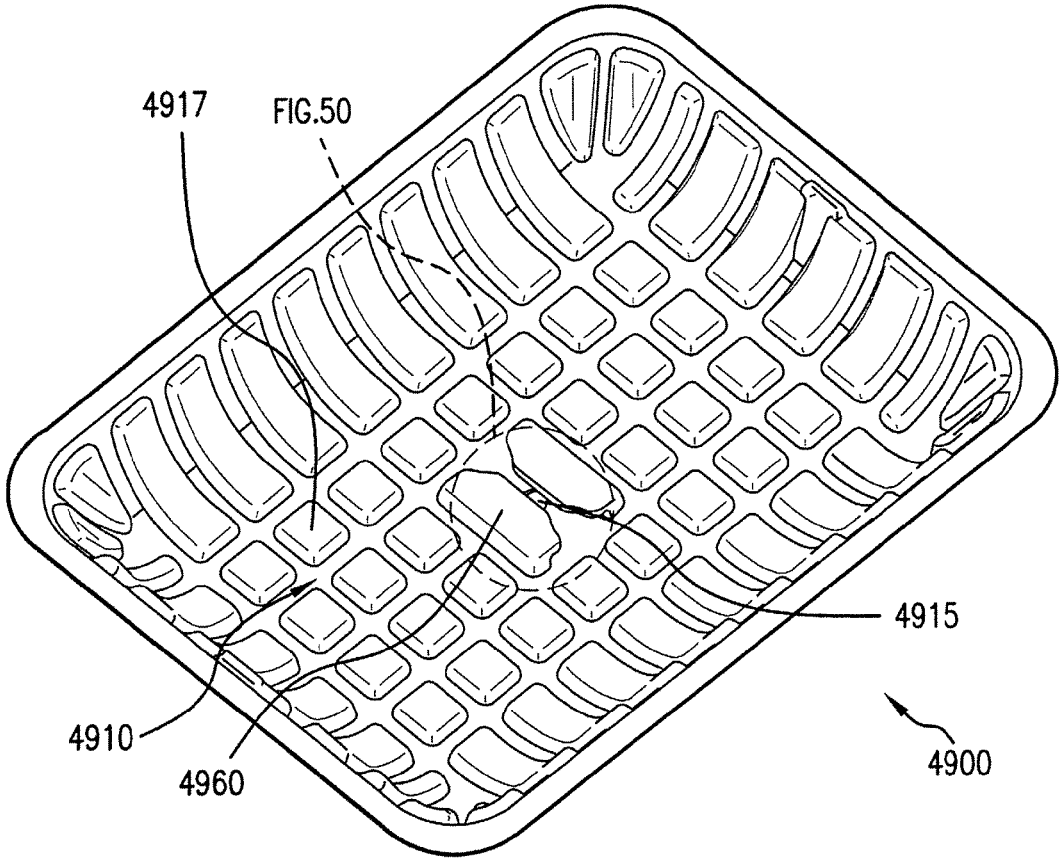
FIGS. 49 and 50 illustrate one embodiment of a container having an internal reservoir, in accordance with another aspect of the invention, where the container has a structure to prevent obstruction of the drain aperture.
Figure 50:
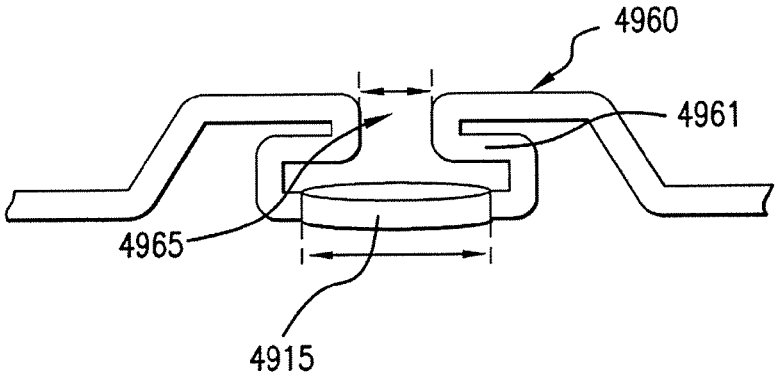

FIGS. 49 and 50 illustrate an alternate manner to prevent obstruction of the drain hole 4915. A protective structure 4960 is molded to extend above the aperture 4915. An undercut 4961 is provided to allow liquid to pass under the protective structure 4960 to reach the aperture 4915 and the reservoir. While such a structure can be manufactured in a number of different ways, and could completely cover the aperture 4915, this embodiment illustrates the structure 4960 having a gap 4965 on its upper surface, though the width of the gap 4965 is preferably less than the diameter of the drain aperture 4915. The gap 4965 also facilitates manufacture of this structure by way of a movable mold.

Figure 51A:
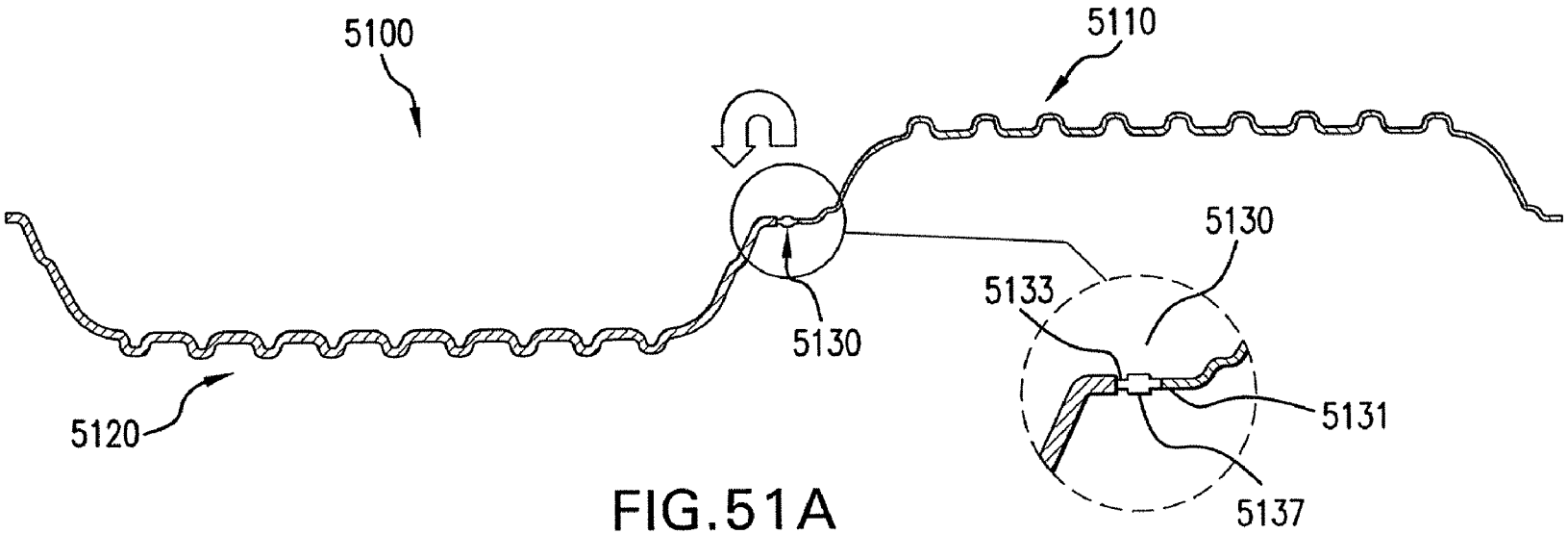
FIGS. 51A and 51B illustrate an embodiment of a container having an internal reservoir, in accordance with another aspect of the invention, where a hinge is provided to connect the first and second trays.
Figure 51B:
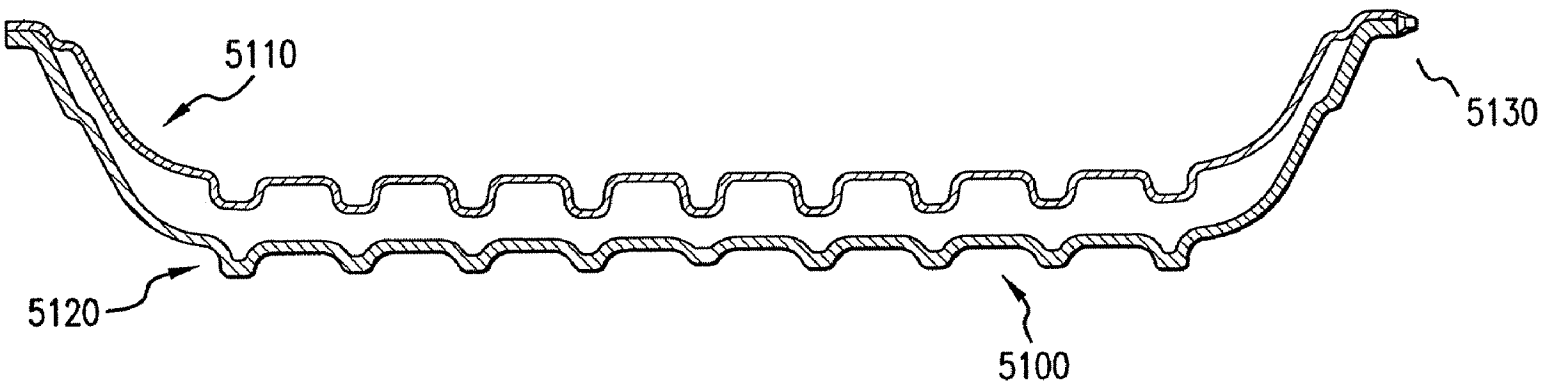

FIGS. 51A and 51B illustrate an embodiment of a container in accordance with the present invention. The container 5100 includes a first tray 5120, a second tray 5110, and an intervening connecting hinge 5130. The first tray 5120, second tray 5110, and hinge 5130 are preferably manufactured in one piece. The hinge 5130 includes reduced thickness portions 5131, 5133 on either side of a central portion 5137. The reduced thickness portions 5131, 5133 facilitate bending of the hinge, while the central portion 5137 provides strength and aides alignment of the first and second trays. The hinge obviates a seal in areas between where the hinge extends, for example, along one edge of the finished container 5100. Along the other edges, one of the sealing methods described herein can be used. As can be seen, the second tray 5110 is thinner than the first tray 5120, and has more abrupt raised surface features, which are facilitated by the thinness of the second tray 5110. The relative thickness of the second tray imparts increased strength to the container 5100.

Figure 52A:
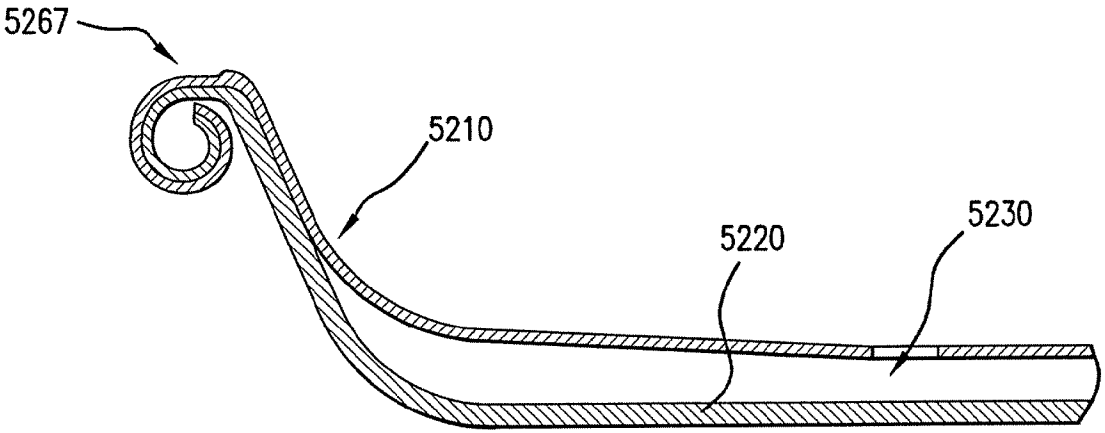
FIGS. 52A-D illustrate various embodiments of lip rolling techniques to seal together the first and second trays of a container having an internal reservoir, in accordance with the invention.
Figure 52D:
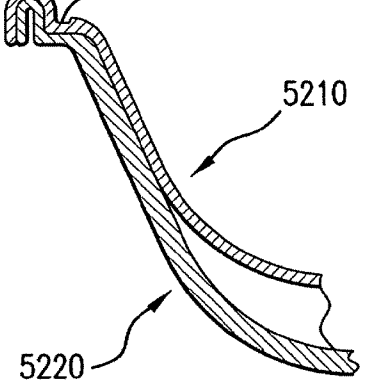
Figure 52C:
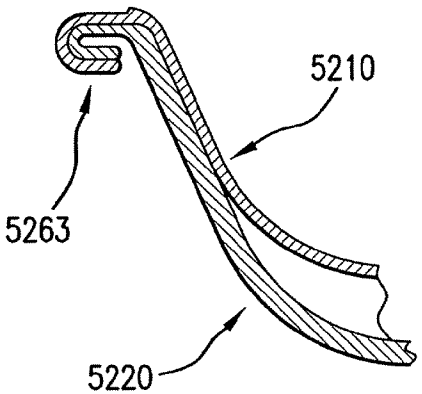
Figure 52B:
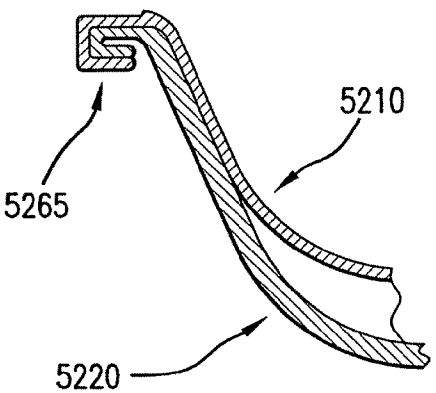

FIGS. 52A-C illustrate various embodiments of lip rolling techniques to seal first and second trays together. FIG. 52A illustrates a lip roll 5267 where the surface of the lip has been coined (compressed) to facilitate rolling.

In these lip-rolling techniques, force is used to deform the individual elements, thereby creating a connection. Adhesive and/or heat can be applied to facilitate attachment, but neither adhesive nor heat is required. Lip rolls 5265 and 5263 are variations of the lip roll 5267. Further, lip roll 5261 includes a crimp 5262 adjacent thereto to facilitate connection.

Alternatively, adhesive, cohesive, heat welding, ultrasonic welding or chemical bonding techniques or other techniques can be used to join the first and second trays to one another.

The trays can be molded from sheet material, or can be cast from liquid, powdered or pellet material.

Both the first and second trays can be the same material, color and pattern, or can alternatively be manufactured from different materials, colors or with different patterns.

The containers described herein can be manufactured from any suitable material, for example, expanded polystyrene foam, metal foil, such as aluminum foil, oriented polystyrene (OPS), polypropylene, mineral filled polypropylene, amorphous polyethylene terephthalate (APET), thermoplastics. It is to be understood that the foregoing list is not exhaustive, and that the containers can be made from other materials.

The above containers are typically manufactured in at least two parts. For example, the container 100 of FIGS. 1-3 can be made by forming the first tray 220 and second tray 110, and then joining them. If a valve is included, this is also manufactured separately and then applied to the container, or portion thereof.

The containers described herein can be of any shape desired, such as, for example, circular, rectangular, oblong, oval, or square. The containers can be used for packaging uncooked foods, but can also be used for cooking and/or holding of cooked food, such as a cooked chicken. Advantageously, the subject containers are capable of retaining the liquid exuded during and after cooking of a roast chicken, for example. If used for cooking, the materials used for the container must be capable of satisfactorily withstanding oven temperatures.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

What is claimed is:

1. A container comprising:

a first tray having a first bottom wall and a surrounding first sidewall extending generally upwardly from the first bottom wall to define a space therein; and a second tray having a second bottom wall and a surrounding second sidewall extending generally upwardly from the second bottom wall, the second bottom wall having at least one aperture defined in a central region thereof, the second bottom wall having an upper surface sloping downwardly toward the at least one aperture, the second sidewall has a top surface including at least two raised surface features defining a channel in fluid communication with the at least one aperture, and the second sidewall has a bottom surface including a recess defined by at least one of the raised surface features;

the second tray disposed within the space of the first tray with at least a portion of the second sidewall in contact with the first sidewall to define a chamber of a reservoir between the recess in the bottom surface of the second sidewall and the first sidewall, the reservoir in fluid communication with the aperture.

2. The container of claim 1, wherein the first tray has a substantially rectangular shape.

3. The container of claim 1, wherein the first sidewall extends upwardly and outwardly from the first bottom wall at a first angle between about 15 and 90 degrees.

4. The container of claim 3, wherein the angle is between about 45 and 60 degrees.

5. The container of claim 3, wherein the second sidewall extends upwardly and outwardly from the second bottom wall at a second angle, and wherein the first angle is greater than the second angle, to define a chamber between the first sidewall and the second sidewall.

6. The container of claim 1, wherein the first bottom wall has a central region aligned with the aperture of the second tray, and an upper surface sloping downwardly, away from the central region.

7. The container of claim 1, wherein the upper surface of the second bottom wall includes a raised surface feature.

8. The container of claim 7, wherein the raised surface feature of the second bottom wall is defined by at least one protrusion extending upwardly from the upper surface of the second bottom wall.

9. The container of claim 8, wherein the at least one protrusion has an elongate shape aligned in a non-radial orientation relative to the at least one aperture.

10. The container of claim 8, wherein the at least one protrusion is substantially perpendicular to at least one edge of the second sidewall.

11. The container of claim 8, wherein the at least one protrusion is spaced from the at least one aperture.

12. The container of claim 7, wherein the raised surface feature of the second bottom wall is defined by at least one depression formed in the second bottom wall.

13. The container of claim 12, wherein the at least one depression is a trough.

14. The container of claim 13, wherein the trough is substantially radial, relative to the at least one aperture.

15. The container of claim 1, wherein an upper surface of the first tray includes cooperating elements to support the second tray.

16. The container of claim 15, wherein the cooperating elements extend from the upper surface of the first tray and cooperate with a lower surface of the second tray.

17. The container of claim 15, wherein the second tray has a lower surface with a plurality of depressions formed therein, the cooperating elements of the first tray correspond in location with the depressions formed in the second tray.

18. The container of claim 1, wherein the aperture is arranged relative to the reservoir such that a first volume of liquid capable of being retained within the reservoir when oriented in a first position is substantially equal to a second volume of liquid capable of being retained within the reservoir when oriented in a second position.

19. The container of claim 18, wherein the first position comprises the container oriented generally horizontally, and the second position comprises the container oriented generally vertically.

20. The container of claim 18, wherein the first position comprises the container being oriented horizontally, with a lower surface of the bottom wall of the first tray facing downward, and the second position comprises the container being oriented horizontally, a lower surface of the bottom wall of the first tray facing upward.

21. The container of claim 1, wherein the central region is defined along a centerline of the upper surface of the second tray.

22. A container for a perishable product, the container comprising:

a first tray having a first bottom wall and a surrounding first sidewall extending generally upwardly from the first bottom wall to define a space therein; and a second tray having a second bottom wall and a surrounding second sidewall extending generally upwardly from the second bottom wall, the second bottom wall having at least one aperture defined in a central region thereof, the second bottom wall having an upper surface sloping downwardly toward the at least one aperture, the second sidewall has a top surface including a plurality of raised surface features, defining at least one channel in fluid communication with the at least one aperture, and the second sidewall has a bottom surface including a plurality of recesses defined by the raised surface features;

the second tray disposed within the space of the first tray to define a reservoir therebetween, at least a portion of the second sidewall in contact with the first sidewall to define a chamber of the reservoir between each recess in the bottom surface of the second sidewall and the first sidewall in fluid communication with the aperture.

23. The container of claim 22, wherein the central region is defined along a centerline of the upper surface of the second tray.

24. A container for a perishable product, the container comprising:

a first tray having a first bottom wall and a surrounding first sidewall extending generally upwardly from the first bottom wall to define a space therein; and a second tray having a second bottom wall and a surrounding second sidewall extending generally upwardly from the second bottom wall, the second bottom wall having at least one aperture defined in a central region thereof, the second sidewall has a top surface including at least two raised surface features defining a channel in fluid communication with the at least one aperture, and the second sidewall has a bottom surface including at least one recess defined by at least one of the raised surface features, the second bottom wall having an upper surface sloping downwardly toward the at least one aperture, the upper surface of the second bottom wall further including a raised surface feature;

the second tray disposed within the space of the first tray with at least a portion of the second sidewall in contact with the first sidewall to define a chamber of a reservoir between the the at least one recess in the bottom surface of the second sidewall and the first sidewall, the reservoir in fluid communication with the aperture.

25. The container of claim 24, wherein the raised surface feature of the second bottom wall includes at least one protrusion.

26. The container of claim 24, wherein the raised surface feature of the second bottom wall includes at least one depression.

27. The container of claim 24, wherein the raised surface feature of the second bottom wall includes at least one protrusion and at least one depression.

28. The container of claim 24, wherein the central region is defined along a centerline of the upper surface of the second tray.

* * * * *